US011661824B2

(12) United States Patent
Eitschberger et al.

(10) Patent No.: US 11,661,824 B2
(45) Date of Patent: May 30, 2023

(54) AUTONOMOUS PERFORATING DRONE

(71) Applicant: DynaEnergetics Europe GmbH, Troisdorf (DE)

(72) Inventors: Christian Eitschberger, Munich (DE); Liam McNelis, Bonn (DE); Thilo Scharf, Letterkenny (IE); Andreas Robert Zemla, Much (DE); Shmuel Silverman, Novato, CA (US); Gernot Uwe Burmeister, Austin, TX (US); Arash Shahinpour, Troisdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 17/835,468

(22) Filed: Jun. 8, 2022

(65) Prior Publication Data

US 2022/0333467 A1 Oct. 20, 2022

Related U.S. Application Data

(63) Continuation of application No. 16/542,890, filed on Aug. 16, 2019, now abandoned, which is a (Continued)

(51) Int. Cl.
*E21B 43/1185* (2006.01)
*E21B 33/068* (2006.01)
*E21B 47/09* (2012.01)

(52) U.S. Cl.
CPC ..... *E21B 43/1185* (2013.01); *E21B 33/068* (2013.01); *E21B 47/09* (2013.01)

(58) Field of Classification Search
CPC ..... E21B 43/1185; E21B 33/068; E21B 47/09
See application file for complete search history.

(56) References Cited

U.S. PATENT DOCUMENTS 2,062,974 A 12/1936 Lane
2,216,359 A 10/1940 Spencer
(Continued)

FOREIGN PATENT DOCUMENTS

AR 021476 A1 7/2002
AR 109754 A1 1/2019
(Continued)

OTHER PUBLICATIONS

US 11,274,530 B2, 03/2022, Eitschberger et al. (withdrawn)
(Continued)

*Primary Examiner* — Christopher J Sebesta
(74) *Attorney, Agent, or Firm* — Womble Bond Dickinson (US) LLP

(57) ABSTRACT

According to some embodiments, an autonomous perforating drone for downhole delivery of a wellbore tool, and associated systems and methods, are disclosed. In an aspect, the wellbore tool may be a plurality of shaped charges that are arranged in a variety of configurations, including helically, in one or more single radial planes, or opposing around a perforating assembly section, and detonated in a top-to-bottom sequence when the autonomous perforating drone reaches a predetermined depth in the wellbore. In another aspect, the shaped charges may be received in shaped charge apertures within a body of a perforating assembly section, wherein the shaped charge apertures are respectively positioned adjacent to at least one of a receiver booster, detonator, and detonating cord for directly initiating the shaped charges.

20 Claims, 28 Drawing Sheets

Related U.S. Application Data continuation-in-part of application No. 16/537,720, filed on Aug. 12, 2019, now Pat. No. 11,408,279, and a continuation-in-part of application No. 16/455,816, filed on Jun. 28, 2019, now Pat. No. 10,844,696, and a continuation-in-part of application No. PCT/EP2019/066919, filed on Jun. 25, 2019, and a continuation-in-part of application No. 16/451,440, filed on Jun. 25, 2019, now Pat. No. 10,794,159, and a continuation-in-part of application No. PCT/IB2019/000526, filed on Apr. 12, 2019, and a continuation-in-part of application No. PCT/IB2019/000530, filed on Mar. 29, 2019, said application No. PCT/IB2019/000526 is a continuation-in-part of application No. PCT/IB2019/000537, filed on Mar. 18, 2019, said application No. 16/455,816 is a continuation of application No. 16/272,326, filed on Feb. 11, 2019, now Pat. No. 10,458,213, said application No. 16/542,890 is a continuation-in-part of application No. 16/272,326, filed on Feb. 11, 2019, now Pat. No. 10,458,213.

(60) Provisional application No. 62/842,329, filed on May 2, 2019, provisional application No. 62/831,215, filed on Apr. 9, 2019, provisional application No. 62/827,468, filed on Apr. 1, 2019, provisional application No. 62/823,737, filed on Mar. 26, 2019, provisional application No. 62/816,649, filed on Mar. 11, 2019, provisional application No. 62/780,427, filed on Dec. 17, 2018, provisional application No. 62/720,638, filed on Aug. 21, 2018, provisional application No. 62/765,185, filed on Aug. 20, 2018, provisional application No. 62/699,484, filed on Jul. 17, 2018, provisional application No. 62/690,314, filed on Jun. 26, 2018, provisional application No. 62/678,636, filed on May 31, 2018.

(56) References Cited

U.S. PATENT DOCUMENTS

| | | | |
|---|---|---|---|
| 2,418,486 | A | 4/1947 | Smylie |
| 2,667,836 | A | 2/1954 | Church et al. |
| 2,742,857 | A | 4/1956 | Turechek |
| 3,013,491 | A | 12/1961 | Poulter |
| 3,019,731 | A | 2/1962 | David et al. |
| 3,173,992 | A | 3/1965 | Boop |
| 3,235,005 | A | 2/1966 | Jacques |
| 3,255,659 | A | 6/1966 | Venghiattis |
| 3,327,630 | A | 6/1967 | Bell |
| 3,565,188 | A | 2/1971 | Hakala |
| 3,589,453 | A | 6/1971 | Venghiattis |
| 3,777,663 | A | 12/1973 | Brown |
| 4,007,796 | A | 2/1977 | Boop |
| 4,074,630 | A | 2/1978 | Zondag |
| 4,100,978 | A | 7/1978 | Boop |
| 4,140,188 | A | 2/1979 | Vann |
| 4,266,613 | A | 5/1981 | Boop |
| 4,269,120 | A | 5/1981 | Brede et al. |
| 4,273,047 | A | 6/1981 | Rommer |
| 4,312,273 | A | 1/1982 | Camp |
| 4,319,526 | A | 3/1982 | DerMott |
| 4,457,383 | A | 7/1984 | Boop |
| 4,496,008 | A | 1/1985 | Pottier et al. |
| 4,523,650 | A | 6/1985 | Sehnert et al. |
| 4,598,775 | A | 7/1986 | Vann et al. |
| 4,609,057 | A | 9/1986 | Walker et al. |
| 4,619,333 | A | 10/1986 | George |
| 4,621,396 | A | 11/1986 | Walker et al. |
| 4,635,734 | A | 1/1987 | Donovan et al. |
| 4,650,009 | A | 3/1987 | McClure et al. |
| 4,657,089 | A | 4/1987 | Stout |
| 4,739,839 | A | 4/1988 | Regalbuto et al. |
| 4,747,201 | A | 5/1988 | Donovan et al. |
| 4,753,170 | A | 6/1988 | Regalbuto et al. |
| 4,769,734 | A | 9/1988 | Heinemeyer et al. |
| 4,784,061 | A | 11/1988 | Christopher |
| 4,790,383 | A | 12/1988 | Savage et al. |
| 4,800,815 | A | 1/1989 | Appledorn et al. |
| 4,808,925 | A | 2/1989 | Baird |
| 4,817,531 | A | 4/1989 | Walker et al. |
| 4,860,653 | A | 8/1989 | Abouav |
| 4,881,445 | A | 11/1989 | Hayes |
| 4,986,183 | A | 1/1991 | Jacob et al. |
| 5,007,486 | A | 4/1991 | Rides |
| 5,027,708 | A | 7/1991 | Gonzalez et al. |
| 5,060,573 | A | 10/1991 | Montgomery et al. |
| 5,090,321 | A | 2/1992 | Abouav |
| 5,105,742 | A | 4/1992 | Sumner |
| 5,159,145 | A | 10/1992 | Carisella et al. |
| 5,159,146 | A | 10/1992 | Carisella et al. |
| 5,165,489 | A | 11/1992 | Langston |
| 5,223,665 | A | 6/1993 | Burleson et al. |
| 5,237,136 | A | 8/1993 | Langston |
| 5,385,098 | A | 1/1995 | Lindqvist et al. |
| 5,392,860 | A | 2/1995 | Ross |
| 5,603,384 | A | 2/1997 | Bethel et al. |
| 5,648,635 | A | 7/1997 | Lussier et al. |
| 5,673,760 | A | 10/1997 | Brooks et al. |
| 5,775,426 | A | 7/1998 | Snider et al. |
| 5,785,130 | A | 7/1998 | Wesson et al. |
| 5,816,343 | A | 10/1998 | Markel et al. |
| 5,837,925 | A | 11/1998 | Nice |
| 5,992,289 | A | 11/1999 | George et al. |
| 6,006,833 | A | 12/1999 | Burleson et al. |
| 6,021,095 | A | 2/2000 | Tubel et al. |
| 6,079,332 | A | 6/2000 | Marshall et al. |
| 6,098,707 | A | 8/2000 | Pastusek et al. |
| 6,112,666 | A | 9/2000 | Murray et al. |
| 6,216,596 | B1 | 4/2001 | Wesson |
| 6,222,749 | B1 | 4/2001 | Peron |
| 6,283,214 | B1 | 9/2001 | Guinot et al. |
| 6,298,915 | B1 | 10/2001 | George |
| 6,333,699 | B1 | 12/2001 | Zierolf |
| 6,412,415 | B1 | 7/2002 | Kothari et al. |
| 6,418,853 | B1 * | 7/2002 | Duguet ..... F42B 3/121 102/202.7 |
| 6,439,121 | B1 | 8/2002 | Gillingham |
| 6,453,817 | B1 | 9/2002 | Markel et al. |
| 6,487,973 | B1 | 12/2002 | Gilbert, Jr. et al. |
| 6,497,285 | B2 | 12/2002 | Walker |
| 6,506,083 | B1 | 1/2003 | Bickford et al. |
| 6,520,258 | B1 | 2/2003 | Yang et al. |
| 6,779,605 | B2 | 8/2004 | Jackson |
| 6,785,116 | B1 | 8/2004 | Hummel et al. |
| 6,820,693 | B2 | 11/2004 | Hales et al. |
| 6,843,317 | B2 | 1/2005 | Mackenzie |
| 6,843,318 | B2 | 1/2005 | Yarbro |
| 6,938,689 | B2 | 9/2005 | Farrant et al. |
| 7,044,230 | B2 | 5/2006 | Starr et al. |
| 7,093,664 | B2 | 8/2006 | Todd et al. |
| 7,168,494 | B2 | 1/2007 | Starr et al. |
| 7,278,491 | B2 | 10/2007 | Scott |
| 7,301,750 | B2 | 11/2007 | DeVries et al. |
| 7,322,416 | B2 | 1/2008 | Burris, II et al. |
| 7,347,278 | B2 | 3/2008 | Lerche et al. |
| 7,347,279 | B2 | 3/2008 | Li et al. |
| 7,353,879 | B2 | 4/2008 | Todd et al. |
| 7,363,967 | B2 | 4/2008 | Burris et al. |
| 7,441,601 | B2 | 10/2008 | George et al. |
| 7,464,647 | B2 | 12/2008 | Teowee et al. |
| 7,735,578 | B2 | 6/2010 | Loehr et al. |
| 7,752,971 | B2 | 7/2010 | Loehr |
| 7,762,351 | B2 | 7/2010 | Vidal |
| 7,775,279 | B2 | 8/2010 | Marya et al. |
| 7,802,619 | B2 | 9/2010 | Hurst et al. |
| 7,980,309 | B2 | 7/2011 | Crawford |
| 8,056,632 | B2 | 11/2011 | Goodman |
| 8,066,083 | B2 | 11/2011 | Hales et al. |
| 8,141,434 | B2 | 3/2012 | Kippersund et al. |
| 8,151,882 | B2 | 4/2012 | Grigar et al. |

(56) References Cited

U.S. PATENT DOCUMENTS 8,327,746 B2 12/2012 Behrmann et al.
8,342,094 B2 1/2013 Marya et al.
8,413,727 B2 4/2013 Holmes
8,505,632 B2 8/2013 Guerrero et al.
8,582,275 B2 11/2013 Yan et al.
8,596,378 B2 12/2013 Mason et al.
8,695,506 B2 4/2014 Lanclos
8,810,247 B2 8/2014 Kuckes
8,863,665 B2 10/2014 DeVries et al.
8,875,787 B2 * 11/2014 Tassaroli ..... E21B 43/1185 175/2
8,881,816 B2 11/2014 Glenn et al.
8,899,322 B2 12/2014 Cresswell et al.
8,904,935 B1 12/2014 Brown et al.
8,950,480 B1 2/2015 Strickland
8,981,957 B2 3/2015 Gano et al.
8,985,023 B2 3/2015 Mason
9,062,539 B2 6/2015 Schmidt et al.
9,133,695 B2 9/2015 Xu
9,145,748 B1 9/2015 Meier et al.
9,157,718 B2 10/2015 Ross
9,194,219 B1 11/2015 Hardesty et al.
9,206,675 B2 12/2015 Hales et al.
9,267,346 B2 2/2016 Robertson et al.
9,279,306 B2 3/2016 Baihly
9,284,819 B2 3/2016 Tolman et al.
9,284,824 B2 3/2016 Fadul et al.
9,291,039 B2 3/2016 King et al.
9,291,435 B2 3/2016 Scheid et al.
9,297,242 B2 3/2016 Zhang et al.
9,317,038 B2 4/2016 Ozick et al.
9,359,863 B2 6/2016 Streich et al.
9,359,884 B2 6/2016 Hallundbaek et al.
9,382,783 B2 7/2016 Langford et al.
9,383,237 B2 7/2016 Wiklund et al.
9,441,470 B2 9/2016 Guerrero et al.
9,464,508 B2 10/2016 Lerche et al.
9,494,021 B2 11/2016 Parks et al.
9,523,255 B2 12/2016 Andrzejak
9,574,416 B2 2/2017 Wright et al.
9,581,422 B2 2/2017 Preiss et al.
9,605,937 B2 3/2017 Eitschberger et al.
9,617,829 B2 4/2017 Dale et al.
9,650,848 B2 5/2017 Taylor et al.
9,689,223 B2 6/2017 Schacherer et al.
9,695,645 B2 7/2017 Tilley et al.
9,702,680 B2 7/2017 Parks et al.
9,726,005 B2 8/2017 Hallundbaek et al.
9,784,549 B2 10/2017 Eitschberger
9,790,763 B2 10/2017 Fripp et al.
9,797,238 B2 10/2017 Frosell et al.
9,903,192 B2 2/2018 Entchev et al.
9,903,695 B1 2/2018 Goodman et al.
9,915,513 B1 3/2018 Zemla et al.
9,926,755 B2 3/2018 Van Petegem et al.
9,963,955 B2 5/2018 Tolman et al.
10,000,994 B1 6/2018 Sites
10,001,007 B2 6/2018 Pelletier et al.
10,060,234 B2 8/2018 Robey et al.
10,066,921 B2 9/2018 Eitschberger
10,077,641 B2 9/2018 Rogman et al.
10,138,713 B2 11/2018 Tolman et al.
10,151,180 B2 12/2018 Robey et al.
10,267,611 B2 4/2019 Lownds et al.
10,281,249 B2 5/2019 Rueda et al.
10,352,144 B2 7/2019 Entchev et al.
10,352,674 B2 7/2019 Eitschberger
10,365,078 B2 7/2019 Eitschberger
10,400,558 B1 9/2019 Shahinpour et al.
10,458,213 B1 10/2019 Eitschberger et al.
10,502,036 B2 12/2019 Spring
10,598,002 B2 3/2020 Sites
10,605,037 B2 3/2020 Eitschberger et al.
10,605,578 B2 3/2020 Zemla et al.
10,746,003 B2 8/2020 Yang et al.
10,794,159 B2 10/2020 Eitschberger et al.
10,830,566 B2 11/2020 Maxted et al.
10,844,684 B2 11/2020 Eitschberger
10,844,696 B2 11/2020 Eitschberger et al.
10,858,919 B2 12/2020 Anthony et al.
10,914,147 B2 2/2021 Sullivan et al.
10,927,650 B2 2/2021 Schultz et al.
10,954,760 B2 3/2021 Mcnelis et al.
10,982,513 B2 4/2021 Gupta et al.
10,982,941 B2 4/2021 Eitschberger
11,047,189 B2 6/2021 Fernandes et al.
11,199,076 B2 12/2021 Collins et al.
11,286,756 B2 3/2022 Harrigan et al.
11,339,632 B2 5/2022 Eitschberger et al.
11,448,043 B2 9/2022 Bradley et al.
2002/0062991 A1 5/2002 Farrant et al.
2002/0145423 A1 10/2002 Yoo
2004/0216632 A1 11/2004 Finsterwald
2005/0011390 A1 1/2005 Jennings
2005/0178282 A1 8/2005 Brooks et al.
2005/0183610 A1 8/2005 Barton et al.
2005/0194146 A1 9/2005 Barker et al.
2005/0202720 A1 9/2005 Burke et al.
2005/0229805 A1 10/2005 Myers, Jr. et al.
2005/0241824 A1 11/2005 Burris et al.
2005/0241825 A1 11/2005 Burris et al.
2005/0241835 A1 11/2005 Burris et al.
2005/0269083 A1 12/2005 Burris, II et al.
2007/0125540 A1 6/2007 Gerez et al.
2008/0047456 A1 2/2008 Li et al.
2008/0110612 A1 5/2008 Prinz et al.
2008/0121095 A1 5/2008 Han et al.
2008/0134922 A1 * 6/2008 Grattan ..... F42C 15/005 102/206
2008/0149338 A1 6/2008 Goodman et al.
2008/0173204 A1 7/2008 Anderson et al.
2008/0264639 A1 10/2008 Parrott et al.
2009/0050322 A1 * 2/2009 Hill ..... E21B 43/11852 166/55.1
2009/0151949 A1 6/2009 Marya et al.
2009/0159285 A1 6/2009 Goodman
2009/0183916 A1 7/2009 Pratt et al.
2010/0000789 A1 1/2010 Barton et al.
2010/0065302 A1 3/2010 Nesbitt
2010/0089643 A1 4/2010 Vidal
2010/0163224 A1 7/2010 Strickland
2011/0024116 A1 2/2011 McCann et al.
2012/0085538 A1 4/2012 Guerrero et al.
2012/0152542 A1 6/2012 Le
2012/0160491 A1 6/2012 Goodman et al.
2012/0180678 A1 7/2012 Kneisl
2012/0199352 A1 8/2012 Lanclos et al.
2012/0226443 A1 9/2012 Cresswell et al.
2012/0247769 A1 10/2012 Schacherer et al.
2012/0281829 A1 11/2012 Rudakevych et al.
2012/0298361 A1 11/2012 Sampson
2013/0008639 A1 1/2013 Tassaroli
2013/0048376 A1 2/2013 Rodgers et al.
2013/0062055 A1 3/2013 Tolman et al.
2013/0118805 A1 5/2013 Moody-Stuart et al.
2013/0153205 A1 6/2013 Borgfeld et al.
2013/0199843 A1 8/2013 Ross
2013/0220613 A1 8/2013 Brooks et al.
2013/0248174 A1 9/2013 Dale et al.
2014/0053750 A1 2/2014 Lownds et al.
2014/0076542 A1 3/2014 Whitsitt et al.
2014/0131035 A1 * 5/2014 Entchev ..... E21B 33/1204 166/53
2014/0218207 A1 8/2014 Gano et al.
2015/0176386 A1 6/2015 Castillo et al.
2015/0226044 A1 8/2015 Ursi et al.
2015/0275615 A1 10/2015 Rytlewski et al.
2015/0330192 A1 11/2015 Rogman et al.
2015/0337648 A1 11/2015 Zippel et al.
2015/0354310 A1 12/2015 Zaiser
2015/0361774 A1 12/2015 Flores
2015/0376991 A1 12/2015 McNelis et al.
2016/0040520 A1 2/2016 Tolman et al.
2016/0061572 A1 3/2016 Eitschberger et al.

(56) References Cited

U.S. PATENT DOCUMENTS

| | | | |
|---|---|---|---|
| 2016/0069163 | A1 | 3/2016 | Tolman et al. |
| 2016/0084048 | A1 | 3/2016 | Harrigan et al. |
| 2016/0084075 | A1 | 3/2016 | Ingraham et al. |
| 2016/0168961 | A1 | 6/2016 | Parks et al. |
| 2016/0169639 | A1 | 6/2016 | Smart et al. |
| 2016/0258240 | A1 | 9/2016 | Fripp et al. |
| 2016/0273902 | A1 | 9/2016 | Eitschberger |
| 2016/0290098 | A1 | 10/2016 | Marya |
| 2016/0320769 | A1 | 11/2016 | Deffenbaugh et al. |
| 2016/0356132 | A1 | 12/2016 | Burmeister et al. |
| 2016/0369620 | A1 | 12/2016 | Pelletier et al. |
| 2017/0030693 | A1 | 2/2017 | Preiss et al. |
| 2017/0052011 | A1 | 2/2017 | Parks et al. |
| 2017/0058649 | A1 | 3/2017 | Geerts et al. |
| 2017/0145798 | A1 | 5/2017 | Robey et al. |
| 2017/0167233 | A1 | 6/2017 | Sampson et al. |
| 2017/0175500 | A1 | 6/2017 | Robey et al. |
| 2017/0199015 | A1 | 7/2017 | Collins et al. |
| 2017/0211363 | A1 | 7/2017 | Bradley et al. |
| 2017/0241244 | A1* | 8/2017 | Barker ..... E21B 43/117 |
| 2017/0268326 | A1 | 9/2017 | Tao et al. |
| 2017/0268860 | A1 | 9/2017 | Eitschberger |
| 2017/0275976 | A1 | 9/2017 | Collins et al. |
| 2017/0314372 | A1 | 11/2017 | Tolman et al. |
| 2017/0357021 | A1 | 12/2017 | Valero et al. |
| 2018/0003045 | A1 | 1/2018 | Dotson et al. |
| 2018/0030334 | A1 | 2/2018 | Collier et al. |
| 2018/0045498 | A1 | 2/2018 | Teowee et al. |
| 2018/0087369 | A1 | 3/2018 | Sherman et al. |
| 2018/0100387 | A1 | 4/2018 | Kouchmeshky et al. |
| 2018/0135398 | A1 | 5/2018 | Entchev et al. |
| 2018/0202789 | A1 | 7/2018 | Parks et al. |
| 2018/0209251 | A1 | 7/2018 | Robey et al. |
| 2018/0224260 | A1 | 8/2018 | Zemla et al. |
| 2018/0274342 | A1 | 9/2018 | Sites |
| 2018/0299239 | A1 | 10/2018 | Eitschberger et al. |
| 2018/0306010 | A1 | 10/2018 | Von Kaenel et al. |
| 2018/0318770 | A1 | 11/2018 | Eitschberger et al. |
| 2018/0340412 | A1 | 11/2018 | Singh et al. |
| 2018/0372460 | A1 | 12/2018 | Loehken et al. |
| 2019/0040722 | A1 | 2/2019 | Yang et al. |
| 2019/0049225 | A1 | 2/2019 | Eitschberger |
| 2019/0071963 | A1 | 3/2019 | Sites |
| 2019/0186241 | A1 | 6/2019 | Yang et al. |
| 2019/0284889 | A1 | 9/2019 | LaGrange et al. |
| 2019/0316449 | A1 | 10/2019 | Schultz et al. |
| 2019/0353013 | A1 | 11/2019 | Sokolove et al. |
| 2019/0368301 | A1 | 12/2019 | Eitschberger et al. |
| 2019/0368321 | A1 | 12/2019 | Eitschberger et al. |
| 2020/0018139 | A1 | 1/2020 | Eitschberger et al. |
| 2020/0063553 | A1 | 2/2020 | Zemla et al. |
| 2020/0370421 | A1 | 11/2020 | Fripp et al. |
| 2020/0400417 | A1 | 12/2020 | Eitschberger et al. |
| 2021/0040809 | A1 | 2/2021 | Eitschberger |
| 2021/0123330 | A1 | 4/2021 | Eitschberger et al. |
| 2021/0198983 | A1 | 7/2021 | Eitschberger et al. |
| 2021/0199002 | A1 | 7/2021 | Zemla et al. |
| 2021/0340847 | A1 | 11/2021 | Davis et al. |
| 2022/0170727 | A1 | 6/2022 | Eitschberger |
| 2022/0178230 | A1 | 6/2022 | Eitschberger et al. |
| 2022/0282578 | A1 | 9/2022 | Eitschberger |
| 2022/0372851 | A1 | 11/2022 | Preiss et al. |

FOREIGN PATENT DOCUMENTS

| | | | |
|---|---|---|---|
| AU | 741792 | B2 | 12/2001 |
| CA | 2385517 | A1 | 4/2001 |
| CA | 2821506 | A1 | 1/2015 |
| CA | 2941648 | A1 | 9/2015 |
| CA | 3101558 | A1 | 12/2019 |
| CA | 2821506 | C | 3/2020 |
| CA | 2933762 | C | 4/2020 |
| CN | 1217784 | A | 5/1999 |
| CN | 2648065 | | 10/2004 |
| CN | 101300403 | A | 11/2008 |
| CN | 201184775 | | 1/2009 |
| CN | 201607180 | U | 10/2010 |
| CN | 201620848 | U | 11/2010 |
| CN | 202810806 | U | 3/2013 |
| CN | 105377479 | A | 3/2016 |
| CN | 105392961 | A | 3/2016 |
| CN | 205577894 | U | 9/2016 |
| CN | 210564483 | U | 5/2020 |
| CN | 210598934 | U | 5/2020 |
| CN | 211115936 | U | 7/2020 |
| CN | 111971453 | A | 11/2020 |
| CN | 112424443 | A | 2/2021 |
| CN | 109373835 | B | 4/2021 |
| CN | 109372475 | B | 5/2021 |
| CN | 112840101 | A | 5/2021 |
| CN | 213297926 | U | 5/2021 |
| CN | 113646505 | A | 11/2021 |
| CN | 114105720 | A | 3/2022 |
| CN | 114174632 | A | 3/2022 |
| CN | 217844937 | U | 11/2022 |
| DE | 4330195 | C1 | 11/1994 |
| DE | 10017703 | A1 | 5/2001 |
| EP | 0088516 | A1 | 9/1983 |
| EP | 1688584 | B1 | 8/2011 |
| EP | 2598830 | A1 | 6/2013 |
| EP | 2952675 | A2 | 9/2015 |
| EP | 3568664 | A1 | 11/2019 |
| EP | 3144630 | B1 | 1/2020 |
| EP | 3478928 | B1 | 6/2021 |
| GB | 839486 | A | 6/1960 |
| GB | 916870 | A | 1/1963 |
| GB | 2295664 | A | 6/1996 |
| GB | 2395970 | A | 6/2004 |
| GB | 2548101 | A | 9/2017 |
| JP | 2001515815 | A | 9/2001 |
| KR | 20180008177 | A | 1/2018 |
| RU | 2633904 | C1 | 10/2017 |
| WO | 9721067 | A1 | 6/1997 |
| WO | 9745696 | A1 | 12/1997 |
| WO | 1998046965 | A1 | 10/1998 |
| WO | 2009846965 | A1 | 10/1998 |
| WO | 9912773 | A1 | 3/1999 |
| WO | 2001004452 | A1 | 1/2001 |
| WO | 0123827 | A1 | 4/2001 |
| WO | 2011051435 | A2 | 5/2011 |
| WO | 2011146866 | A2 | 11/2011 |
| WO | 2011150251 | A1 | 12/2011 |
| WO | 2012135101 | A2 | 10/2012 |
| WO | 2012161854 | A2 | 11/2012 |
| WO | 2014089194 | A1 | 6/2014 |
| WO | 2015028204 | A3 | 3/2015 |
| WO | 2017147329 | A1 | 8/2017 |
| WO | 2018067598 | A1 | 4/2018 |
| WO | 2018141423 | A1 | 8/2018 |
| WO | 2018177733 | A1 | 10/2018 |
| WO | 2018182565 | A1 | 10/2018 |
| WO | 2019098991 | A1 | 5/2019 |
| WO | 2019147294 | A1 | 8/2019 |
| WO | 2019148009 | A2 | 8/2019 |
| WO | 2019229520 | A1 | 12/2019 |
| WO | 2019229521 | A1 | 12/2019 |
| WO | 2020002383 | A1 | 1/2020 |
| WO | 2020002983 | A1 | 1/2020 |
| WO | 2020200935 | A1 | 10/2020 |
| WO | 2021052974 | A2 | 3/2021 |
| WO | 2021191275 | A1 | 9/2021 |
| WO | 2021255030 | A1 | 12/2021 |
| WO | 2022135749 | A1 | 6/2022 |
| WO | 2022184732 | A1 | 9/2022 |
| WO | 2022256450 | A1 | 12/2022 |
| ZA | 200202372 | B | 3/2003 |

OTHER PUBLICATIONS

Wade et al., Field Tests Indicate New Perforating Devices Improve Efficiency in Casing Completion Operations, SPE 381, pp. 1069-1073, Oct. 1962, 5 pgs.

(56) References Cited

OTHER PUBLICATIONS

SIPO, Search Report dated Mar. 29, 2017, in Chinese: See Search Report for CN App. No. 201480040456.9, dated Jul. 11, 2017, 12 pgs.
World Intellectual Property Office, Search Report for GB Patent App. No. GB1700625.5, dated Jul. 11, 2017, dated Jul. 7, 2017, 5 pages.
GB Intellectual Property Office, Office Action dated Feb. 27, 2018, See Office Action for App. No. GB 1717516.7, dated Jul. 11, 2017, 6 pgs.
Norwegian Industrial Property Office, Office Action for NO Patent App. No. 20160017, dated Jul. 11, 2017, dated Mar. 15, 2017, 3 pgs.
Norwegian Industrial Property Office, Search Report for NO Patent App. No. 20160017, dated Jul. 11, 2017, dated Mar. 15, 2017, 2 pgs.
FIIP, Search Report dated Feb. 1, 2018, in Russian: See Search Report for RU App. No. 2016104882/03, dated Jul. 11, 2017, 7 pgs.
International Search Report of International Application No. PCT/CA2014/050673, issued Jul. 11, 2017, dated Oct. 9, 2014, 3 pgs.
Amit Govil, Selective Perforation: A Game Changer in Perforating Technology—Case Study, presented at the 2012 European and West African Perforating Symposium, 14 pgs.
UK Examination Report of United Kingdom Patent Application No. GB1600085.3, issued Jul. 11, 2017, dated Mar. 9, 2016, 1 pg.
International Written Opinion of International Application No. PCT/CA2014/050673, issued Jul. 11, 2017, dated Oct. 9, 2014, 4 pgs.
Jet Research Centers, Capsule Gun Perforating Systems, Alvarado, Texas, 26 pgs., https://www.jetresearch.com/content/dam/jrc/Documents/Books_Catalogs/07_Cap_Gun.pdf.
Hunting, Gun Systems and Accessories, 1 pg., http://www.hunting-intl.com/media/1976277/Wireline%20Capsule%20Gun%20Accessories.pdf.
Harrison Jet Gun Xtra Penetrator, website visited Nov. 29, 2018, 1 pg., https://www.google.com/search?harrison+jet+gun+xtra+penetrator&client=firefox-b-1-d&source=lnms&tbm=isch&sa=X&ved=0ahUKEwjY0KOQ1YTjAhXHmeAKHa00DeYQ_AUIESgC&biw=1440&bih=721#imgrc=ZlqpUcJ_-TL3IM:.
Intellectual Property India, Office Action of IN Application No. 201647004496, dated Jun. 7, 2019, 6 pgs.
Jet Research Centers, Capsule Gun Perforating Systems, Alvarado, Texas, 27 pgs., Jun. 12, 2019 https://www.jetresearch.com/content/dam/jrc/Documents/Books_Catalogs/07_Cap_Gun.pdf.
Kumar et al., Novel Miniature Firing circuit for semiconductor bridge detonator initiation, Armament Res. and Dev. Establishment, Feb. 14, 2015, 4 pages, http://www.academia.edu.
Marketing White Paper: EQUAfrac Shaped Charge; Exhibit 1017 of PGR No. 2021-00089; dated Jan. 2017; 5 pages.
Micro Smart Systems, Slickline Triggers & Perforators, 1 pg., https://www.micro-smart.com/pdf/slickline_trigger_overview.pdf.
Norwegian Industrial Property Office, Search Report for NO Patent App. No. 20171759, dated Jan. 14, 2020, 2 pgs.
Norwegian Industrial Property Office; Office Action and Search Report for NO App. 20160017; dated Jun. 15, 2017; 5 pages.
Norwegian Industrial Property Office; Office Action for NO Application No. 20180507; dated Jan. 23, 2023; 3 pages.
Norwegian Industrial Property Office; Office Action for NO Application No. 20180507; dated Sep. 29, 2022; 2 pages.
Norwegian Industrial Property Office; Office Action for NO Application No. 20210799; dated Oct. 30, 2021; 2 pages.
Norwegian Industrial Property Office; Search Report for NO Application No. 20180507; dated Jan. 23, 2023; 2 pages.
Pool Supply World; Paramount—Threaded Nozzle Retainer Ring for Pool Valet, White; dated May 9, 2021; 3 pages; URL: https://poolsupplyworld.com/301817.html#description-btn-div.
QINETIQ Limited; Auxiliary Request in Opposition; dated Oct. 31, 2017; 99 pages.
QINETIQ Limited; QinetiQ Cover Letter stating Main and Auxiliary Requests; dated Sep. 8, 2017; 62 pages.
QINETIQ Limited; Response to Communication under Rule 79(1) EPC; dated Jan. 30, 2017; 12 pages.
QINTEQ Limited; Statement of Grounds of Appeal; dated Mar. 28, 2018; 112 pages.
Rodgers, John; Declaration for PGR No. 2021-00089; dated Sep. 16, 2021; 93 pages.
Schlumberger Technology Corporation; Exhibit A-01 to Defendant's Preliminary Invalidity Contentions Invalidity of U.S. Pat. No. 10,844,696 over WO20190148009; dated Aug. 19, 2021; 267 pages.
Schlumberger Technology Corporation; Exhibit A-02 to Defendant's Preliminary Invalidity Contentions Invalidity of U.S. Pat. No. 10,844,696 over U.S. Pat. No. 4,598,775; dated Aug. 19, 2021; 178 pages.
Schlumberger Technology Corporation; Exhibit A-03 to Defendant's Preliminary Invalidity Contentions Invalidity of U.S. Pat. No. 10,844,696 over U.S. Pat. No. 4,753,301; dated Aug. 19, 2021; 178 pages.
Schlumberger Technology Corporation; Exhibit A-04 to Defendant's Preliminary Invalidity Contentions Invalidity of U.S. Pat. No. 10,844,696 over U.S. Pat. No. 10,746,003; dated Aug. 19, 2021; 186 pages.
Schlumberger Technology Corporation; Exhibit A-05 to Defendant's Preliminary Invalidity Contentions Invalidity of U.S. Pat. No. 10,844,696 over WO2017/024266; dated Aug. 19, 2021; 247 pages.
Schlumberger Technology Corporation; Petitioner's Reply to Patent Owner's Preliminary Response; dated Oct. 13, 2021; 14 pages.
Schlumberger Technology Corporation; Petiton for Post Grant Review Case No. PGR2021-00089; dated Jun. 1, 2021; 155 pages.
Schlumberger, eFire Electronic Firing Head, 2019, 1 pg., www.slb.com.
Schlumberger; Exposed Perforating Gun Systems Through-tubing capsule gun systems; https://www.slb.com/completions/well-completions/perforating/perforating-gun-systems/exposed#related-information; Oct. 26, 2020; 5 pages.
Schlumberger; PowerSprial Nova Extradeep spiral-phased capsule gun perforating system Press Release; dated Oct. 22, 2020; Retrieved from web on Jaunary 18, 2021; https://www.slb.com/completions/well-completions/perforating/perforating-guns-and-charges/powerspiral-nova-capsule-gun-perforating-system; 2 pages.
Spartek Systems, Electronic Firing Head—Quick Change Trigger (QCT), May 2019, 3 pgs., https://www.sparteksystems.com/siteimages/Brochures/Flyer_Intelligent_Trigger.pdf.
The State Intellectual Property Office of P.R. China; Office Action for CN Application No. 201780082132.5; dated Mar. 5, 2021; 11 pages.
U.S. Department of Transporation; Classification of Explosives Fourth Revision; dated Jan. 31, 2014; 52 pages.
United States Patent and Trademark Office, Final Office Action of U.S. Appl. No. 16/455,816, dated Apr. 20, 2020, 21 pages.
United States Patent and Trademark Office, Final Office Action of U.S. Appl. No. 16/542,890, dated May 12, 2020, 16 pages.
United States Patent and Trademark Office, Non-Final Office Action of U.S. Appl. No. 16/451,440, dated Oct. 24, 2019, 22 pages.
United States Patent and Trademark Office, Non-Final Office Action of U.S. Appl. No. 16/455,816, dated Jan. 13, 2020, 14 pages.
United States Patent and Trademark Office, Non-Final Office Action of U.S. Appl. No. 16/455,816, dated Jul. 2, 2020, 15 pages.
United States Patent and Trademark Office, Non-Final Office Action of U.S. Appl. No. 16/455,816, dated Nov. 5, 2019, 17 pages.
United States Patent and Trademark Office, Non-Final Office Action of U.S. Appl. No. 16/760,955, dated Aug. 21, 2020, 14 pages.
United States Patent and Trademark Office, Non-final Office Action of U.S. Appl. No. 16/451,440, dated Oct. 24, 2019, 22 pgs.
United States Patent and Trademark Office, Notice of Allowance for U.S. Appl. No. 15/499,439, dated Nov. 17, 2017, 10 pages.
United States Patent and Trademark Office, Notice of Allowance for U.S. Appl. No. 15/880,153, dated Nov. 22, 2019, 9 pages.
United States Patent and Trademark Office, Notice of Allowance for U.S. Appl. No. 16/760,955, dated Dec. 9, 2020, 9 pages.
United States Patent and Trademark Office, Notice of Allowance of U.S. Appl. No. 16/272,326, dated Sep. 4, 2019. 9 pages.
United States Patent and Trademark Office, Office Action of U.S. Appl. No. 16/585,790, dated Nov. 12, 2019, 9 pgs.

(56) References Cited

OTHER PUBLICATIONS

United States Patent and Trademark Office; Decision Denying Institution of Post-Grant Review for PGR2021-00089; dated Dec. 14, 2021; 51 pages.
United States Patent and Trademark Office; Final Office Action for U.S. Appl. No. 16/451,440; dated Feb. 7, 2020; 11 pages.
United States Patent and Trademark Office; Final Office Action for U.S. Appl. No. 17/141,989; dated Sep. 30, 2022; 15 pages.
United States Patent and Trademark Office; Final Office Action for U.S. Appl. No. 17/221,219; dated Aug. 24, 2021; 14 pages.
United States Patent and Trademark Office; Final Office Action for U.S. Appl. No. 17/254,198; dated May 26, 2022; 19 pages.
United States Patent and Trademark Office; Final Office Action for U.S. Appl. No. 17/352,728; dated Mar. 9, 2022; 9 pages.
United States Patent and Trademark Office; U.S. Pat. No. 10,844,696.
United States Patent Trial and Appeal Board; Institution Decision for PGR 2020-00080; dated Feb. 12, 2021; 15 pages.
United States Patent Trial and Appeal Board; Record of Oral Hearing held Feb. 18, 2020 for IPR dated 2018-00600; dated Feb. 18, 2020; 27 pages.
WIPO; Invitation to Pay Additional Fees for PCT App No. PCT/EP2017/069327; mailed Oct. 20, 2017; 14 pages.
United States Patent and Trademark Office; Non-Final Office Action for U.S. Appl. No. 16/542,890; dated Nov. 4, 2019; 16 pages.
United States Patent and Trademark Office; Non-Final Office Action for U.S. Appl. No. 16/537,720 dated Jan. 26, 2022; 15 pages.
United States Patent and Trademark Office; Non-Final Office Action for U.S. Appl. No. 16/537,720 dated Jun. 15, 2021; 13 pages.
United States Patent and Trademark Office; Non-Final Office Action for U.S. Appl. No. 16/542,890, filed Sep. 30, 2020; 17 pages.
United States Patent and Trademark Office; Non-Final Office Action for U.S. Appl. No. 16/776,977 dated May 11, 2021; 6 pages.
United States Patent and Trademark Office; Non-Final Office Action for U.S. Appl. No. 16/809,729 dated Feb. 3, 2022; 6 pages.
United States Patent and Trademark Office; Non-Final Office Action for U.S. Appl. No. 16/809,729 dated Jun. 22, 2021; 15 pages.
United States Patent and Trademark Office; Non-Final Office Action for U.S. Appl. No. 16/919,473 dated Feb. 8, 2022; 12 pages.
United States Patent and Trademark Office; Non-Final Office Action for U.S. Appl. No. 17/004,966 dated Jul. 23, 2021; 22 pages.
United States Patent and Trademark Office; Non-Final Office Action for U.S. Appl. No. 17/007,574 dated May 6, 2022; 10 pages.
United States Patent and Trademark Office; Non-Final Office Action for U.S. Appl. No. 17/059,205 dated Jun. 16, 2022; 17 pages.
United States Patent and Trademark Office; Non-Final Office Action for U.S. Appl. No. 17/072,067 dated Mar. 31, 2022; 15 pages.
United States Patent and Trademark Office; Non-Final Office Action for U.S. Appl. No. 17/141,989 dated May 10, 2022; 12 pages.
United States Patent and Trademark Office; Non-Final Office Action for U.S. Appl. No. 17/162,579 dated Feb. 28, 2022; 16 pages.
United States Patent and Trademark Office; Non-Final Office Action for U.S. Appl. No. 17/221,219 dated Aug. 3, 2022; 8 pages.
United States Patent and Trademark Office; Non-Final Office Action for U.S. Appl. No. 17/221,219 dated Jun. 17, 2021; 10 pages.
United States Patent and Trademark Office; Non-Final Office Action for U.S. Appl. No. 17/254,198 dated Dec. 22, 2021; 17 pages.
United States Patent and Trademark Office; Non-Final Office Action for U.S. Appl. No. 17/352,728 dated Oct. 25, 2021; 9 pages.
United States Patent and Trademark Office; Non-Final Office Action for U.S. Appl. No. 17/383,816 dated Apr. 26, 2022; 11 pages.
United States Patent and Trademark Office; Non-Final Office Action for U.S. Appl. No. 17/383,816 dated Jan. 25, 2022; 23 pages.
United States Patent and Trademark Office; Non-Final Office Action for U.S. Appl. No. 17/524,837 dated Sep. 23, 2022; 7 pages.
United States Patent and Trademark Office; Non-Final Office Action for U.S. Appl. No. 17/608,173 dated Mar. 29, 2022; 5 pages.
United States Patent and Trademark Office; Non-Final Office Action for U.S. Appl. No. 17/627,780 dated Jan. 19, 2023; 9 pages.
United States Patent and Trademark Office; Non-Final Office Action for U.S. Appl. No. 17/835,468 dated Nov. 22, 2022; 16 pages.
United States Patent and Trademark Office; Non-Final Office Action of U.S. Appl. No. 15/499,439, filed Jul. 28, 2017; 13 pages.
United States Patent and Trademark Office; Non-Final Office Action of U.S. Appl. No. 15/880,153, filed Oct. 1, 2019 8 pages.
United States Patent and Trademark Office; Notice of Allowance for U.S. Appl. No. 16/451,440; dated Jun. 5, 2020; 8 pages.
United States Patent and Trademark Office; Notice of Allowance for U.S. Appl. No. 15/920,812 dated Aug. 4, 2021; 5 pages.
United States Patent and Trademark Office; Notice of Allowance for U.S. Appl. No. 16/455,816 dated Sep. 22, 2020; 12 pages.
United States Patent and Trademark Office; Notice of Allowance for U.S. Appl. No. 16/511,495 dated Dec. 15, 2020; 9 pages.
United States Patent and Trademark Office; Notice of Allowance for U.S. Appl. No. 16/537,720 dated Apr. 21, 2022; 9 pages.
United States Patent and Trademark Office; Notice of Allowance for U.S. Appl. No. 16/540,484 dated Jan. 5, 2023; 7 pages.
United States Patent and Trademark Office; Notice of Allowance for U.S. Appl. No. 16/640,372 dated Mar. 8, 2022; 8 pages.
United States Patent and Trademark Office; Notice of Allowance for U.S. Appl. No. 16/809,729 dated Sep. 21, 2022; 7 pages.
United States Patent and Trademark Office; Notice of Allowance for U.S. Appl. No. 16/886,257 dated Sep. 15, 2021; 9 pages.
United States Patent and Trademark Office; Notice of Allowance for U.S. Appl. No. 16/919,473 dated Jun. 14, 2022; 8 pages.
United States Patent and Trademark Office; Notice of Allowance for U.S. Appl. No. 16/924,504 dated Nov. 5, 2021; 5 pages.
United States Patent and Trademark Office; Notice of Allowance for U.S. Appl. No. 17/004,966 dated Nov. 5, 2021; 12 pages.
United States Patent and Trademark Office; Notice of Allowance for U.S. Appl. No. 17/007,574 dated May 21, 2021; 8 pages.
United States Patent and Trademark Office; Notice of Allowance for U.S. Appl. No. 17/007,574 dated Sep. 26, 2022; 8 pages.
United States Patent and Trademark Office; Patent Trial and Appeal Board Decision on Appeal; dated Apr. 11, 2022; 12 pages.
United States Patent and Trademark Office; Requirement for Restriction/Election for U.S. Appl. No. 16/537,720; dated Apr. 27, 2021; 8 pages.
United States Patent and Trademark Office; Requirement for Restriction/Election for U.S. Appl. No. 17/677,478; dated May 2, 2022; 7 pages.
United States Patent and Trademark Office; U.S. Appl. No. 62/621,999; dated Jan. 25, 2018; 42 pages.
United States Patent and Trademark Office; U.S. Appl. No. 62/627,591; dated Feb. 7, 2018; 40 pages.
United States Patent and Trademark Office; U.S. Appl. No. 62/736,298; dated Sep. 25, 2018; 120 pages.
U.S. Appl. No. 16/287,150, filed Feb. 27, 2019, Frank Haron Preiss.
U.S. Appl. No. 17/783,065, filed Jun. 7, 2022, Christian Eitschberger.
U.S. Appl. No. 17/971,708, filed Oct. 24, 2022, Joern Olaf Loehken.
U.S. Appl. No. 29/722,460, filed Jan. 30, 2020, Christian Eitschberger.
U.S. Appl. No. 29/722,461, filed Jan. 30, 2020, Christian Eitschberger.
U.S. Appl. No. 29/748,612, filed Aug. 31, 2020, Christian Eitschberger.
U.S. Appl. No. 62/699,484, filed Jul. 17, 2018, Christian Eitschberger.
U.S. Appl. No. 62/720,638, filed Aug. 21, 2018, Andreas Robert Zemla.
U.S. Appl. No. 62/780,427, filed Dec. 17, 2018, Christian Eitschberger.
U.S. Appl. No. 62/816,649, filed Mar. 11, 2019, Christian Eitschberger.
U.S. Appl. No. 62/842,329, filed May 2, 2019, Christian Eitschberger.
U.S. Appl. No. 62/847,488, filed May 14, 2019, Christian Eitschberger.
U.S. Appl. No. 62/853,824, filed May 29, 2019, Liam McNelis.
U.S. Appl. No. 62/861,601, filed Jun. 14, 2019, Christian Eitschberger.
U.S. Appl. No. 62/864,080, filed Jun. 20, 2019, Christian Eitschberger.
U.S. Appl. No. 62/876,447, filed Jul. 19, 2019, Christian Eitschberger.
U.S. Appl. No. 62/928,462, filed Oct. 31, 2019, Christian Eitschberger.
U.S. Appl. No. 62/939,982, filed Nov. 25, 2019, Christian Eitschberger.
U.S. Appl. No. 62/945,942, filed Dec. 10, 2019, Christian Eitschberger.
U.S. Appl. No. 62/957,381, filed Jan. 6, 2020, Thilo Scharf.
U.S. Appl. No. 63/001,766, filed Mar. 30, 2020, Christian Eitschberger.
U.S. Appl. No. 63/002,507, filed Mar. 31, 2020, Eric Mulhern.
U.S. Appl. No. 63/003,222, filed Mar. 31, 2020, Christian Eitschberger.
U.S. Appl. No. 63/090,770, filed Oct. 13, 2020, Joern Olaf Loehken.
U.S. Appl. No. 63/128,401, filed Dec. 21, 2020, Stefan Purcelean.
U.S. Appl. No. 63/155,902, filed Mar. 3, 20201, Christian Eitschberger.
U.S. Appl. No. 63/166,720, filed Mar. 26, 2021, Christian Eitschberger.

(56) References Cited

OTHER PUBLICATIONS

U.S. Appl. No. 63/271,464, filed Oct. 25, 2021, Joern Olaf Loehken.
U.S. Appl. No. 63/271,466, filed Oct. 25, 2021, Christian Eitschberger.
U.S. Appl. No. 63/347,056, filed May 31, 2022, Christian Eitschberger.
U.S. Appl. No. 63/385,368, filed Nov. 29, 2022, Thilo Scharf.
U.S. Appl. No. 63/386,984, filed Dec. 12, 2022, Christian Eitschberger.
U.S. Appl. No. 63/476,289, filed Dec. 20, 2022, Christian Eitschberger.
3M, CTC Medical Repair, Inc.; Threaded Retaining Ring for 3M K220 Sagittal Saw Attachment; dated Jul. 12, 2010; 1 page; URL: http://www.ctcmedrepair.com/sales/index.php?main_page=product_info&cPath=2_3&products_id=323.
Amit Govil, Selective Perforation: A Game Changer in Perforating Technology—Case Study, presented at the 2012 European and West African Perforating Symposium, Schlumberger, Nov. 7-9, 2012, 14 pgs.
Babu et al., Programmable Electronic Delay Device for Detonator, Defence Science Journal, May 2013, 3 pages, vol. 63, No. 3, https://doaj.org/article/848a537b12ae4a8b835391bec9.
Baker et al., Tendeka—Downhole wireless technology for production, Jul. 2018, 2 pgs., https://www.tendeka.com/wp-content/uploads/Downhole-wireless-technology-for-production-DEJ.pdf.
Bohanek, et al.; The Efficiency of Liner Shaped Charges; dated Jun. 2014; 8 pages.
DYNAENERGETICS Europe GMBH; Exposed Gun Subs & Accessories; dated May 23, 2017; https://www.dynaenergetics.com/products/hardware-and-tcp/perforating-gun-systems/exposed-gun-subs-accessories.
DYNAENERGETICS, DYNAselect Electronic Detonator 0015 SFDE RDX 1.4B, Product Information, Dec. 16, 2011, 1 pg.
DYNAENERGETICS, DYNAselect Electronic Detonator 0015 SFDE RDX 1.4S, Product Information, Dec. 16, 2011, 1 pg.
DYNAENERGETICS, New Powders for DPEX Charges, 3 pgs., Dec. 19, 2021.
Entchev et al., Autonomous Perforating System for Multizone Completions, SPE 147296, Prepared for Presentation at Society of Petroleum Engineers (SPE) Annual Technical Conference and Exhibition held Oct. 30, 2011-Nov. 2, 2011, 7 pgs. https://www.onepetro.org/conference-paper/SPE-147296-MS.
EQUAfrac Brochure; Exhibit No. 1016 of PGR No. 2021-00089; 6 pages.
EQUAfrac Shaped Charges; Exhibit No. 1018 of PGR No. 2021-00089; dated 2018; 2 pages.
Fischer et al., A Survey of Combustible Metals, Thermites, and Intermetallics for Pyrotechnic Applications, 15 pgs., Presented at 32nd AIAA/ASME/SAE/ASEE Joint Propulsion Conference, Jul. 1-3, 1996.
Fischer et al., Theoretical Energy Reliease of Thermites, Intermetallics, and Combustible Metals, Presented at 24th International Pyrotechnics Seminar, Monterey, CA, 59 pgs., Jul. 1998.
Fischer et al.; A Survey of Combustible Metals, Thermites, and Intermetallics for Pyrotechnic Applications; 32nd AIAA/ASME/ASEE Joint Propulsion Conference; dated Jul. 1-3, 1996; 15 pages.
Gazda et al., A Battery-Operated, Electro-Mechanical Setting Tool for Use with Bridge Plugs and Similar Wellbore Tools, Jun. 1996, 7 pgs., https://onepetro.org/OTCONF/proceedings-abstract/95OTC/All-95OTC/OTC-7877-MS/44138.
Giromax Directional,Gyroscopic and magnetic borehole surveying systems with outstanding quality andreliability, Feb. 14, 2016, 4 pgs., https://www.gyromax.com.au/inertial-sensing.html.
Halliburtion, World's first acoustic firing head system allows safer and more flexible TCP operations, Aug. 2015, 2 pgs., https://www.halliburton.com/content/dam/ps/public/lp/contents/Case_Histories/web/acoustic-firing-tcp.pdf.
Halliburton, Maxfire Electronic Firing Systems, Nov. 2014, 7 pgs., https://www.halliburton.com/content/dam/ps/public/lp/contents/Brochures/web/MaxFire.pdf.
Harrison Jet Guns; Image of "xtra penetrator".
Hunting Energy Services; Quick Change Assemblies; 2014; 1 Page; http://www.hunting-intl.com/media/1968009/QuickChangeAssemblies.pdf.
Hunting Titan, Inc., U.S. Appl. No. 62/736,298 titled Starburst Cluster Gun and filed Sep. 25, 2018, which is a priority application of International App. No. PCT/US2019/015255 published as International Publication No. WO2019/148009, Aug. 1, 2019, 34 pages, WIPO.
International Searching Authority, International Search Report and Written Opinion for PCT App. No. PCT/IB2019/000526; dated Sep. 25, 2019, 17 pgs.
International Searching Authority, International Search Report and Written Opinion for PCT App. No. PCT/IB2019/000530; dated Oct. 8, 2019; 13 pgs.
International Searching Authority, International Search Report and Written Opinion for PCT App. No. PCT/IB2019/000569; dated Oct. 9, 2019, 12 pages.
International Searching Authority, International Search Report and Written Opinion of International App. No. PCT/EP2018/080831, dated Feb. 15, 2019, 16 pgs.
International Searching Authority, International Search Report and Written Opinion of International App. No PCT/IB2019/000569, dated Oct. 9, 2019, 12 pages.
International Searching Authority, Preliminary Report on Patentability, International App. No. PCT/EP2018/080831, dated Jun. 2, 2020, 9 pgs.
International Searching Authority; International Preliminary Report on Patentability for International Application No. PCT/IB2019/000526; dated Dec. 10, 2020; 10 pages.
International Searching Authority; International Preliminary Report on Patentability for PCT Application No. PCT/IB2019/000569; dated Jan. 28, 2021; 8 pages.
International Searching Authority; International Preliminary Report on Patentability for PCT/EP2019/066919; dated Jan. 7, 2021; 9 pages.
International Searching Authority; International Preliminary Report on Patentability for PCT/IB2019/000530; dated Jan. 7, 2021; 9 pages.
International Searching Authority; International Preliminary Report on Patentability International Application No. PCT/EP2019/063966; dated Dec. 10, 2020; 7 pages.
International Searching Authority; International Preliminary Report on Patentability of the International Searching Authority for PCT/EP2019/072064; dated Feb. 25, 2021; 9 pages.
International Searching Authority; International Preliminary Report on Patentability of the International Searching Authority for PCT/EP2020/058241; dated Oct. 14, 2021; 14 pages.
International Searching Authority; International Preliminary Report on Patentability of the International Searching Authority for PCT/EP2020/075788; dated Mar. 31, 2022; 10 pages.
International Searching Authority; International Preliminary Report on Patentability of the International Searching Authority for PCT/EP2019/072032; dated Mar. 4, 2021; 9 pages.
International Searching Authority; International Preliminary Report on Patentability of the International Searching Authority for PCT/EP2020/085622; dated Jun. 23, 2022; 7 pages.
International Searching Authority; International Preliminary Report on Patentability of the International Searching Authority for PCT/EP2020/085624; dated Jun. 23, 2022; 6 pages.
International Searching Authority; International Preliminary Report on Patentability of the International Searching Authority for PCT/EP2021/057570; dated Oct. 6, 2022; 14 pages.
International Searching Authority; International Search Report and Written Opinion for PCT App. No. PCT/EP2019/066919; dated Sep. 10, 2019; 11 pages.
International Searching Authority; International Search Report and Written Opinion for PCT App. No. PCT/EP2019/072032; dated Nov. 15, 2019; 13 pages.
International Searching Authority; International Search Report and Written Opinion for PCT App. No. PCT/EP2019/072064; dated Nov. 20, 2019; 15 pages.
International Searching Authority; International Search Report and Written Opinion of the International Searching Authority for PCT/EP2021/057570; dated Sep. 13, 2021; 21 pages.

(56) References Cited

OTHER PUBLICATIONS

International Searching Authority; International Search Report and Written Opinion of the International Searching Authority for PCT/EP2020/075788; dated Mar. 16, 2021; 17 pages.
International Searching Authority; International Search Report and Written Opinion of the International Searching Authority for PCT/EP2020/070291; dated Dec. 15, 2020; 14 pages.
International Searching Authority; International Search Report and Written Opinion of the International Searching Authority for PCT/EP2021/057028; dated Jun. 29, 2021; 11 pages.
International Searching Authority; International Search Report and Written Opinion of the International Searching Authority for PCT/EP2021/084619; dated Sep. 22, 2021; 13 pages.
International Searching Authority; International Searching Authority Partial Search Report and Invitation to Pay Additional Search Fees for PCT/EP2021/057570; dated Jul. 22, 2021; 17 pages.
International Searching Authority; Invitation to Pay Additional Fees with Partial International Search for Application No. PCT/EP2020/075788; dated Jan. 19, 2021; 9 pages.

* cited by examiner

AUTONOMOUS PERFORATING DRONE

CROSS-REFERENCE TO RELATED APPLICATIONS

This application claims priority (e.g. as a continuation application) to U.S. patent application Ser. No. 16/542,890 filed Aug. 16, 2019, and thereby to all priority claims therein.

Specifically, U.S. patent application Ser. No. 16/542,890 claims priority to U.S. patent application Ser. No. 16/537,720, filed Aug. 12, 2019, which claims the benefit of U.S. Provisional Patent Application No. 62/831,215, filed Apr. 9, 2019 and U.S. Provisional Patent Application No. 62/823,737, filed Mar. 26, 2019, to which this application also claims the benefit.

U.S. patent application Ser. No. 16/542,890 also claims priority to U.S. Provisional Application No. 62/720,638, filed Aug. 21, 2018, to which this application also claims the benefit.

U.S. patent application Ser. No. 16/542,890 also claims priority to U.S. patent application Ser. No. 16/455,816, filed Jun. 28, 2019 (now issued as U.S. Pat. No. 10,844,696), which claims priority to U.S. patent application Ser. No. 16/272,326 filed Feb. 11, 2019 (now issued as U.S. Pat. No. 10,458,213), which claims the benefit of U.S. Provisional Patent Application No. 62/780,427 filed Dec. 17, 2018 and U.S. Provisional Patent Application No. 62/699,484 filed Jul. 17, 2018, to which this application also claims the benefit.

U.S. patent application Ser. No. 16/542,890 claims priority to U.S. application Ser. No. 16/451,440, filed Jun. 25, 2019 (now issued as U.S. Pat. No. 10,794,159), which claims the benefit of U.S. Provisional Patent Application No. 62/842,329, filed May 2, 2019, to which this application also claims the benefit.

U.S. patent application Ser. No. 16/542,890 also claims priority to International Patent Application No. PCT/EP2019/066919, filed Jun. 25, 2019, to which this application also claims the benefit.

U.S. patent application Ser. No. 16/542,890 also claims the benefit of U.S. Provisional Patent Application No. 62/816,649, filed Mar. 11, 2019, to which this application also claims the benefit.

U.S. patent application Ser. No. 16/542,890 also claims priority to International Patent Application No. PCT/IB2019/000526, filed Apr. 12, 2019, which claims priority to International Patent Application No. PCT/IB2019/000537, filed Mar. 18, 2019, which claims the benefit of U.S. Provisional Patent Application No. 62/678,636 filed May 31, 2018, to which this application also claims the benefit.

U.S. patent application Ser. No. 16/542,890 also claims priority to International Patent Application No. PCT/IB2019/000530 filed Mar. 29, 2019, which claims the benefit of U.S. Provisional Patent Application No. 62/690,314 filed Jun. 26, 2018, to which this application also claims the benefit.

U.S. patent application Ser. No. 16/542,890 also claims the benefit of U.S. Provisional Patent Application No. 62/765,185 filed Aug. 20, 2018, to which this application also claims the benefit.

U.S. patent application Ser. No. 16/542,890 also claims priority to U.S. patent application Ser. No. 16/272,326 filed Feb. 11, 2019 (now issued as U.S. Pat. No. 10,458,213), which claims the benefit of U.S. Provisional Patent Application No. 62/780,427 filed Dec. 17, 2018 and U.S. Provisional Patent Application No. 62/699,484 filed Jul. 17, 2018, to which this application also claims the benefit.

U.S. patent application Ser. No. 16/542,890 also claims the benefit of U.S. Provisional Patent Application No. 62/823,737 filed Mar. 26, 2019, to which this application also claims the benefit.

U.S. patent application Ser. No. 16/542,890 also claims the benefit of U.S. Provisional Patent Application No. 62/827,468 filed Apr. 1, 2019, to which this application also claims the benefit.

U.S. patent application Ser. No. 16/542,890 also claims the benefit of U.S. Provisional Patent Application No. 62/831,215 filed Apr. 9, 2019, to which this application also claims the benefit. The entire contents of each application listed above are incorporated herein by reference.

BACKGROUND OF THE DISCLOSURE

Hydraulic Fracturing (or, "fracking") is a commonly-used method for extracting oil and gas from geological formations (i.e., "hydrocarbon bearing formations") such as shale and tight-rock formations. Fracking typically involves, among other things, drilling a wellbore into a hydrocarbon bearing formation; installing casing(s) and tubing; deploying a perforating gun including shaped explosive charges in the wellbore via a wireline or other methods; positioning the perforating gun within the wellbore at a desired area; perforating the wellbore and the hydrocarbon formation by detonating the shaped charges; pumping high hydraulic pressure fracking fluid into the wellbore to force open perforations, cracks, and imperfections in the hydrocarbon formation; delivering a proppant material (such as sand or other hard, granular materials) into the hydrocarbon formation to hold open the perforations, fractures, and cracks (giving the tight-rock formation permeability) through which hydrocarbons flow out of the hydrocarbon formation; and, collecting the liberated hydrocarbons via the wellbore.

Perforating the wellbore and the hydrocarbon formations is typically done using one or more perforating guns. For example, as shown in FIG. 1, a conventional perforating gun string 1100 may have two or more perforating guns 1110. Each perforating gun 1110 may have a substantially cylindrical gun barrel 1120 housing a charge carrier 1130 including, among other things, one more shaped charges 1140, a detonating cord 1150 for detonating the shaped charges 1140, and a conductive line 1160 for relaying an electrical signal between connected perforating guns 1110.

Shaped charges 1140 in the perforating gun 1110 are typically detonated in a "top-fire" sequence from a topmost shaped charge 1141 to a bottommost shaped charge 1142. For purposes of this disclosure, "topmost" means furthest "upstream," or towards the well surface, and "bottommost" means furthest "downstream," or further from the surface within the well. The top-fire sequence is initiated by a detonator 1145 positioned nearest the topmost shaped charge 1141. The top-fire sequence may be problematic for any perforating gun or wellbore tool that is detonated while traveling at high speed, because the velocity of the tool and the wellbore fluid combined with the force from detonating a topmost explosive charge may separate and scatter different portions of the tool. This may decrease accuracy in perforating at particular locations, cause failure of explosive charges or other components, result in greater amounts of debris, and the like. In addition, it is generally more favorable for the deployment and physical conveyance for pump down operations of the wellbore tool if most of the weight of the tool (i.e., the detonator and associated control components) is at the front (downstream end) of the tool in relation to its direction of movement.

FIG. 1B shows a cross-sectional view of a wellbore and wellhead according to the prior art use of a wireline cable 2012 to place drones in a wellbore 2016. In oil and gas wells, the wellbore 2016, as illustrated in FIG. 1B is a narrow shaft drilled in the ground, vertically and/or horizontally deviated. A wellbore 2016 can include a substantially vertical portion as well as a substantially horizontal portion and a typical wellbore may be over a mile in depth (e.g., the vertical portion) and several miles in length (e.g., the horizontal portion). The wellbore 2016 is usually fitted with a wellbore casing that includes multiple segments (e.g., about 40-foot segments) that are connected to one another by couplers. A coupler (e.g., a collar), may connect two sections of wellbore casing.

In the oil and gas industry, the wireline cable 2012, electric line or e-line are cabling technology used to lower and retrieve equipment or measurement devices into and out of the wellbore 2016 of an oil or gas well for the purpose of delivering an explosive charge, evaluation of the wellbore 2016 or other well-related tasks. Other methods include tubing conveyed (i.e., TCP for perforating) slickline or coil tubing conveyance. A speed of unwinding the wireline cable 2012 and winding the wireline cable 2012 back up is limited based on a speed of the wireline equipment 2062 and forces on the wireline cable 2012 itself (e.g., friction within the well). Because of these limitations, it typically can take several hours for a wireline cable 2012 and a toolstring 2031 to be lowered into a well and another several hours for the wireline cable 2012 to be wound back up and the expended toolstring retrieved. The wireline equipment 2062 feeds wireline 2012 through wellhead 2060. When detonating explosives, the wireline cable 2012 will be used to position the toolstring 2031 of perforating guns 2018 containing the explosives into the wellbore 2016. After the explosives are detonated, the wireline cable 2012 will have to be extracted or retrieved from the well.

Wireline cables and TCP systems have other limitations such as becoming damaged after multiple uses in the wellbore due to, among other issues, friction associated with the wireline cable rubbing against the sides of the wellbore. Location within the wellbore is a simple function of the length of wireline cable that has been sent into the well. Thus, the use of wireline may be a critical and very useful component in the oil and gas industry yet also presents significant engineering challenges and is typically quite time consuming. It would therefore be desirable to provide a system that can minimize or even eliminate the use of wireline cables for activity within a wellbore while still enabling the position of the downhole equipment, e.g., the toolstring 2031, to be monitored.

During many critical operations utilizing equipment disposed in a wellbore, it is important to know the location and depth of the equipment in the wellbore at a particular time. When utilizing a wireline cable for placement and potential retrieval of equipment, the location of the equipment within the well is known or, at least, may be estimated depending upon how much of the wireline cable has been fed into the wellbore. Similarly, the speed of the equipment within the wellbore is determined by the speed at which the wireline cable is fed into the wellbore. As is the case for a toolstring 2031 attached to a wireline, determining depth, location and orientation of a toolstring 2031 within a wellbore 2016 is typically a prerequisite for proper functioning.

One known means of locating a toolstring 2031, whether tethered or untethered, within a wellbore involves a casing collar locator ("CCL") or similar arrangement, which utilizes a passive system of magnets and coils to detect increased thickness/mass in a wellbore casing 1580 (FIG. 7) at portions where coupling collars 1590 (FIG. 7) connect two sections of wellbore casing 1582, 1584 (FIG. 7). A toolstring 2031 equipped with a CCL may be moved through a portion of the wellbore casing 1580 having the collar 1590. The increased wellbore wall thickness/mass the collar 1590 results in a distortion of the magnetic field (flux) around the CCL magnet. This magnetic field distortion, in turn, results in a small current being induced in a coil; this induced current is detected by a processor/onboard computer which is part of the CCL. In a typical embodiment of known CCL, the computer 'counts' the number of coupling collars 1590 detected and calculates a location along the wellbore 2016 based on the running count.

Another known means of locating a toolstring 2031 within a wellbore 2016 involves tags attached at known locations along the wellbore casing 1580. The tags, e.g., radio frequency identification ("RFID") tags, may be attached on or adjacent to casing collars but placement unrelated to casing collars is also an option. Electronics for detecting the tags are integrated with the toolstring 2031 and the onboard computer may 'count' the tags that have been passed. Alternatively, each tag attached to a portion of the wellbore may be uniquely identified. The detecting electronics may be configured to detect the unique tag identifier and pass this information along to the computer, which can then determine current location of the toolstring 2031 along the wellbore 2016.

Similar operations and challenges may be encountered with downhole delivery, deployment, and/or initiation of a variety of wellbore tools besides perforating guns. For example, a wellbore tool may be a puncher gun, logging tool, jet cutter, plug, frac plug, bridge plug, setting tool, self-setting bridge plug, self-setting frac plug, mapping/positioning/orientating tool, bailer/dump bailer tool, or other ballistic tool. For purposes of this disclosure, a wellbore tool is any such tool, listed or otherwise, that is delivered, deployed, or initiated in a wellbore, and the disclosed exemplary embodiments are not limited to any particular wellbore tool.

Accordingly, current wellbore operations and system(s) require substantial amounts of onsite personnel and equipment. Even with large gun strings, a substantial amount of time, equipment, and labor may be required to deploy the perforating gun or wellbore tool string, position the perforating gun or wellbore tool string at the desired location(s), and retrieve the fired perforating gun assemblies post perforating. Further, current perforating devices and systems may be made from materials that remain in the wellbore after detonation of the shaped charges and leave a large amount of debris that must either be removed from the wellbore or left within. Accordingly, devices, systems, and methods that may reduce the time, equipment, labor, and debris associated with downhole operations would be beneficial.

Knowledge of the location, depth and velocity of the toolstring in the absence of a wireline cable would be essential. The present disclosure is further associated with systems and methods of determining location along a wellbore 2016 that do not necessarily rely on the presence of casing collars or any other standardized structural element, e.g., tags, associated with the wellbore casing 1580.

BRIEF DESCRIPTION OF THE EXEMPLARY EMBODIMENTS

In an aspect, the disclosure relates to an autonomous perforating drone for downhole delivery of one or more wellbore tools. The autonomous perforating drone may comprise a perforating assembly section including at least one aperture configured for receiving a shaped charge; a control module section positioned upstream of the perforating assembly section relative to an orientation of the drone when deployed in the wellbore, the control module section including a hollow interior portion; a ballistic channel open to and extending from the hollow interior portion to the at least one aperture in the perforating assembly section; and, a control module positioned within the hollow interior portion of the control module section. The control module may include a housing enclosing a donor charge within an inner area of the control module, the donor charge being positioned adjacent to the ballistic channel. A receiver booster may be positioned within the ballistic channel, at the portion of the ballistic channel that extends to the at least one aperture, such that the receiver booster may be configured to directly initiate a shaped charge received in the aperture.

In another aspect, the disclosure relates to a method for perforating a wellbore casing or hydrocarbon formation. The method may include arming an autonomous perforating drone according to the exemplary embodiments, e.g., including a perforating assembly section including at least one shaped charge received in an aperture, wherein at least a portion of the shaped charge and the aperture extend into a body of the drone, a control module section positioned upstream of the perforating assembly section relative to an orientation of the drone when deployed in the wellbore, the control module section including a hollow interior portion, a ballistic channel open to and extending from the hollow interior portion to the at least one aperture in the perforating assembly section, and a control module positioned within the hollow interior portion of the control module section. The control module may include a housing enclosing a detonator and a donor charge, the detonator being configured for initiating the donor charge which is positioned adjacent to the ballistic channel. A receiver booster may be positioned within the ballistic channel, at the portion of the ballistic channel that extends to the at least one aperture, and a ballistic interrupt may be positioned within the ballistic channel between the donor charge and the receiver booster in a spaced apart configuration from the donor charge and the receiver booster. The ballistic interrupt may be movable between a closed state and an open state and arming the autonomous perforating drone may include moving the ballistic interrupt from the closed state to the open state. The method may further include deploying the drone into the wellbore and detonating the at least one shaped charge.

In a further aspect, the disclosure relates to an autonomous perforating drone for downhole delivery of one or more wellbore tools, comprising: a perforating assembly section; a control module section positioned upstream of the perforating assembly section relative to an orientation of the drone when deployed in the wellbore, the control module section including a hollow interior portion; a ballistic channel open to and extending from the hollow interior portion into at least a portion of the perforating assembly section; a control module positioned within the hollow interior portion of the control module section, and a donor charge housed within the control module and substantially aligned with the ballistic channel; a receiver booster positioned at least in part within the portion of the ballistic channel within the perforating assembly section; a first plurality of shaped charges received in a first plurality of shaped charge apertures in the body portion of the drone positioned at the perforating assembly section. In the exemplary embodiment(s), the first plurality of shaped charge apertures are arranged in a first single radial plane and an initiation end of each of the first plurality of shaped charges is substantially adjacent to the receiver booster when the respective shaped charges are received in the respective shaped charge apertures, and a second plurality of shaped charges received in a second plurality of shaped charge apertures in the body portion of the drone may be positioned at the perforating assembly section, and the second plurality of shaped charge apertures are arranged in a second single radial plane. The second single radial plane is positioned upstream of the first single radial plane, and an initiation end of each of the second plurality of shaped charges is substantially adjacent to the receiver booster when the respective shaped charges are received in the respective shaped charge apertures, such that the receiver booster may be configured to directly initiate a shaped charge received in the aperture.

For purposes of this disclosure, a "drone" is a self-contained, autonomous or semi-autonomous vehicle for downhole delivery of a wellbore tool. For purposes of this disclosure and without limitation, "autonomous" means without a physical connection or manual control and "semi-autonomous" means without a physical connection. An "autonomous perforating drone" according to some embodiments is a drone in which, e.g., shaped charges carried by the drone are detonated within the wellbore; however, as the disclosure makes clear, an "autonomous perforating drone" is not limited to a drone for downhole delivery of shaped charges and may include any known or later-developed wellbore tools consistent with this disclosure. Further, the use of the word "drone" throughout this disclosure may be used interchangeably and/or for brevity with the phrase "autonomous perforating drone" without limitation, except where the specification otherwise makes clear.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1A:
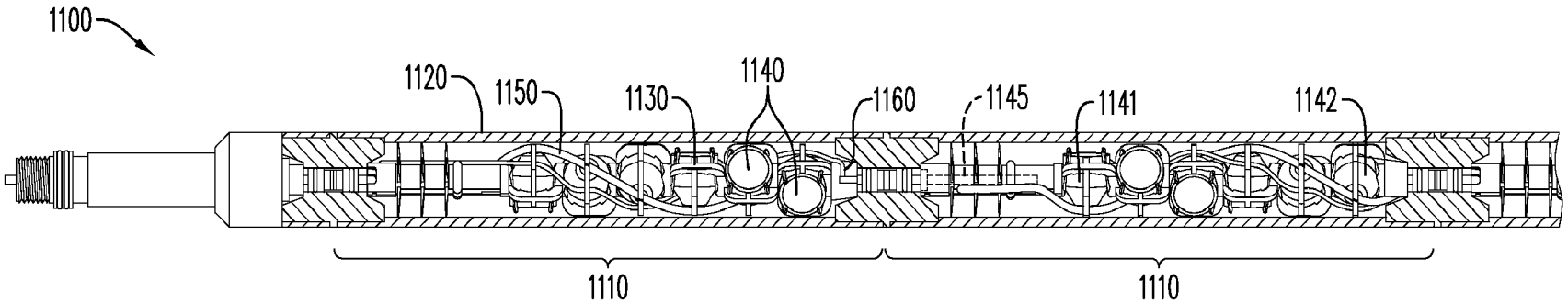
FIG. 1A (PRIOR ART)
FIG. 1A is a cross-sectional view of a perforating gun string according to the prior art.
Figure 1B:
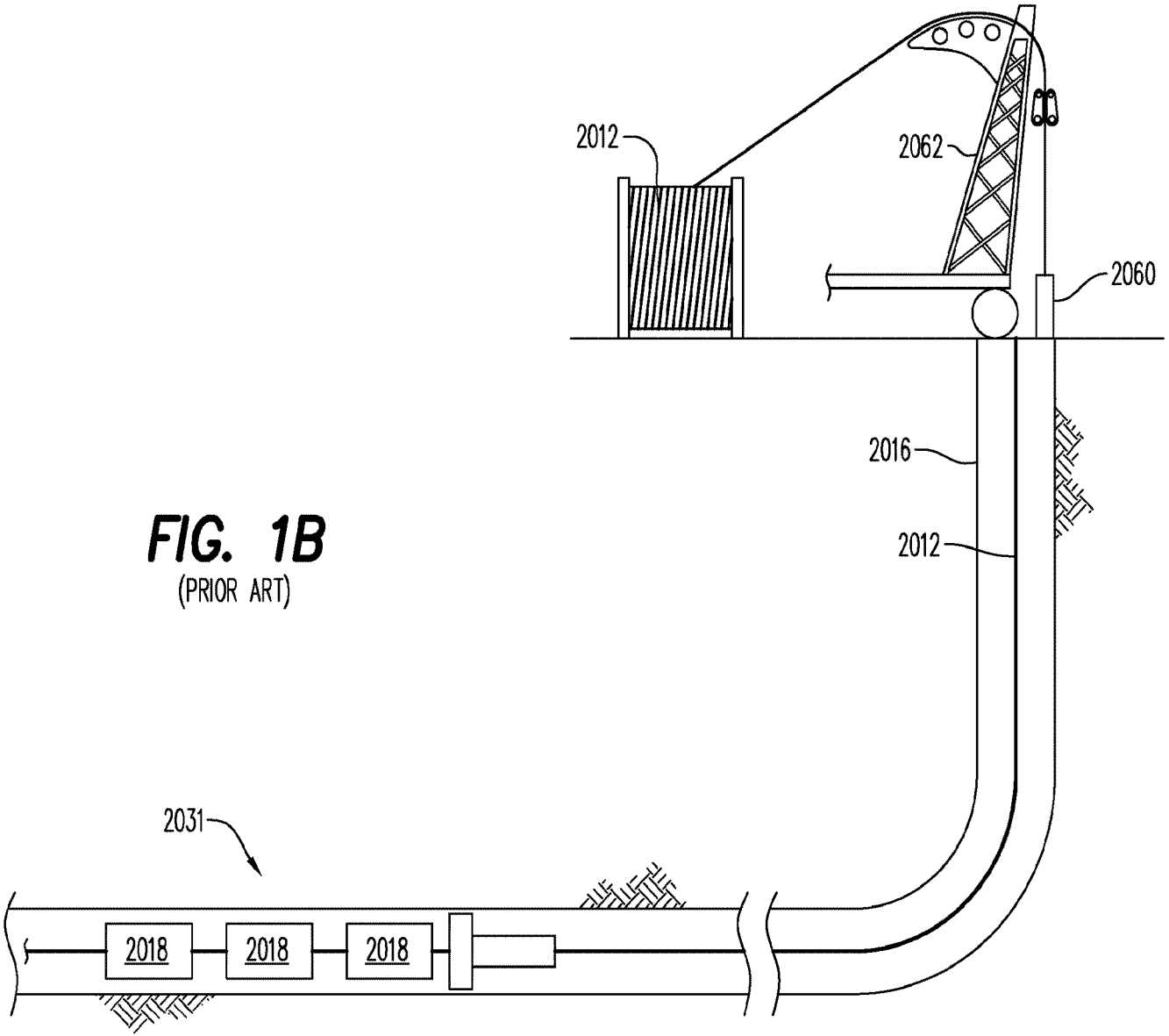
FIG. 1B (PRIOR ART)
FIG. 1B is a cross-sectional view of a wellbore and wellhead showing the prior art use of a wireline to place drones in a wellbore.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

This application incorporates by reference each of the following pending patent applications in their entireties: International Patent Application No. PCT/US2019/063966, filed May 29, 2019; U.S. patent application Ser. No. 16/423,230, filed May 28, 2019; U.S. Provisional Patent Application No. 62/841,382, filed May 1, 2019; U.S. Provisional Patent Application No. 62/720,638, filed Aug. 21, 2018; U.S. Provisional Patent Application No. 62/719,816, filed Aug. 20, 2018; and U.S. Provisional Patent Application No. 62/678,654, filed May 31, 2018.

Reference will now be made in detail to various exemplary embodiments. Each example is provided by way of explanation and is not meant as a limitation and does not constitute a definition of all possible embodiments.

Figure 2A:
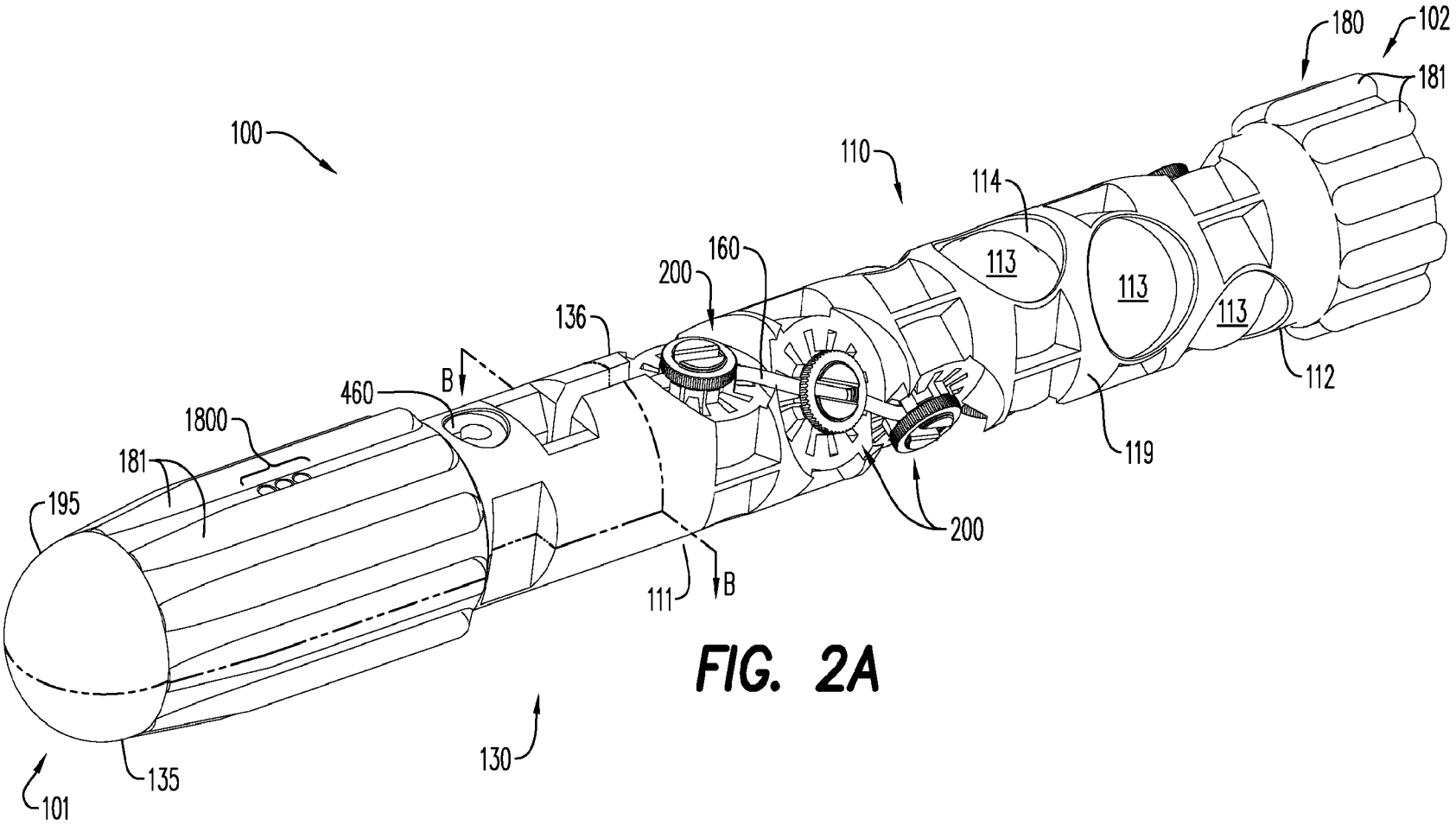
FIG. 2A is a side perspective view of an autonomous perforating drone according to an exemplary embodiment.
Figure 2B:
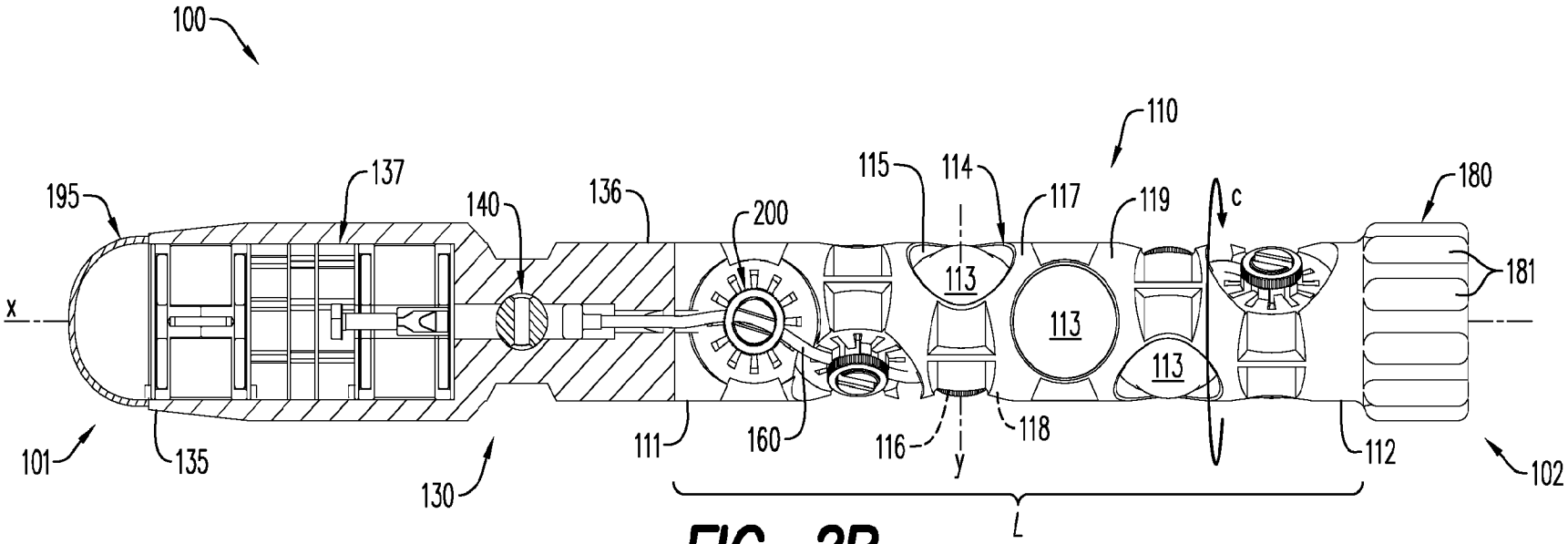
FIG. 2B is a side view with partial cross-sectional view taken along the planes by view 'B' of the autonomous perforating drone according to FIG. 2A.

Turning now to FIG. 2A and FIG. 2B, an exemplary embodiment of an autonomous perforating drone 100 according to this disclosure is shown. The exemplary autonomous perforating drone 100 is a generally (though not literally or limitingly) torpedo-shaped assembly or module with a circumferential aspect c formed about a longitudinal axis x. The autonomous perforating drone 100 includes a tip section 195 at a front (downstream) end 101 of the autonomous perforating drone 100 and a tail section 180 at a rear (upstream) end 102, opposite the front end 101, of the autonomous perforating drone 100. A perforating assembly section 110 and a control module section 130 are respectively positioned between the tail section 180 and the tip section 195. The control module section 130 is connected at a first end 135 of the control module section 130 to the tip section 195 and at a second end 136, opposite the first end 135, of the control module section 130 to a downstream end 111 of the perforating assembly section 110. The perforating assembly section 110 includes an upstream end 112 opposite the downstream end 111 and in the exemplary embodiment shown in FIG. 2A and FIG. 2B the upstream end 112 of the perforating assembly section 110 is connected to the tail section 180.

The tail section 180 may include guiding fins 181 for providing radial stability as the autonomous perforating drone 100 is traveling through a wellbore fluid within a wellbore. In various embodiments, one or more of the tip section 195, the control module section 130, the perforating assembly section 110, and the tail section 180 may have features such as guiding fins, a curved topology, etc. for providing one or more of rotational speed, radial stability, and reduced friction to the autonomous perforating drone 100.

For purposes of this disclosure, each of the "tip section", "control module section", "perforating assembly section", and "tail section" is defined with respect and reference to, and to aid in the description of, the position and configuration of certain structures and componentry of the exemplary embodiments of an autonomous perforating drone as described throughout this disclosure. None of the terms "tip section", "control module section", "perforating assembly section", or "tail section" is limited to any particular assembly, configuration, or delineation points of, or along, an autonomous perforating drone according to this disclosure. For example, any or all of the "tip section", "control module section", "perforating assembly section", and "tail section" may be integrally formed by injection molding, casting, 3D printing, 3D milling from bar stock, etc. For purposes of this disclosure, "integral" or "integrally formed" respectively means a single piece or formed as a single piece.

Further, for purposes of this disclosure, the term "connected" generally means joined, such as by mechanical features, adhesives, welding, friction fit, or other known techniques for joining separate components, and may also mean "integrally formed" as that term is used in this disclosure, except where otherwise indicated.

Moreover, for purposes of this disclosure, "upstream" means in a direction towards the wellbore entrance or surface and "downstream" means in a direction deeper or further into the wellbore. For example, as the autonomous perforating drone 100 travels downstream, the tip section 195 is positioned first in the wellbore fluid, the tip section 195 being positioned downstream of the tail section 180. The autonomous perforating drone 100 is deployed and conveyed through the wellbore fluid via known techniques including, but not limited to, pump down conveyance.

With continuing reference to FIG. 2A and FIG. 2B, the exemplary perforating assembly section 110 is generally defined by a perforating assembly section body 119 that is configured for, among other things, retaining one or more shaped charges 113 and a detonating cord 160 for delivery downhole in a wellbore. The perforating assembly section 110 is generally cylindrically-shaped and is formed about the longitudinal axis x. In the exemplary embodiment shown in FIG. 2A and FIG. 2B, the perforating assembly section 110 includes a plurality of shaped charges 113, and each shaped charge 113 is positioned and retained, in part, in a first opening 115 of an aperture 114 that extends laterally through the perforating assembly section 110 along an axis y. The aperture extends between the first opening 115 on a first side 117 of the perforating assembly section 110 and a second opening 116 on a second side 118, opposite the first side 117, of the perforating assembly section 110. The first side 117 of the perforating assembly section 110 and the second side 118 of the perforating assembly section 110 are defined separately for each of the plurality of apertures 114, according to the respective opposing portions of the perforating assembly section 110 through which a particular aperture 114 passes. As described in detail with respect to FIGS. 3A, 3B, 5A, and 5C-5E, a fixation assembly 200 of the exemplary embodiment shown in FIG. 2A and FIG. 2B is positioned about the second opening 116 of each aperture 114 and secures the shaped charge 113 within the aperture 114. The fixation assembly 200 may also secure the detonating cord 160 in place at each shaped charge 113 along a length L of the perforating assembly section 110, as described in detail with respect to FIGS. 5A-5E.

With reference specifically to FIG. 2A, the exemplary autonomous perforating drone 100 also includes, among other things, features such as charging/programming contacts 1800 for charging a power source and/or programming onboard circuitry contained in a control module 137 (FIG. 2B) of the autonomous perforating drone 100 and a ballistic interrupt actuator 460 for moving a ballistic interrupt 140 (FIG. 2B) between a closed state 143 (FIG. 3A) and an open state 144 (FIG. 3B) within the autonomous perforating drone 100. Aspect of these features are variously shown and described throughout this disclosure and in the figures, as follows.

Figure 3A:
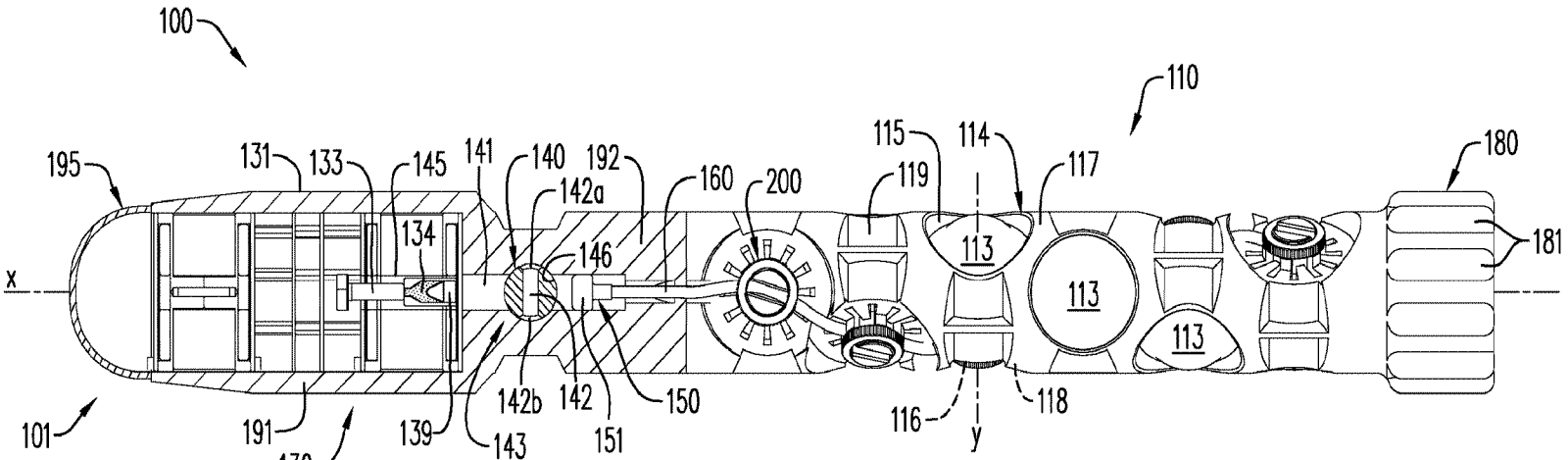
FIG. 3A is a side view with cross-sectional view of the exemplary embodiment according to FIG. 2B, with a ballistic interrupt in a closed state.
Figure 3B:
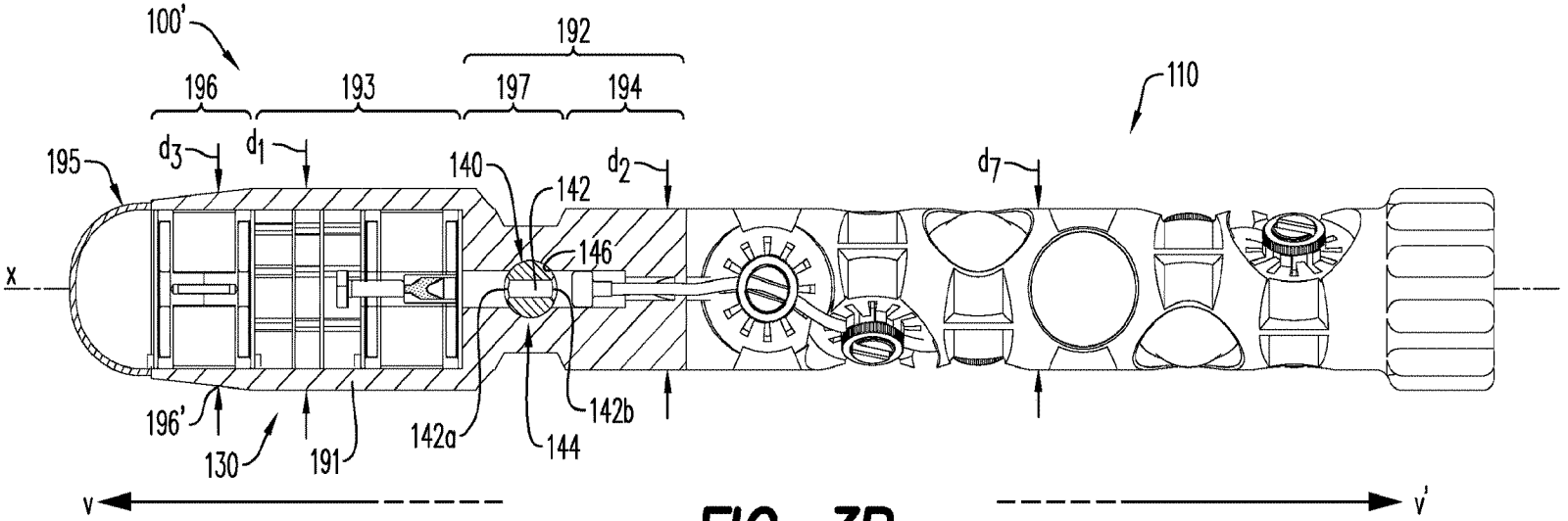
FIG. 3B is a side view with cross-sectional view of the exemplary embodiment according to FIG. 2B, with a ballistic interrupt in an open state.

With reference now to FIGS. 3A and 3B, each of those figures shows, among other things, a cross-section of the exemplary control module section 130 of the autonomous perforating drone 100 as generally described with respect to FIG. 2A and FIG. 2B. However, as explained in greater detail further below, FIG. 3A shows the exemplary autonomous perforating drone 100 with the ballistic interrupt 140 in a closed state 143 and FIG. 3B shows the exemplary autonomous perforating drone 100' with the ballistic interrupt in an open state 144.

Figure 26:
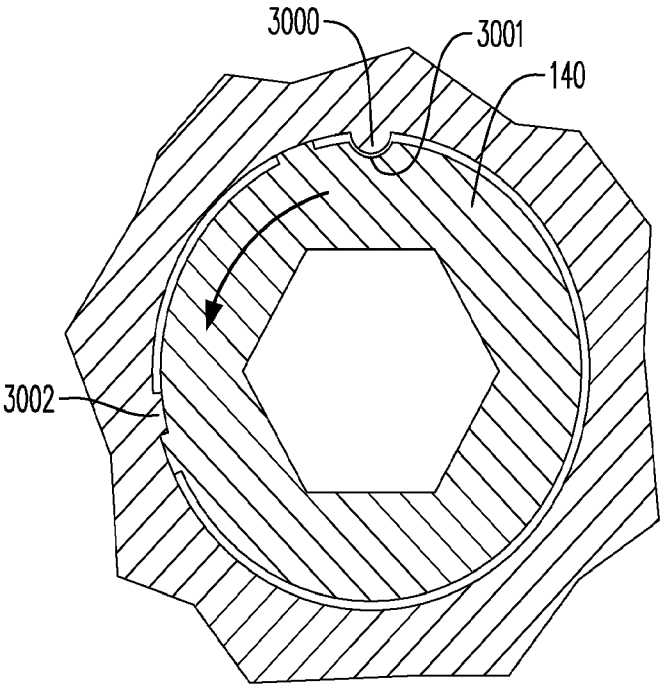

In an aspect, and with reference to FIG. 26, at least a portion of the ballistic interrupt 140 may include a detent 3001 for seating against a corresponding protrusion 3000 on a surface within the drone body, for example within the cavity (not numbered) in which the ballistic interrupt 140 sits. The seating contributes to maintaining a position (relative to rotation) of the ballistic interrupt 140. In addition, a stop notch 3002 may extend from, for example and without limitation, a surface of the cavity and have a size and geometry configured to resist over-rotation of the ballistic interrupt 140 within the cavity, for example, when the ballistic interrupt 140 is moved between the on and off states.

Figure 4:
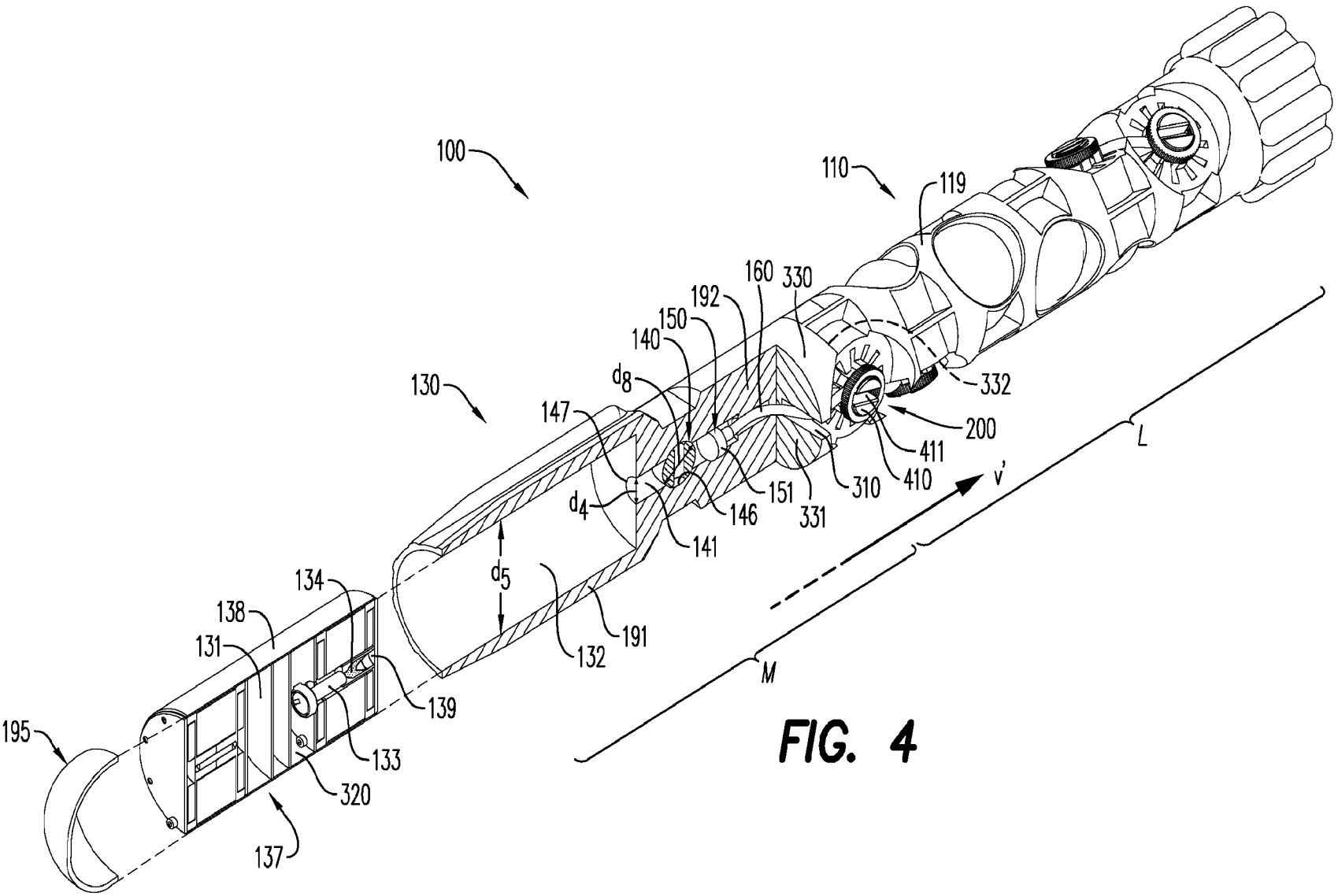
FIG. 4 is a perspective view with an exploded, cross-sectional view of a control module section of the exemplary embodiment according to FIG. 2B.

With continuing reference to FIGS. 2A-3B, and further reference to FIG. 4, the exemplary control module section 130 is generally defined by a control module section body 191 and is circumferentially-shaped and formed about the longitudinal axis x. The control module section 130 defined by the control module section body 191 has a profile including, among other things, a large diameter portion 193 with a diameter $d_1$, a reduced diameter portion 194 with a diameter $d_2$, a transition region 197 positioned between the large diameter portion 193 and the reduced diameter portion 194, and a tapered portion 196 with a diameter $d_3$ at a position 196' representing any particular point along the varying-diameter tapered portion 196 at which the diameter $d_3$ is measured. The diameter $d_1$ of the large diameter portion 193 is greater than the diameter $d_2$ of the reduced diameter portion 194. In the exemplary embodiments shown in FIGS. 3A and 3B, the diameter $d_2$ of the reduced diameter portion 194 is substantially equal to a diameter $d_7$ of the perforating assembly section 110.

The transition region 197 is connected to each of the large diameter portion 193 and the reduced diameter portion 194 and spans a space therebetween. The presence and profile of the transition region 197 is not limited by the disclosed embodiments and may take any shape or configuration as particular applications dictate. The tapered portion 196 is positioned and spans a gap between the large-diameter portion 194 of the control module section 130 and the tip section 195, and the diameter $d_3$ at the position 196' on the tapered portion 196 gradually decreases in a direction v from the large-diameter portion 194 of the control module section 130 towards the tip section 195. The exemplary profile of the control module section 130 shown in, e.g., FIG. 3B helps to reduce impacts and friction on the shaped charges 113 as the autonomous perforating drone 100, 100' travels through a wellbore fluid, whereby the large diameter portion 193 absorbs impacts against a wellbore casing and pushes wellbore fluid out and around the perforating assembly section 110. In other embodiments, the tip section 195 may have a different profile, for example and without limitation, an arrow-like or pointed tip.

For purposes of this disclosure, each of the "large diameter portion 193", "reduced diameter portion 194", "transition region 197", and "tapered portion 196" is defined with respect and reference to, and to aid in the description of, the profile of the exemplary control module section 130 shown in, e.g., FIGS. 3A and 3B. None of the terms "large diameter portion 193", "reduced diameter portion 194", "transition region 197", or "tapered portion 196" is limited to any particular assembly, configuration, or delineation points of, or along, an autonomous perforating drone according to this disclosure, nor is a control module section according to this disclosure limited to a profile including one or more diameters. For example and without limitation, the control module section 130 may be cylindrically shaped with a constant diameter, or may have a non-circumferential profile.

With continuing reference specifically to FIGS. 3A and 4 (and further shown and described with respect to FIG. 13B), the control module section 130 defined by the control module section body 191 includes, among other things, a hollow interior portion 132 and a ballistic channel 141 respectively positioned within the control module section 130 defined by the control module section body 191. The ballistic channel 141 is open to the hollow interior portion 132 and extends from the hollow interior portion 132 in a direction v' from the hollow interior portion 132 towards the perforating assembly section 110/tail section 180. In the exemplary embodiments shown in FIGS. 3A-4, the ballistic channel 141 is surrounded by a portion 192 of increased thickness of the control module section body 191 and has a diameter $d_4$ that is smaller than a diameter $d_5$ of the hollow interior portion 132. The diameter $d_4$ of the ballistic channel 141 is sized to receive a receiver booster 150 which, as shown in FIGS. 3A-4, is positioned within the ballistic channel 141, and the ballistic interrupt 140 is positioned within the ballistic channel 141 in a ballistic interrupt cavity 146 that is formed as an area of the ballistic channel 141 with a diameter $d_8$ which is larger than the diameter $d_4$ of the ballistic channel 141. The ballistic interrupt 140 and the receiver booster 150 are positioned in a spaced apart relationship within the ballistic channel 141 such that the ballistic interrupt 140 is nearer the hollow interior portion 132 and the receiver booster 150 is nearer the perforating assembly section 110. The receiver booster 150 is connected to the detonating cord 160, for example by crimping, within the ballistic channel 141, and the exemplary ballistic channel 141 shown in, e.g., FIGS. 3A-4, is sized to receive at least a portion of the detonating cord 160. The detonating cord 160 extends away from the receiver booster 150 in the direction v' towards the perforating assembly section 110/tail section 180, and opposite the direction v towards the ballistic interrupt 140.

In some embodiments, a set of stackable pellets may be used in conjunction with, or in place of, the receiver booster 150 for initiating the detonating cord 160 by ballistic force.

The control module section 130 and the hollow interior portion 132 are sized to receive the control module 137 which is positioned within the hollow interior portion 132 of the control module section 130. The control module 137 includes a housing 138 that defines an inner area 320 of the control module 137 and encloses, for example and without limitation, a detonator 133, a donor charge 134, and a control assembly 131. The control module 137 and the control assembly 131 are further shown and described with respect to FIG. 12. With continuing reference to FIGS. 3A-4, the control assembly 131 may include controlling and operational components of the autonomous perforating drone 100, such as, without limitation, a power source/battery, sensors, depth correlation device, programmable electronic circuit, trigger circuit, detonator fuse, etc. A power source/battery may also be positioned within the hollow interior portion 132, itself, as may other components that do not necessarily need the isolation or component assemblies within the inner area 320 of the control module 137. These and other components are discussed in additional detail with respect to the operation of the autonomous perforating drone 100, especially in FIGS. 22-25, with respect to the exemplary embodiments of drone shown and described with respect to FIGS. 16-21.

The modular, i.e., self-contained, nature of the control module 137 allows it to be removed/removable from the autonomous perforating drone 100 during transport, e.g., to comply with regulatory requirements, and quickly loaded into the autonomous perforating drone 100 at a wellsite. The inner area 320 of the control module 137 can be completely or partially hollow, or not hollow at all, depending on the layout of the control module components and the requirements for sealing the control module 137. For example, in an exemplary embodiment the control module 137 is pressure sealed to protect the components within the control module 137 from environmental conditions both outside of and within the wellbore. In other embodiments one or more of the control module 137, control module section 130, and hollow interior portion 132 may include various known seals to protect the control module 137 and the components within the control module 137, components within the hollow interior portion 132, or other components within the control module section 130 generally.

According to a further aspect, an electrical selective sequence signal may be sent from, e.g., the programmable electronic circuit to the detonator 133 to initiate the detonator when the autonomous perforating drone 100 reaches at least one of a threshold pressure, temperature, horizontal orientation, inclination angle, depth, distance traveled, rotational speed, and position within the wellbore. The threshold conditions may be measured by any known devices consistent with this disclosure including a temperature sensor, a pressure sensor, a positioning device as a gyroscope and/or accelerometer (for horizontal orientation, inclination angle, and rotational speed), and a correlation device such as a casing collar locator (CCL) or position determining system (for depth, distance traveled, and position within the wellbore) as discussed below with respect to FIGS. 6A-9 and FIG. 12. The electrical selective sequence signal may include one or more of an addressing signal for activating one or more power components of the detonator 133, an arming signal for activating a detonator firing assembly such as a trigger circuit or capacitor, and a detonating signal for detonating the detonator 133. The threshold values and other instructions for addressing, arming, and/or detonating the detonator 133 may be taught to the programmable electronic circuit by, for example and without limitation, a control unit at a factory or assembly location or at the surface of the wellbore prior to deploying the autonomous perforating drone 100 into the wellbore. In an aspect, the selective sequence signal may be one or more digital codes including or more digital codes uniquely configured for the detonator 133 of each particular autonomous perforating drone 100.

Figure 6B:
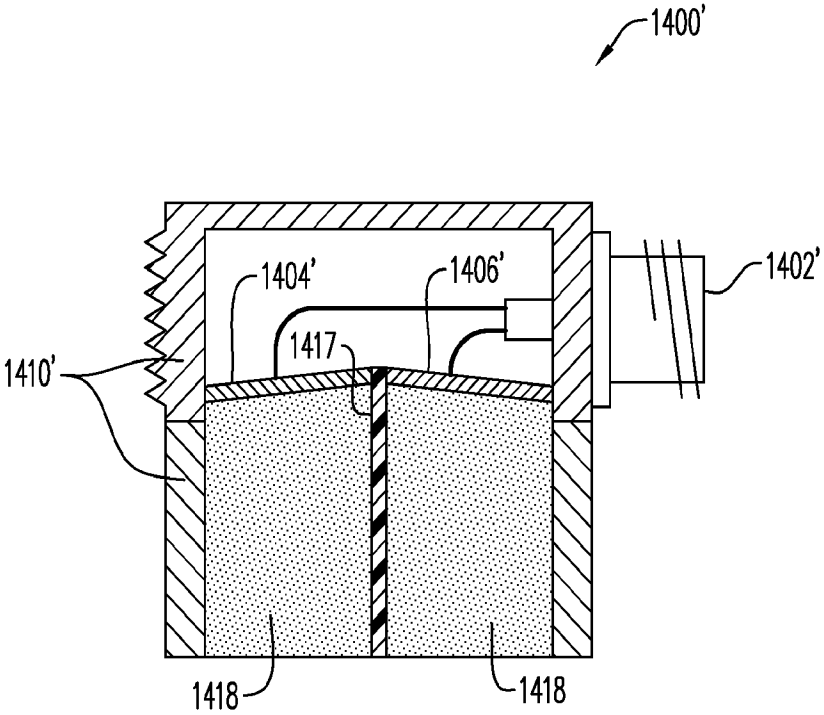
FIG. 6B is a cross-sectional, side plan view of an ultrasonic transceiver utilized in an embodiment.
Figure 6A:
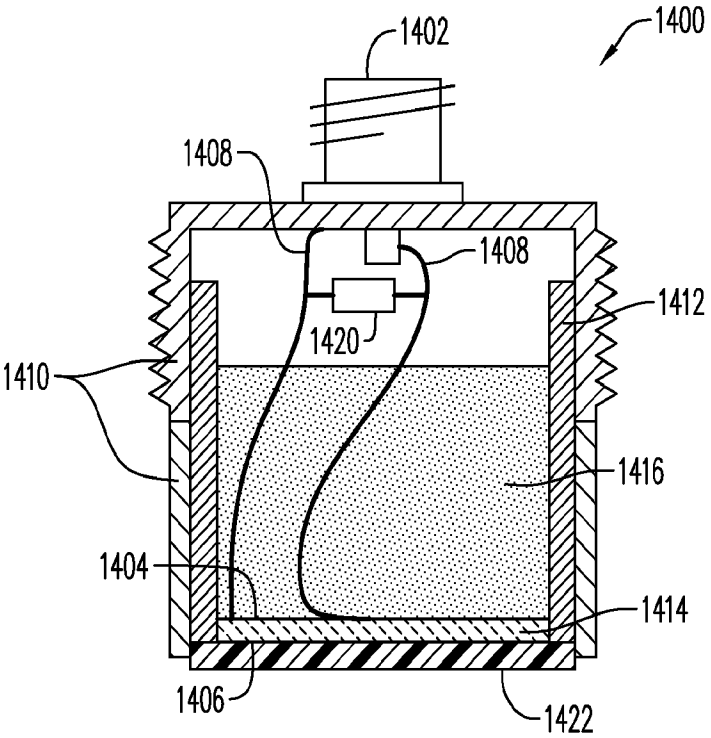
FIG. 6A is a cross-sectional, side plan view of an ultrasonic transceiver utilized in an embodiment.

FIG. 6A is a cross-section of an ultrasonic transducer 1400 that may be used in a system and method of determining location along a wellbore 2016. The transducer 1400 may include a housing 1410 and a connector 1402; the connector 1402 is the portion of the housing 1410 allowing for connections to, e.g., the programmable electronic circuit that may generate and interpret the ultrasound signals. The key elements of the transducer 1400 are a transmitting element 1404 and a receiving element 1406 that are contained in the housing 1410. In the transducer shown in FIG. 6A, the transmitting element 1404 and the receiving element 1406 are integrated into a single active element 1414. That is, the active element 1414 is configured to both transmit an ultrasound signal and receive an ultrasound signal. Electrical leads 1408 are connected to electrodes on the active element 1414 and convey electrical signals to/from the programmable electronic circuit. An electrical network 1420 may be connected between the electrical leads 1408. Optional elements of a transducer include a sleeve 1412, a backing 1416 and a cover/wearplate 1422 protecting the active element 1414.

FIG. 6B is a cross-section of an alternative version of an ultrasonic transducer 1400' that may be used in a system and method of determining location along a wellbore 2016. The transducer 1400' may include a housing 1410' and a connector 1402'; the connector 1402' is the portion of the housing 1410' allowing for connections to, e.g., the programmable electronic circuit that may generate and interpret the ultrasound signals. The key elements of the transducer 1400' are a transmitting element 1404' and a receiving element 1406' that are contained in the housing 1410'. A delay material 1418 and an acoustic barrier 1417 are provided for improving sound transmission and receipt in the context of a separate transmitting element 1404' and receiving element 1406' apparatus.

Figure 7:
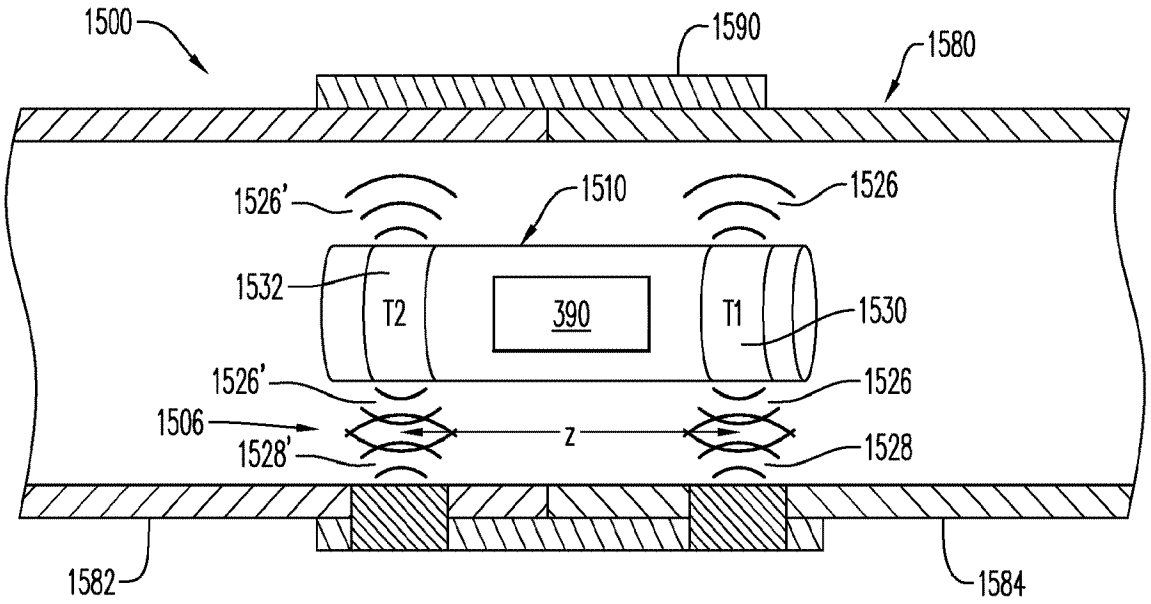
FIG. 7 is a cross-sectional plan view of a two ultrasonic transceiver based navigation system of an embodiment.

With additional reference to FIG. 7, an exemplary autonomous perforating drone 1510 as part of an ultrasonic transducer system 1500 for determining the speed of the autonomous perforating drone 1510 traveling down a wellbore 2016 by identifying ultrasonic waveform changes is shown. As depicted in FIG. 7, the autonomous perforating drone 1510 may be equipped with one or more ultrasonic transducers 1530, 1532. In an embodiment, the autonomous perforating drone 1510 has a first transducer 1530 (also marked T1) and a second transducer 1532 (also marked T2), one at each end of the autonomous perforating drone 1510. The distance separating the first transducer 1530 from the second transducer 1532 is a constant and may be referred to as distance 'Z'. Each of the first transducer 1530 and the second transducer 1532 may have a transmitting element 1404 and a receiving element 1406 (as shown in FIGS. 6A and 6B) that sends/receives signals radially from the autonomous perforating drone 1510. In an embodiment, each transmitting element 1404 and receiving element 1406 may be disposed about an entire radius of the autonomous perforating drone 1510; such an arrangement permits the transmitting element 1404 and the receiving element 1406 respectively to send and receive signals about essentially the entire radius of the autonomous perforating drone 1510.

The exemplary autonomous perforating drone 1510 shown in FIG. 7 includes the first ultrasonic transceiver 1530 and the second ultrasonic transceiver 1532. Each of the first ultrasonic transceiver 1530 and the second ultrasonic transceiver 1532 is capable of detecting alterations in the medium through which the autonomous perforating drone 1510 is traversing by transmitting an ultrasound signal 1526, 1526' and receiving a return ultrasound signal 1528, 1528'. Changes in the material and geometry of the wellbore casing 1580 and other material external to wellbore casing 1580 will often result in a substantial change in the return ultrasound signal 1528, 1528' received by receiving element 1406 and conveyed to autonomous perforating drone 1510, e.g., by the programmable electronic circuit.

With continuing reference to FIG. 7, because T2 1532 is axially displaced from T1 1530 along the long axis of the autonomous perforating drone 1510, T2 1532 passes through an anomaly in the wellbore 2016 at a different time than T1 1530 as the autonomous perforating drone 1510 traverses the wellbore 2016. Put another way, assuming the existence of an anomalous point 1506 along the wellbore, T1 1530 and T2 1532 pass the anomalous point 1506 in wellbore 1070 at slightly different times. In the event that T1 1530 and T2 1532 both register a sufficiently strong and identical, i.e., repeatable, modified return signal as a result of an anomaly at the anomalous point 1506, it is possible to determine the time difference between T1 1530 registering the anomaly at the anomalous point 1506 and T2 1532 registering the same anomaly. The distance Z between T1 1530 and T2 1532 being known, a sufficiently precise measurement of time between T1 1530 and T2 1532 passing a particular anomaly provides a measure of the velocity of the autonomous perforating drone 1510, i.e., velocity equals change in position divided by change in time. Utilizing the typically safe presumption that an anomaly is stationary, the velocity of the autonomous perforating drone 1510 through the wellbore 2016 is available every time the autonomous perforating drone 1510 passes an anomaly that returns a sufficient change in amplitude of a return signal for each of T1 1530 and T2 1532.

The potential exists for locating ultrasonic transceiver T1 1530 and ultrasonic transceiver T2 1532 in different portions of the autonomous perforating drone 1510 and connecting them electrically to the programmable electronic circuit. As such, it is possible to increase the axial distance Z between T1 1530 and T2 1532 almost to the limit of the total length of the autonomous perforating drone 1510. Placing T1 1530 and T2 1532 further away from one another achieves a more precise measure of velocity and retains precision more effectively as higher drone velocities are encountered, especially where sample rates for T1 1530 and T2 1532 reach an upper limit.

Figure 8:
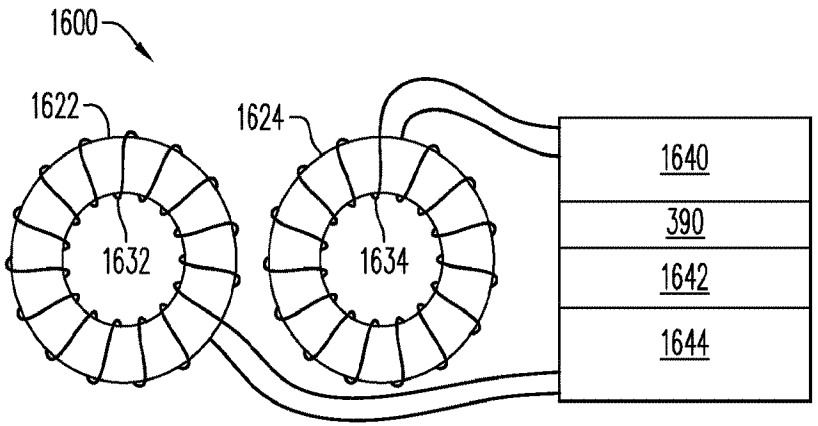
FIG. 8 is a plan view of a navigation system of an embodiment.

In an exemplary embodiment of a navigation system 1600 such as used in the ultrasonic transducer system 1500 shown in FIG. 7, two wire coils 1632, 1634 are respectively used with the transceivers 1530, 1532. As seen in FIG. 8, a signal generating and processing unit 1640 is attached to both ends of a first coil 1632 wrapped around a first core 1622 of high magnetic permeability material and a second coil 1634 wrapped around a second core 1624 of high magnetic permeability material. As discussed previously, although the cores 1622, 1624 and the coils 1632, 1634 are presented in FIG. 8 as toroidal in shape, other shapes are possible. The first coil 1632 and the second coil 1634 of the exemplary embodiment shown in FIG. 7 and FIG. 8 are configured coplanar to one another. Since a toroidal coil defines a plane, the magnetic field established by such a coil possesses a structure related to this plane. Changes in magnetic permeability occurring coplanar to the plane of the toroidal coil will have greater effect on the coil's inductance than changes that are not coplanar. Changes in magnetic permeability in a plane perpendicular to the plane of the coil may have little to no impact on the coil's inductance value. As previously described, the exemplary ultrasonic transducer system 1500 may register the same anomaly, i.e., change in magnetic permeability, once for each coil 1632, 1634. In this configuration, having the coils 1632, 1634 disposed on the same plane may achieve this result.

The processing unit 1640 may include an oscillator circuit 1644 and a capacitor 1642. An oscillating signal is generated by the oscillator circuit 1644, and sent to the wire coils 1632, 1634. With the wire coils 1632, 1634 acting as inductors, a magnetic field is established around the wire coils 1632, 1634 when charge flows through the wire coils 1632, 1634. Insertion of the capacitor 1642 in the processing unit 1640 results in constant transfer of electrons between the wire coils/inductors 1632, 1634 and the capacitor 1642, i.e., in a sinusoidal flow of electricity between the wire coils 1632, 1634 and the capacitor 1642. The frequency of this sinusoidal flow will depend upon the capacitance value of the capacitor 1642 and the magnetic field generated around the wire coils 1632, 1634, i.e., the inductance value of the wire coils 1632, 1634. The peak strength of the sinusoidal magnetic field around the wire coils 1632, 1634 will depend on the materials immediately external to the wire coils 1632, 1634. With the capacitance of the capacitor 1642 being constant and the peak strength of the magnetic field around the wire coils 1632, 1634 being constant, the circuit will resonate at a particular frequency. That is, current in the circuit will flow in a sinusoidal manner having a frequency, referred to as a resonant frequency, and a constant peak current.

Figure 9:
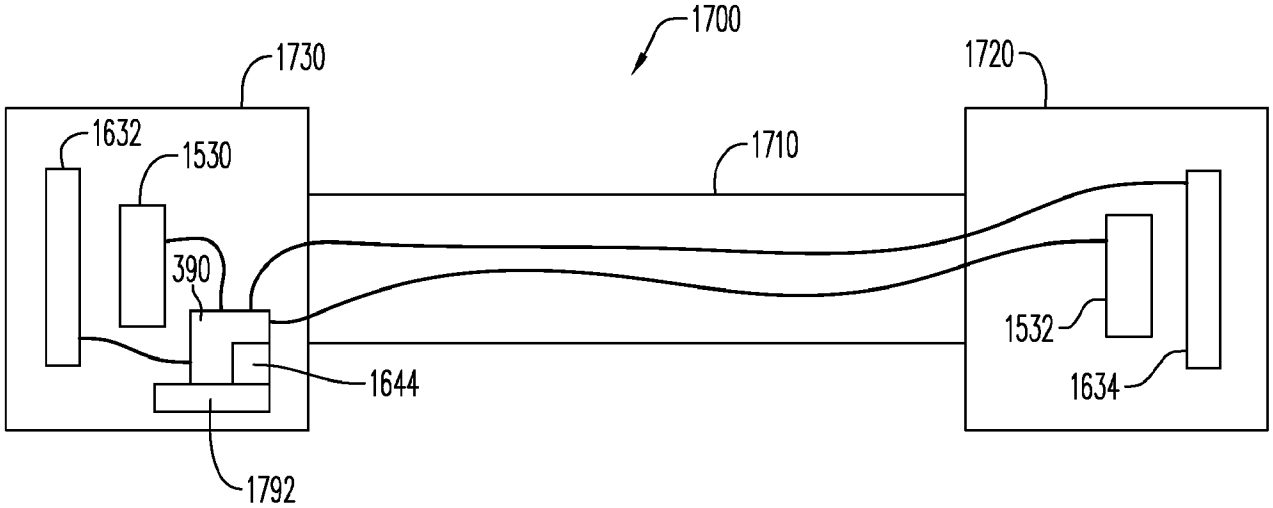
FIG. 9 is a block diagram, cross sectional view of a drone in accordance with an embodiment.

With reference to FIG. 9, a schematic cross-sectional view of an autonomous perforating drone 1700 as generally described throughout this disclosure is shown. For example, the autonomous perforating drone 1700 may take the form of the autonomous perforating drone 100 shown in FIGS. 2A-3B. For example, the body portion 1710 of the autonomous perforating drone 1700 may bear one or more shaped charges. As is well-known in the art, detonation of the shaped charges is typically initiated with an electrical pulse or signal supplied to a detonator. The detonator of the autonomous perforating drone embodiment 1700 shown in FIG. 9 and generally with respect to the exemplary embodiments of an autonomous perforating drone as described throughout this disclosure—e.g., in FIGS. 2A-3B—may be located in the control module section 130, the perforating assembly section 110, or at a position or intersection therebetween. The detonator 133 may initiate the shaped charges either directly or through an intermediary structure such as a detonating cord.

As would be understood by one of ordinary skill in the art, electrical power typically supplied via the wireline cable 2012 to wellbore tools, such as a tethered drone or typical perforating gun, would not be available to an autonomous perforating drone as described herein and shown in FIG. 9. In order for all components of the autonomous perforating drone 1700 to be supplied with electrical power, a power supply 1792 may be included generally as part of the autonomous perforating drone 1700 in any portion such as configurations dictate. It is contemplated that the power supply 1792 may be disposed so that it is adjacent any components of the autonomous perforating drone 1700 that require electrical power (such as an onboard computer 390).

The on-board power supply 1792 for the autonomous perforating drone 1700 may take the form of an electrical battery; the battery may be a primary battery or a rechargeable battery. Whether the power supply 1792 is a primary or rechargeable battery, it may be inserted into the autonomous perforating drone 1700 at any point during construction of the autonomous perforating drone 1700 or immediately prior to insertion of the autonomous perforating drone 1700 into the wellbore 2016. If a rechargeable battery is used, it may be beneficial to charge the battery immediately prior to insertion of the autonomous perforating drone 1700 into the wellbore 2016. Charge times for rechargeable batteries are typically on the order of minutes to hours.

In an embodiment, another option for the power supply 1792 is the use of a capacitor or a supercapacitor. A capacitor is an electrical component that consists of a pair of conductors separated by a dielectric. When an electric potential is placed across the plates of a capacitor, electrical current enters the capacitor, the dielectric stops the flow from passing from one plate to the other plate and a charge builds up. The charge of a capacitor is stored as an electric field between the plates. Each capacitor is designed to have a particular capacitance (energy storage). In the event that the capacitance of a chosen capacitor is insufficient, a plurality of capacitors may be used. When a capacitor is connected to a circuit, a current will flow through the circuit in the same way as a battery. That is, when electrically connected to elements that draw a current the electrical charge stored in the capacitor will flow through the elements. Utilizing a DC/DC converter or similar converter, the voltage output by the capacitor will be converted to an applicable operating voltage for the circuit. Charge times for capacitors are on the order of minutes, seconds or even less.

A supercapacitor operates in a similar manner to a capacitor except there is no dielectric between the plates. Instead, there is an electrolyte and a thin insulator such as cardboard or paper between the plates. When a current is introduced to the supercapacitor, ions build up on either side of the insulator to generate a double layer of charge. Although the structure of supercapacitors allows only low voltages to be stored, this limitation is often more than outweighed by the very high capacitance of supercapacitors compared to standard capacitors. That is, supercapacitors are a very attractive option for low voltage/high capacitance applications as will be discussed in greater detail hereinbelow. Charge times for supercapacitors are only slightly greater than for capacitors, i.e., minutes or less.

A battery typically charges and discharges more slowly than a capacitor due to latency associated with the chemical reaction to transfer the chemical energy into electrical energy in a battery. A capacitor is storing electrical energy on the plates so the charging and discharging rate for capacitors are dictated primarily by the conduction capabilities of the capacitors plates. Since conduction rates are typically orders of magnitude faster than chemical reaction rates, charging and discharging a capacitor is significantly faster than charging and discharging a battery. Thus, batteries provide higher energy density for storage while capacitors have more rapid charge and discharge capabilities, i.e., higher power density, and capacitors and supercapacitors may be an alternative to batteries especially in applications where rapid charge/discharge capabilities are desired.

Thus, the on-board power supply 1792 for the autonomous perforating drone 1700 may take the form of a capacitor or a supercapacitor, particularly for rapid charge and discharge capabilities. A capacitor may also be used to provide additional flexibility regarding when the power supply is inserted into the autonomous perforating drone 1700, particularly because the capacitor will not provide power until it is charged. Thus, shipping and handling of the autonomous perforating drone 1700 containing shaped charges or other explosive materials presents low risks where an uncharged capacitor is installed as the power supply 1792. This is contrasted with shipping and handling of an autonomous perforating drone 1700 with a battery, which can be an inherently high risk activity and frequently requires a separate safety mechanism to prevent accidental detonation. Further, and as discussed previously, the act of charging a capacitor is very fast. Thus, the capacitor or supercapacitor being used as a power supply 1792 for the autonomous perforating drone 1700 can be charged immediately prior to deployment of the autonomous perforating drone 1700 into the wellbore 2016.

In an aspect, magnetic sensors such as Hall effect magnetic sensors or magnetometers may be used in combination with a super capacitor as a depth correlation sensor in the exemplary autonomous perforating drones described herein. Such a system may be used with a magnetic ring (e.g., a plastic with flexible magnetic tape or film secured thereto) between adjacent wellbore casings, for example, at a collar between casing ends, wherein the magnetic ring includes beacons or magnets for detection by the drone sensors. In another aspect, casing collars may be painted with high temperature paint or adhesives including magnetic material such as metal fillings, powder, or flakes.

While the option exists to ship the autonomous perforating drone 1700 preloaded with a rechargeable battery which has not been charged, i.e., the electrochemical potential of the rechargeable battery is zero, this option comes with some significant drawbacks. The goal must be kept in mind of assuring that no electrical charge is capable of inadvertently accessing any and all explosive materials in the autonomous perforating drone 1700. Electrochemical potential is often not a simple, convenient or failsafe thing to measure in a battery. It may be the case that the potential that a 'charged' battery may be mistaken for an 'uncharged' battery simply cannot be reduced sufficiently to allow for shipping the autonomous perforating drone 1700 with an uncharged battery. In addition, as mentioned previously, the time for charging a rechargeable battery having adequate power for the autonomous perforating drone 1700 could be on the order of an hour or more. Currently, fast recharging batteries of sufficient charge capacity are uneconomical for the 'one-time-use' or 'several-time-use' that would be typical for batteries used in the autonomous perforating drone 1700.

In an embodiment, electrical components of an exemplary autonomous perforating drone as described throughout this disclosure including the control module 137, an oscillator circuit 1644, one or more wire coils 1632, 1634, and one or more ultrasonic transceivers 1530, 1532 may be battery powered while explosive elements like the detonator for initiating detonation of the shaped charges are capacitor powered. Such an arrangement would take advantage of the possibility that some or all of the control module 137, the oscillator circuit 1644, the wire coils 1632, 1634, and the ultrasonic transceivers 1530, 1532 may benefit from a high density power supply having higher energy density, i.e., a battery, while initiating elements such as detonators typically benefit from a higher power density, i.e., capacitor/supercapacitor. A very important benefit for such an arrangement is that the battery is completely separate from the explosive materials, affording the potential to ship the autonomous perforating drone 1700 preloaded with a charged or uncharged battery. The power supply that is connected to the explosive materials, i.e., the capacitor/supercapacitor, may be very quickly charged immediately prior to dropping the autonomous perforating drone 1700 into wellbore 2016.

In an aspect, a capacitor used as a power supply in the exemplary autonomous drones described throughout this disclosure may be charged to 30-40 Amps, and/or charged for approximately 15-40 minutes per autonomous perforating drone and provide approximately 1 hour of active power.

As shown in the exemplary embodiment of FIG. 3A, when the control module 137 is received within the hollow interior portion 132 of the control module section 130, the donor charge 134 is adjacent to and substantially aligned with the ballistic channel 141, and a portion 139 of the control module housing 138 is positioned between the donor charge 134 and the ballistic channel 141. For purposes of this disclosure, "adjacent" means next to or near, but is not limited to directly abutting and does not exclude the presence of intervening structures. Thus, when the control module 137 is received within the hollow interior portion 132 of the control module section 130, the ballistic interrupt 140 within the ballistic channel 141 is positioned in a spaced apart relationship between the donor charge 134 and the receiver booster 150.

In an aspect, the donor charge 134 is positioned within a detonator channel 145 within the control module 137, and the detonator 133 is positioned adjacent to the donor charge 134 within the detonator channel 145 and substantially aligned with the donor charge 134 along the longitudinal axis x. The detonator 133 may be, for example and without limitation, an explosive charge or any other device as is well known in the art for causing a detonation, ignition, or ballistic initiation. In an aspect, the detonator 133 may be a selective detonator. For purposes of this disclosure, "selective" means that the detonator 133 is initiated only when it receives a specific initiating signal or selective sequence signal, as discussed above, from the control module 137 (i.e., the programmable electronic circuit), e.g., to cause a capacitive discharge to a fuse of the detonator 133. One benefit of a selective detonator is that it is radio-frequency (RF)-safe—i.e., it will not be initiated by stray RF signals in the proximity of the detonator 133.

The donor charge 134 is also an explosive shaped charge, but the donor charge 134 may include, for example, an explosive material within a casing (not numbered), designed to create a directed perforating jet upon detonation, as is well known in the art. According to the exemplary configuration, detonating the detonator 133 will cause the donor charge 134 to detonate. In an aspect, the donor charge 134 may be designed, for example and without limitation, to have an explosive power for contributing to breaking apart the drone upon detonation. In another aspect, the donor charge 134 may be explosive and/or explosive/liner assembly as in a typical shaped charge but may be pressed into a plastic housing instead of contained within a metal casing.

The ballistic interrupt 140 is thus an important safety and operational feature of the autonomous perforating drone 100. For example, in operation, when the donor charge 134 is detonated it produces the perforating jet that pierces the portion 139 of the control module housing 138 between the donor charge 134 and the ballistic channel 141, and travels into the ballistic channel 141. When the ballistic interrupt 140 is in the closed state 143 shown in FIG. 3A, it provides a physical barrier and thereby prevents the perforating jet created by the donor charge 134 from reaching the receiver booster 150 and thereby initiating detonation (as explained further below) of the autonomous perforating drone 100. Specifically, with continuing reference to the exemplary embodiment shown in FIGS. 3A and 4, the ballistic interrupt 140 includes a through-bore 142 that extends through the ballistic interrupt 140 between a first opening 142*a* of the through-bore 142 and a second opening 142*b* of the through-bore 142. When the ballistic interrupt 140 is in the closed state 143, the through-bore 142 is substantially perpendicular to the longitudinal axis x and the ballistic interrupt 140 otherwise prevents ballistic communication between the donor charge 134 and the receiver booster 150 by shielding the receiver booster 150 from the perforating jet created by the donor charge 134. Accordingly, the ballistic interrupt 140 in the closed state 143 does not provide a path through which the perforating jet created by the donor charge 134 may reach the receiver booster 150 and thus is no longer ballistically aligned with the donor charge 134. In a further aspect of the exemplary closed state 143, the first opening 142*a* and the second opening 142*b* of the through-bore 142 may be positioned within an area of the ballistic interrupt cavity 146 at the diameter $d_8$ which is beyond the diameter of the ballistic channel 141 and may enhance the shielding effect of the ballistic interrupt 140. In another aspect, the ballistic interrupt 140 may include additional holes therethrough and/or in communication with the through-bore 142, for preventing failure or collapse of the autonomous perforating drone 100 due to a pressure differential across the ballistic interrupt 140.

In some embodiments, the detonator 133 may be spaced apart from the donor charge 134. For example, a donor charge may be positioned in the ballistic channel 141 or in the through-bore 142 of the ballistic interrupt 140. In such embodiments, the detonator 133 would provide sufficient ballistic energy to reach the spaced-apart donor charge, which may include, e.g., penetrating the portion 139 of the control module housing 138 between the detonator channel 145 and the ballistic channel 141. In embodiments in which a donor charge is positioned in the through-bore 142, the ballistic energy of the detonator 133 would be insufficient to initiate the donor charge through the ballistic interrupt 140 in the closed state 143. Thus, the safety control provided by the ballistic interrupt 140 would not be compromised.

On the other hand, when the autonomous perforating drone 100 is ready for arming, e.g., after passing a safety check and a function test at a wellbore site and immediately before or while being deployed into the wellbore, the ballistic interrupt 140 is moved to the open state 144 as shown in FIG. 3B. In the open state 144, the through-bore 142 is substantially parallel to the longitudinal axis x and coaxial with the ballistic channel 141. The through-bore 142 in the open state 144 allows ballistic communication via the through-bore 142 between the donor charge 134 and the receiver booster 150 such that the perforating jet created by the donor charge 134 may reach the receiver booster 150, causing the receiver booster 150 to detonate when subject to the perforating jet. The receiver booster 150 is generally an explosive charge or any other device, as is well known in the art, for causing an explosion, initiation, or ballistic force, including encapsulated receiver boosters and receiver boosters in a pressure sealed housing 151. Detonation of the receiver booster 150 initiates the detonating cord 160 which is further connected to and configured for detonating the shaped charges 113, as is generally known and explained in additional detail with respect to FIG. 5A.

The pressure sealed housing 151 of the receiver booster 150 may further extend to, or a separate pressure sealed housing may be used for, the connection between the receiver booster 150 and the detonating cord 160. In an aspect, the pressure sealed housing 151 may be rated to at least 10,000 psi and, for exemplary uses, to at least between 15,000 psi and 20,000 psi to enhance waterproof capability. In another aspect, a small amount of grease may be used at a crimp connection between the receiver booster 150 and the detonating cord 160 to prevent water invasion into the connection. As fluid ingression could potentially desensitize the explosives in the detonating cord 160, other techniques for sealing the receiver booster 150 onto the detonating cord 160, and/or sealing the detonating cord 160, are contemplated and include, without limitation, housing the receiver booster 150 and/or the detonating cord 160 in a cap that may include a grommet (or the like) for passing or fitting the detonating cord 160 therethrough, and may further include additional sealing mechanisms such as internal O-rings (or the like) for preventing fluid from seeping into the explosives at certain junctions. In addition, internal contours of the autonomous perforating drone 100, e.g., the configuration of the ballistic channel 141, may be conformed closely to the contour(s) of the receiver booster 150 and the detonating cord 160, including any housings, caps, or sealing mechanisms thereon, to decrease the area through which fluid may encounter the components/connections.

In a further aspect, the receiver booster 150 may be enlarged relative to the detonating cord 160 to prevent an initial bend or curve in the detonating cord 160 which may interfere with assembly of the detonating cord 160 to the receiver booster 150 and result in nicks or crimps in the detonating cord 160. In still a further aspect, the detonating cord 160 may be energetically coupled to the receiver booster 150 by engaging a lower end of the receiver booster 150 or being placed in a side-by-side configuration with the receiver booster 150.

The ballistic interrupt 140 is movable between the closed state 143 and the open state 144 using, for example, a mechanical key as part of a control system at the surface of the wellbore. With reference to the exemplary embodiment shown in FIG. 5A, the ballistic interrupt 140 includes a ballistic interrupt actuator 460 that is part of or in operable connection with the ballistic interrupt 140, for example when the ballistic interrupt 140 is cylindrical and extends laterally through the autonomous perforating drone 100, and is received in an opening 462 in the control module section body 191. The ballistic interrupt actuator 460 includes a keyway 461 for receiving the mechanical key (not shown). The mechanical key may rotate the keyway 461 using a rotational force, thereby rotating the ballistic interrupt 140 between the closed state 143 and the open state 144 (or vice versa). In the exemplary embodiments, the ballistic interrupt 140 is substantially cylindrically-shaped or spherically shaped and is rotatable between the closed state 143 and the open state 144 (and vice versa). The ballistic interrupt 140 including the ballistic interrupt actuator 460 is further shown and described with respect to FIG. 12. In other embodiments, the ballistic interrupt 140 may take any shape or configuration consistent with this disclosure, i.e., movable between a closed state and an open state. The ballistic interrupt 140 may also be moved by other mechanical techniques and using other configurations of a ballistic interrupt actuator and mechanical engagement or otherwise, such as a socket-nut engagement or pin-slot engagement, or may be movable via a magnetic engagement, or via a tool that extends through the control module section body 191 and directly engages the ballistic interrupt 140.

FIG. 4 shows, among other things, an exploded, cross-sectional view of the control module section 130 of the exemplary autonomous perforating drone 100. For example, the control module 137 is shown removed from the hollow interior 132 of the control module section 130 and an opening 147 from the ballistic channel 141 into the hollow interior portion 132 is visible. It is through the opening 147 that a perforating jet created by the donor charge 134 travels into the ballistic channel 141 and, if the ballistic interrupt 140 is in the open state 144, through the through-bore 142, and ultimately arrives at the receiver booster 150 to initiate the detonating cord 160 that is attached to the receiver booster 150.

The detonating cord 160 extends away from the receiver booster 150 in the direction v' towards, e.g., the perforating assembly section 110 and the shaped charges 113 positioned therein. The detonating cord 160 may be any known detonating cord that is pressure and temperature resistant to downhole conditions. A conversion region 330 guides the detonating cord 160 to a connecting portion 410 (FIGS. 5A, 5B, and 5E) including a detonating cord slot 411 of a first shaped charge 113, i.e., the shaped charge 113 nearest the control module section 130, via a guiding slot 310 formed as a radial cutaway in the conversion region 330. The conversion region 330 in the exemplary embodiment shown in FIG. 4 is positioned between, and is integral with, each of the perforating assembly section 110 and the control module section 130. As noted previously in this disclosure, the perforating assembly section 110 and the control module section 130 are generally defined with respect and reference to the position and configuration of certain structures and componentry and for aiding the description of an exemplary autonomous perforating drone according to this disclosure. For example, the perforating assembly section 110 in the exemplary embodiment shown in FIG. 4 is generally the length L of the autonomous perforating drone 100 along which the shaped charges 113 are positioned and the control module section 130 is the length M of the autonomous perforating drone 100 along or within which, without limitation, control components (e.g., the control module 137) and initiation components (e.g., the detonator 133, the donor charge 134, the ballistic interrupt 140, and the receiver booster 150) are positioned. The conversion region 330 in the exemplary embodiment shown in FIG. 4 joins and transitions a configuration of the control module section 130 on a first side 331 of the conversion region 330 to a configuration of the perforating assembly section 110 on a second side 332 of the conversion region 330.

Figure 5A:
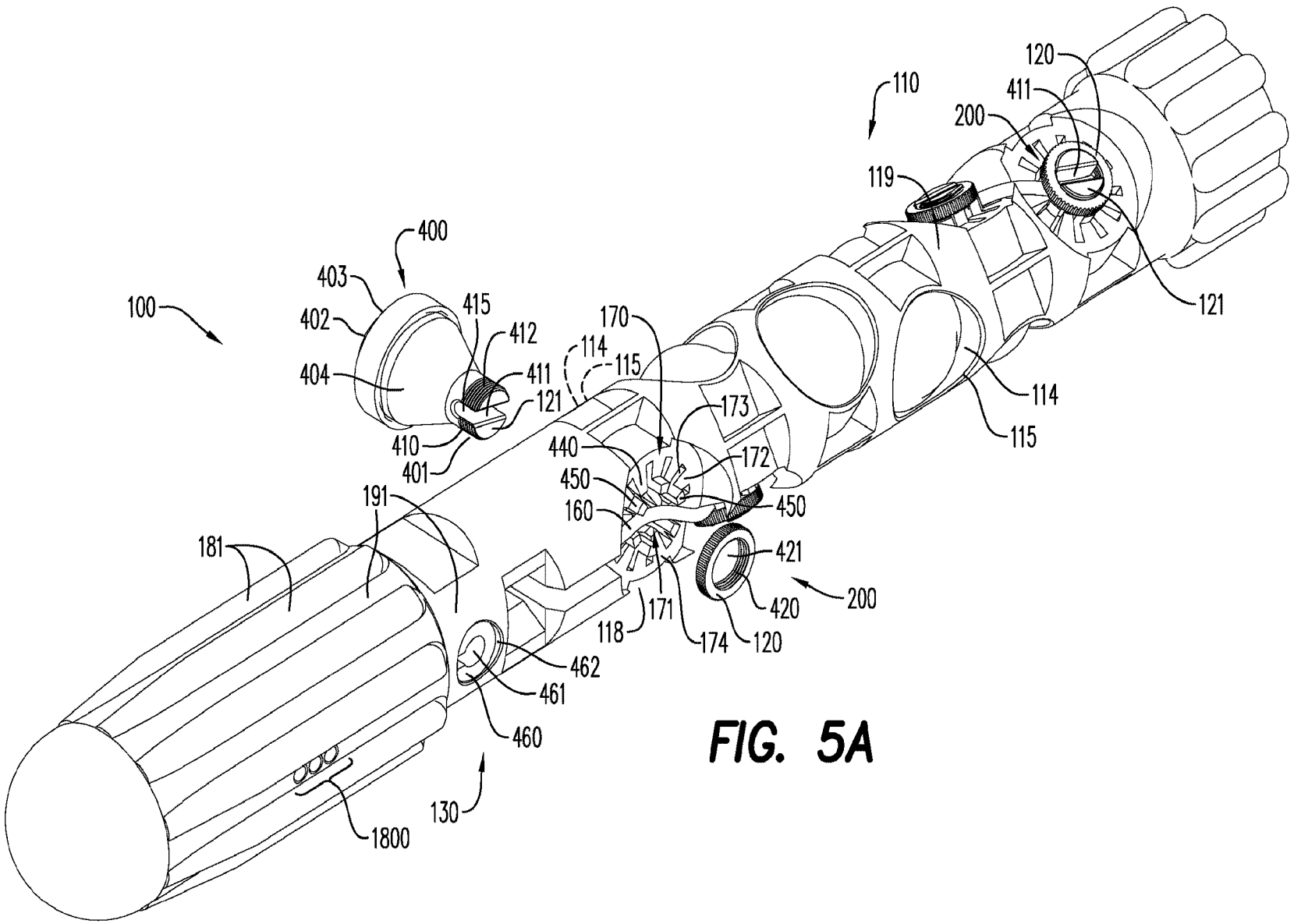
FIG. 5A is a perspective view with an exploded view of a shaped charge and a fixation connector of the exemplary embodiment according to FIG. 2B.
Figure 5B:
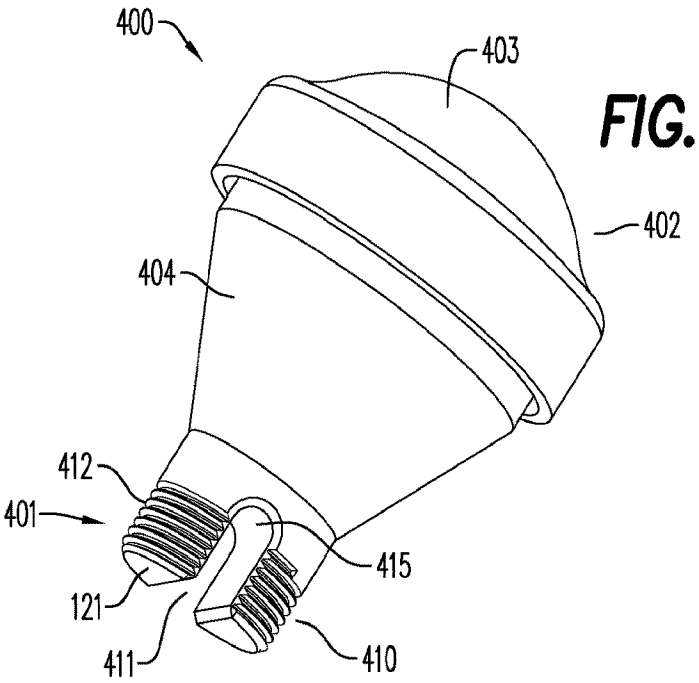
FIG. 5B shows the exemplary shaped charge for use with the exemplary fixation connector according to FIG. 5A.
Figure 5C:
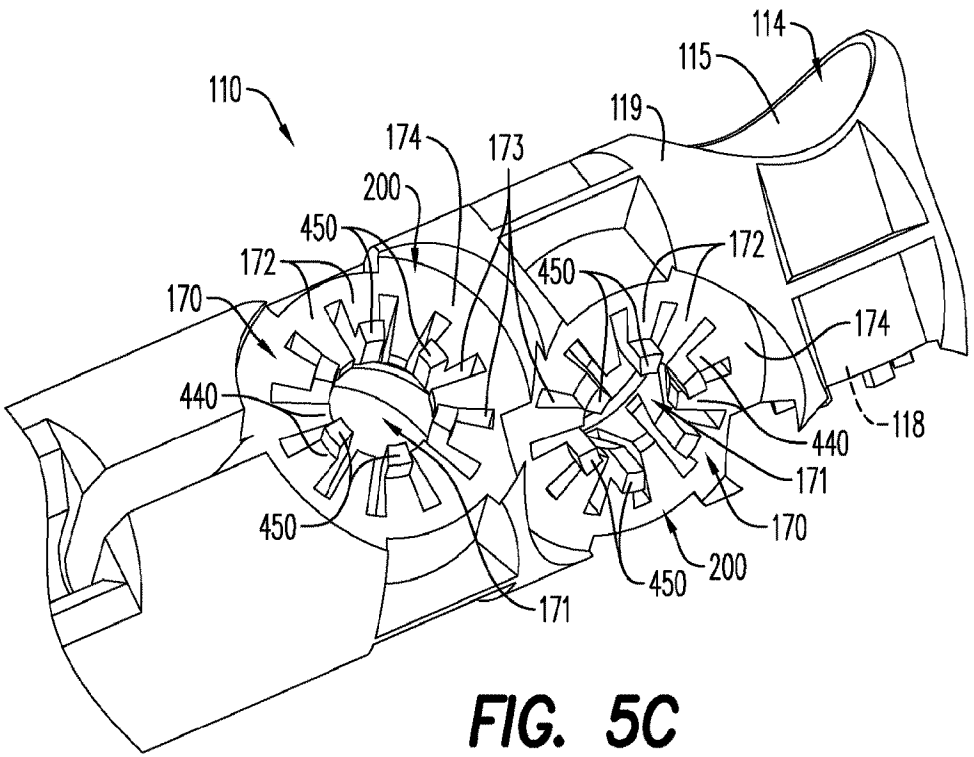
FIG. 5C shows the exemplary fixation connector according to FIG. 5A, in a first state of assembly.
Figure 5D:
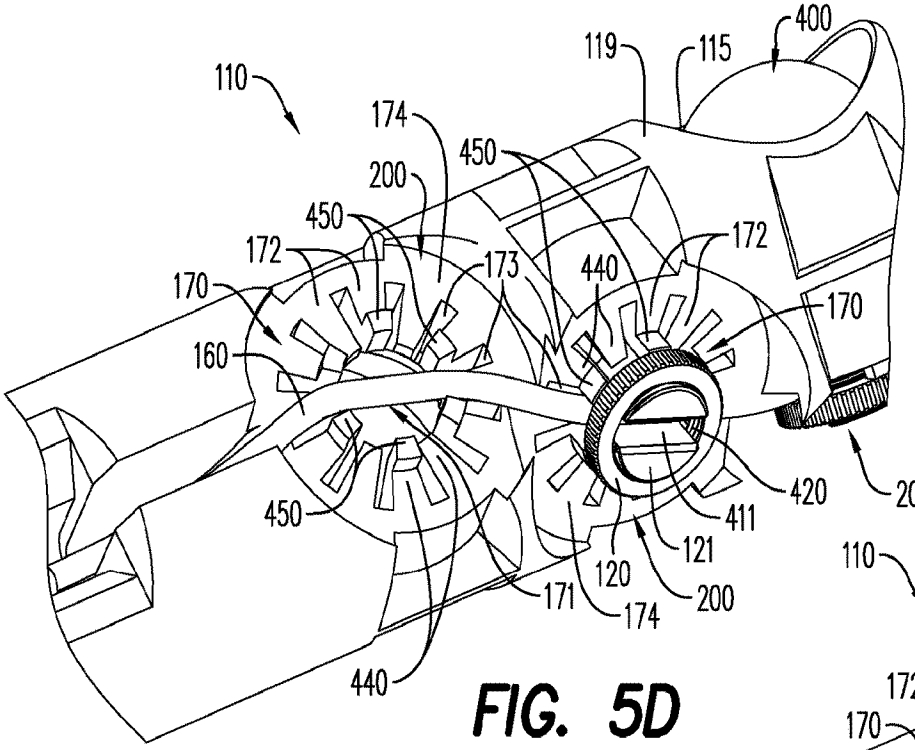
FIG. 5D shows the exemplary fixation connector according to FIG. 5A, in a second state of assembly.
Figure 5E:
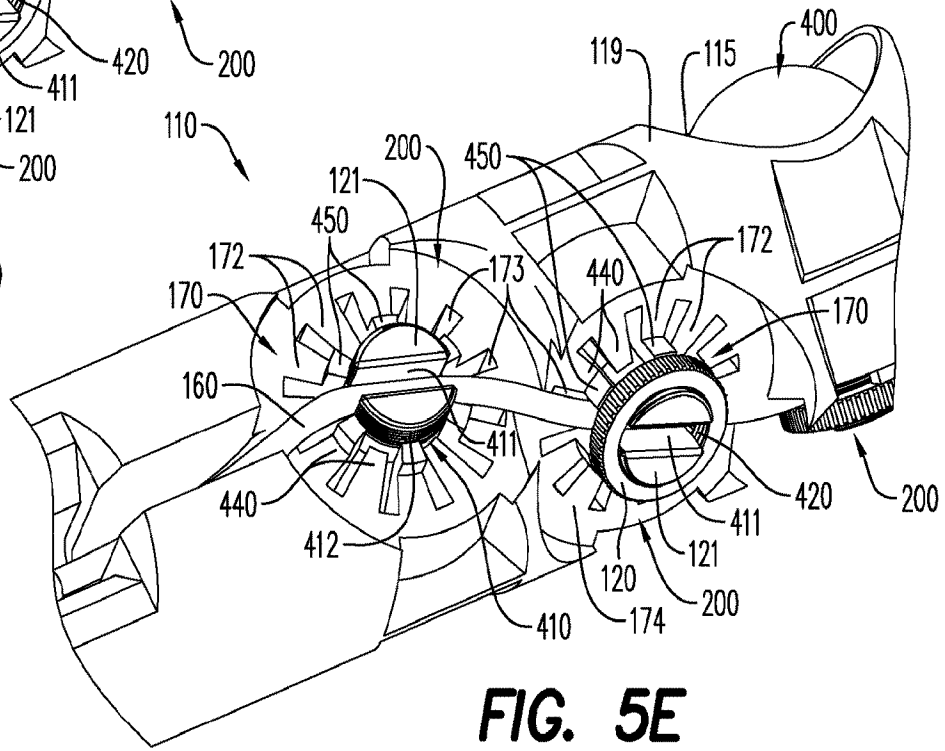
FIG. 5E shows the exemplary fixation connector according to FIG. 5A, in a third state of assembly.

With reference now to FIGS. 5A-5E, a shaped charge 400 and the fixation assembly 200 for retaining the shaped charge 400 in the perforating assembly section 110 according to an exemplary embodiment are shown. FIG. 5A shows a breakout of the shaped charge 400 and a fixation connector 120 (described below) from the exemplary autonomous perforating drone 100 and fixation assembly 200 as shown and described with respect to FIGS. 2A-4. FIG. 5B shows the exemplary shaped charge 400 for use in the embodiment shown in FIG. 5A. FIGS. 5C-5E show blown-up views of the exemplary fixation assemblies 200 in various stages of assembly with the exemplary shaped charge 400 and detonating cord 160.

With particular reference to FIG. 5A and FIG. 5B, the exemplary shaped charge 400 includes, among other things, an initiation side 401 at which the detonating cord 160, for example, will attach to detonate the shaped charge 400, and an encapsulated side 402 opposite the initiation side 401 and including a cap 403 for enclosing explosive and/or kinetic materials (not shown) within a casing 404 of the shaped charge 400, as is well known in the art. The exemplary shaped charges 400 include a cap 403 because the shaped charges 113, 400 in the disclosed exemplary embodiments of an autonomous perforating drone 100 are exposed—i.e., they are not otherwise isolated from wellbore conditions by a structure of the autonomous perforating drone 100. Wellbore fluids and conditions may be corrosive, excessively hot and high pressure, turbulent, and/or otherwise damaging to the shaped charges 113, 400, especially in the event that wellbore fluid or high pressures permeate into the shaped charge casing 404. Encapsulated shaped charges are generally known for such exposed applications. However, in various embodiments consistent with this disclosure, an autonomous perforating drone may have a configuration for enclosing associated shaped charges and thereby obviating the need for encapsulated shaped charges.

Continuing with reference to FIG. 5A and FIG. 5B, the connecting portion 410 of the exemplary shaped charge 400 is positioned at the initiation side 401 of the shaped charge 400 and may be integrally formed with the casing 404 as a projection therefrom. The exemplary connecting portion 410 shown in FIG. 5A and FIG. 5B is configured generally as a cylinder with the detonating cord slot 411, i.e., a parabolic void, extending between a bottom surface 121 of the connecting portion 410 and a detonating cord seat 415 within the cylinder. The detonating cord slot 411 and the detonating cord seat 415 may be shaped complimentarily to the detonating cord 160 or may include any configuration consistent with retaining and guiding the detonating cord 160 between shaped charges 400 along the length L of the autonomous perforating drone 100, as described herein.

With additional reference now to FIGS. 5C-5E, the shaped charge 400 and the connecting portion 410 are configured and sized such that the connecting portion 410 and an external threaded portion 412 of the connecting portion 410 protrude from a central aperture 171 of the fixation assembly 200 when the shaped charge 400 is received in the aperture 114 through the perforating assembly section 110. In the exemplary embodiments shown in FIGS. 5A and 5C-5E, the central aperture 171 defines, in part, the second opening 116 of the aperture 114 through the perforating assembly section 110. This configuration provides a connection area for the fixation connector 120 to engage the connecting portion 410 of the shaped charge 400 and clamp, compress, or otherwise secure the connecting portion 410 at the second opening 116, thereby securing, at least in part, the shaped charge 400 in the aperture 114. In the exemplary embodiment shown in FIGS. 5A, 5D, and 5E, the fixation connector 120 is an annular, female connector with a threaded inner surface 420 and an annular opening 421. The threaded inner surface 420 of the fixation connector 120 is complimentary to the external threaded portion 412 of the connecting portion 410 of the shaped charge 400, for threadingly engaging the external threaded portion 412 of the connecting portion 410 when the connecting portion 410 is received within the annular opening 421 of the fixation connector 120. The fixation connector 120 may then be threadingly advanced along the external threaded portion 412 of the connecting portion 410 until, e.g., it reaches and begins to compress against an opposing surface or structure of the fixation assembly 200. In the exemplary embodiment shown in FIGS. 5A and 5C-5E, the opposing structure includes a plurality of teeth 450 extending outwardly from a star-shaped plate 170 that will be further described with respect to the fixation assembly 200. However, the fixation assembly 200 is not limited by the disclosed geometries or configurations. In various embodiments (see, e.g., FIGS. 10B-15), other known compression, connection, or retention devices and techniques including, without limitation, clamps, clasps, screws, nuts, ratcheting connectors, straps, bands, tape, rubber rings and the like may be used to fixate various exemplary shaped charges, in various exemplary autonomous perforating drone assemblies. Further, the mechanisms, structures, and components of a particular fixation assembly may be separate or may be integrally formed with each other and/or the perforating assembly section body 119 as, for example, features of a single injection-molded piece.

With continuing reference to FIGS. 5A and 5C-5E, the star-shaped plate 170 in the exemplary fixation assembly 200 is integrally formed with the perforating assembly section body 119, as a feature thereof. For example, the star-shaped plate 170 is a generally circularly-shaped surface feature on the second side 118 of the perforating assembly section body 119 with respect to, and opposite, the first opening 115 of a corresponding aperture 114 through the perforating assembly section 110, with which the star-shaped plate 170 is concentrically aligned. In an aspect, the star-shaped plate 170 may be a terminus of the aperture 114.

The star-shaped plate 170 is defined in part by an outer ring portion 174 from which a plurality of fingers 172 extend radially inwardly between the outer ring portion 174 and respective end portions 440 of each finger 172. The end portions 440 are collectively positioned about the central aperture 171 in the star-shaped plate 170 and thereby define the central aperture 171. The central aperture 171 extends laterally (e.g., along the axis y) through the star-shaped plate 170 between an outside of the autonomous perforating drone 100 and an interior (not numbered) of the aperture 114 through the perforating assembly section 110. A plurality of gaps 173 extend radially outwardly from the central aperture 171 such that the fingers 172 and the gaps 173 are alternatingly arranged about a circumference of the central aperture 171, thus creating the so-called "star-shaped" feature.

The end portions 440 of some of the fingers 172 collectively include the plurality of teeth 450 that form a compression surface for the fixation connector 120 as described further herein with respect to an exemplary practice of the autonomous perforating drone 100. Each of the teeth 450 is a projection that is connected to, or integral with, a respective end portion 440 and extends away from the end portion 440 at about a 90-degree angle to the finger 172, in a direction away from the longitudinal axis x of the autonomous perforating drone 100. Thus, the plurality of teeth 450 will extend along at least a portion of the connecting portion 410 of the shaped charge 400 that protrudes from the central aperture 171 of the star-shaped plate 170 when the shaped charge 400 is retained in the aperture 114 through the perforating assembly section 110.

In an exemplary practice of the autonomous perforating drone 100, each shaped charge 400 may be connected to the exemplary autonomous perforating drone 100 by inserting the shaped charge 400 into the corresponding aperture 114 through the perforating assembly section 110. When the shaped charge 400 is fully received in the aperture 114 the connecting portion 410 including the external threaded portion 412 and the detonating cord slot 411 protrudes from the central aperture 171 in the star-shaped plate 170, as described. The detonating cord 160 may then be inserted into the detonating cord slot 411, down to the detonating cord seat 415, and the fixation connector 120 may be threaded onto and advanced along the connecting portion 410 until it reaches the plurality of teeth 450, against which it will compress and retain the shaped charge 400 and the detonating cord 160. The exemplary configuration of the plurality of teeth 450 shown in FIGS. 5A and 5C-5E elevates the fixation connector 120 above the detonating cord 160 within the detonating cord slot 411 such that the fixation connector 120 may be sufficiently compressed against the plurality of teeth 450 to secure the shaped charge 400 without crushing the detonating cord 160. Further, the compression is enhanced because the teeth 450 are positioned on the fingers 172 which have additional resiliency and may conform to oppose specific forces created by the fixation connector 120.

The configuration also allows the detonating cord 160 to extend along the length L of the perforating assembly section 110 through spaces (not numbered) created between the plurality of teeth 450 by end portions 440 that do not include teeth 450. In addition, the shaped charge 400 may be oriented (e.g., turned) within the aperture 114 such that the detonating cord slot 411 is oriented to direct the detonating cord 160 towards a subsequent shaped charge 400 on the perforating assembly section 110. In the exemplary embodiment shown in FIG. 5A, the shaped charges 400 are arranged in a helical pattern along the length L, and the detonating cord 160 follows the helical pattern and connects to each of the shaped charges 400. The detonating cord 160 in the assembled fixation assembly 200 is held in sufficient contact, communication, or proximity with the initiation end 401 of the shaped charges 400 such that the detonating cord 160 is energetically coupled to the initiation end 401 of each shaped charge 400 so as to detonate the explosive charge within the casing 404, as is well known in the art.

While the shaped charge apertures 114 (and correspondingly, the shaped charges 113, 400) are shown in a typical helical arrangement about the perforating assembly section 110 in the exemplary embodiment shown in FIGS. 2A-5E, the disclosure is not so limited and it is contemplated that any arrangement of one or more shaped charges may be accommodated, within the spirit and scope of this disclosure, by the exemplary autonomous perforating drone 100. For example, a single shaped charge aperture or a plurality of shaped charge apertures for respectively receiving a shaped charge may be positioned at any phasing (i.e., circumferential angle) on the body portion, and a plurality of shaped charge apertures may be included, arranged, and aligned in any number of ways. For example, and without limitation, the shaped charge apertures 114 may be arranged, with respect to the body portion, along a single longitudinal axis, within a single radial plane, in a staggered or random configuration, spaced apart along a length of the body portion, pointing in opposite directions, and the like.

In the exemplary embodiments, the autonomous perforating drone 110 including the perforating assembly section body 119, the control module section body 191, the tip section 195, and the tail section 180 may be formed from a material that will substantially disintegrate upon detonation of the shaped charges 113. In an exemplary embodiment, the material may be an injection-molded plastic that will substantially dissolve into a proppant when the shaped charges 113 are detonated, and the autonomous perforating drone 100 may be an integral unit. In the same or other embodiments, one or more portions of the autonomous perforating drone 100 may be formed from a variety of techniques and/or materials including, for example and without limitation, injection molding, casting (e.g., plastic casting and resin casting), metal casting, 3D printing, and 3D milling from a solid plastic bar stock. Reference to the exemplary embodiments including injection-molded plastics is thus not limiting. Further, as noted herein, the description of particular sections and portions of an autonomous perforating drone 100 are for aiding the disclosure with respect and reference to the position of various components, and forming the autonomous perforating drone 100, for example, with one or a combination of integral and separate elements, may be done as applications dictate, without limitation based on the disclosed sections and portions of an autonomous perforating drone 100.

For example, the autonomous perforating drone 100 may be formed as an integral unit, and a portion such as the tip section 195 according to this disclosure may then be removed and adapted for re-securing to the autonomous perforating drone 100, to allow the autonomous perforating drone 100 to, e.g., be transported without a detonator assembly (such as in the control module 137) according to applicable regulations. Once on site, the control module 137 may be inserted into, e.g., the control module section 130 according to this disclosure, and the tip section 195 re-secured thereto. The tip section 195 may be adapted for re-securing to the control module section 130 by milling, turning or injection molding complementary threaded portions, click slots or a bayonet key-turn in each, or using other techniques as known. The connection between the tip section 195 and the control module section is further shown and discussed with respect to FIG. 12. In another aspect, the control module 137 may be preassembled in the control module section 130, before transport, as applicable regulations and applications allow.

An autonomous perforating drone 100 formed according to this disclosure leaves a relatively small amount of debris in the wellbore post perforation. In some embodiments, at least a portion of the autonomous perforating drone 100 may be formed from plastic that is substantially depleted of other components including metals. Substantially depleted may mean, for example and without limitation, lacking entirely or including only nominal or inconsequential amounts. In some embodiments, the plastic may be combined with any other materials consistent with this disclosure. For example, the materials may include metal powders, glass beads or particles, known proppant materials, and the like that may serve as a proppant material when the shaped charges 113 are detonated. In addition, the materials may include, for example, oil or hydrocarbon-based materials that may combust and generate pressure when one or more of the detonator 133, the donor charge 134, and the shaped charges 113 are detonated, synthetic materials potentially including a fuel material and an oxidizer to generate heat and pressure by an exothermic reaction, and materials that are dissolvable in a hydraulic fracturing fluid.

In some embodiments, the exemplary autonomous perforating drone 100 may be connected at the tail portion 180 to a wireline that extends to the surface of the wellbore. The wireline may be connected to the autonomous perforating drone by any known technique for connecting a wireline to a wellbore tool. The wireline may further assist in retrieving any components of the autonomous perforating drone, including, without limitation, a control module, data collection device, or other portions that remain in the wellbore post detonation/perforation. The remaining components may be retracted to the surface along with the wireline.

The exemplary drones described throughout this disclosure, for example and without limitation, with particular reference to FIGS. 16-25, may also be configured for connecting in series as a drone string. In an aspect of a drone string, a single control assembly and/or ballistic interrupt assembly may be used for every drone in the drone string and the drone string would detonate upon a single initiation.

In an exemplary operation, one or more autonomous perforating drones 100 according to the disclosed embodiments are connected to a control system at the surface of a wellbore. The autonomous perforating drones 100 may be manually connected to the control system, or loaded into, for example and without limitation, a deployment vehicle, pressure equalization chamber, or other system for deploying the autonomous perforating drones 100 into the wellbore and including an appropriate connection to the control system. The control system may perform, among other things, a safety check and function test on each autonomous perforating drone 100. Upon a successful result from any test for safety, function, compliance, and/or otherwise, the control system or an operator may "arm" the autonomous perforating drone 100 by moving the ballistic interrupt 140 to an open state 144, as described. The control system may also record which autonomous perforating drones 100 have been armed and determine the order in which the respective autonomous perforating drones 100 will be deployed. The control system may communicate the order, and other instructions, to the autonomous perforating drone 100 via an electrical connection to the control assembly 131, e.g., the programmable electronic circuit, of each autonomous perforating drone 100 as described. Other instructions may include, without limitation, a threshold depth at which to send a detonation signal to the detonator 133, a time delay or other instructions for arming a trigger circuit, desired data to transmit to the wellbore surface, or other instructions that a control system may provide as discussed in U.S. Provisional Patent Application. Nos. 62/690,314 filed Jun. 26, 2018 and 62/765,185 filed Aug. 20, 2018, both of which are incorporated herein by reference in their entirety.

In the exemplary embodiments, the control assembly 131 includes, without limitation, a depth correlation device, and the programmable electronic circuit is either pre-programmed, or programmed via the control system, to receive from the depth correlation device data regarding the current depth of the autonomous perforating drone 100 within the wellbore and send a detonation signal to the detonator 133 when the autonomous perforating drone 100 reaches a predetermined depth. The depth correlation device may be, for example, an electromagnetic sensor, an ultrasonic transducer, or other known depth correlation devices consistent with this disclosure. The autonomous perforating drone 100 may also include a velocity sensor for measuring a current velocity of the autonomous perforating drone 100 within the wellbore, or the depth correlation device may include a velocity sensor or calculate a velocity based on sequential depth readings, and the programmable electronic circuit may be programmed to receive such velocity data as part of a criteria for transmitting the detonation signal.

In some embodiments, the autonomous perforating drone 100 may work with other systems, such as radio-frequency (RF) transducers, casing collar locators (CCL), or other known systems for determining a position of a wellbore tool within the wellbore.

With reference again to the exemplary embodiments, after being deployed into the wellbore the depth correlation device measures the depth of the autonomous perforating drone 100 within the wellbore. When the autonomous perforating drone 100 reaches the predetermined depth, the programmable electronic circuit sends a detonation signal to the detonator 133, which initiates detonation of the donor charge 134 and ultimately the shaped charges 113, as described. The programmable electronic circuit may be in wired, wireless, or contactable electrical communication with the detonator 133 by various known techniques, or may send the detonation signal via, or after activating, e.g., a trigger circuit or other intervening detonation component. The detonation signal may be, without limitation, a selective sequence signal, as previously discussed, that is unique to the detonator 133 of the particular autonomous perforating drone 100. The selective detonation signal may provide a safety measure against accidental firing by, for example, external RF signals.

As described, the autonomous perforating drone 100 travels through the wellbore with the tip section 195 downstream, and the detonating cord 160 is initiated by the receiver booster 150 at the downstream end 111 of the perforating assembly section 110. Accordingly, the ballistic/thermal release from the detonating cord 160 propagates along the length L of the perforating assembly section 110 in a direction from the downstream end 111 of the perforating assembly section 110 to the upstream end of the perforating assembly section 110, and the shaped charges 113 are correspondingly detonated (by the detonating cord 160) in a bottom-up, i.e., downstream to upstream, sequence. This bottom-up sequence for detonating the shaped charges 113 prevents downstream shaped charges and portions of the autonomous perforating drone 100 from being separated and blown away from the rest of the assembly, as may happen if an upstream shaped charge is detonated while a drone is traveling at high velocity in a wellbore fluid. Accordingly, the bottom-up detonation sequence may prevent downstream shaped charges from failing to detonate or detonating at an undesired location, and leaving unexploded shaped charges and extra debris in the wellbore.

Figure 10A:
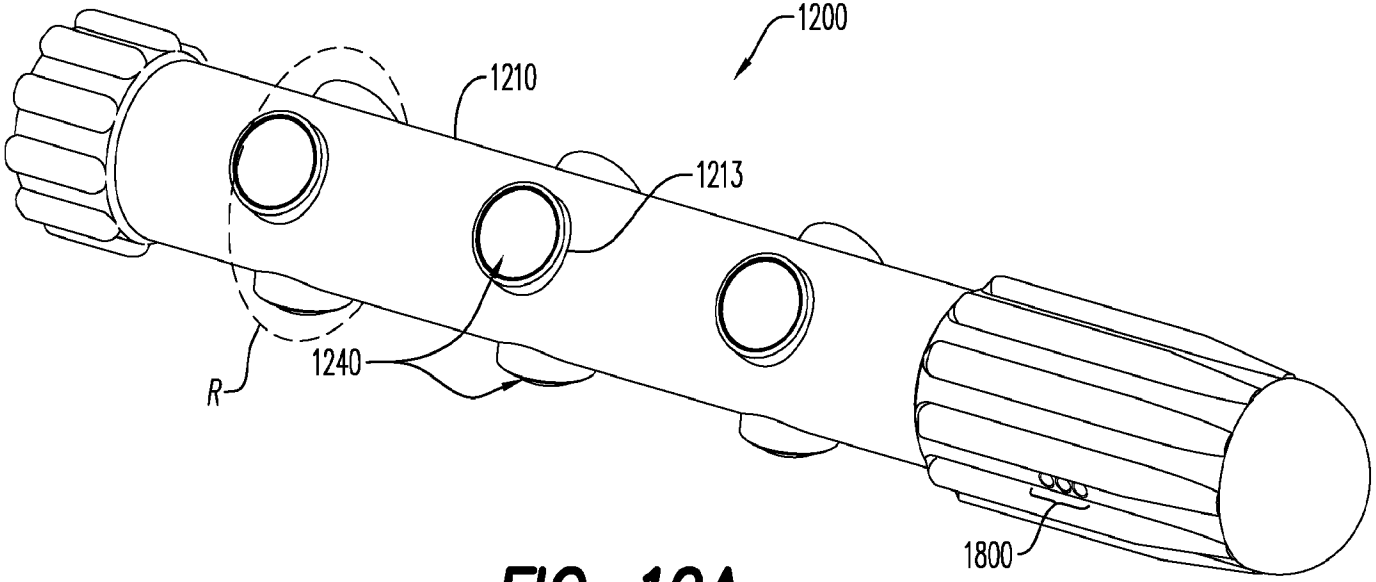
FIG. 10A is a perspective view of an autonomous perforating drone according to an exemplary embodiment.
Figure 10B:
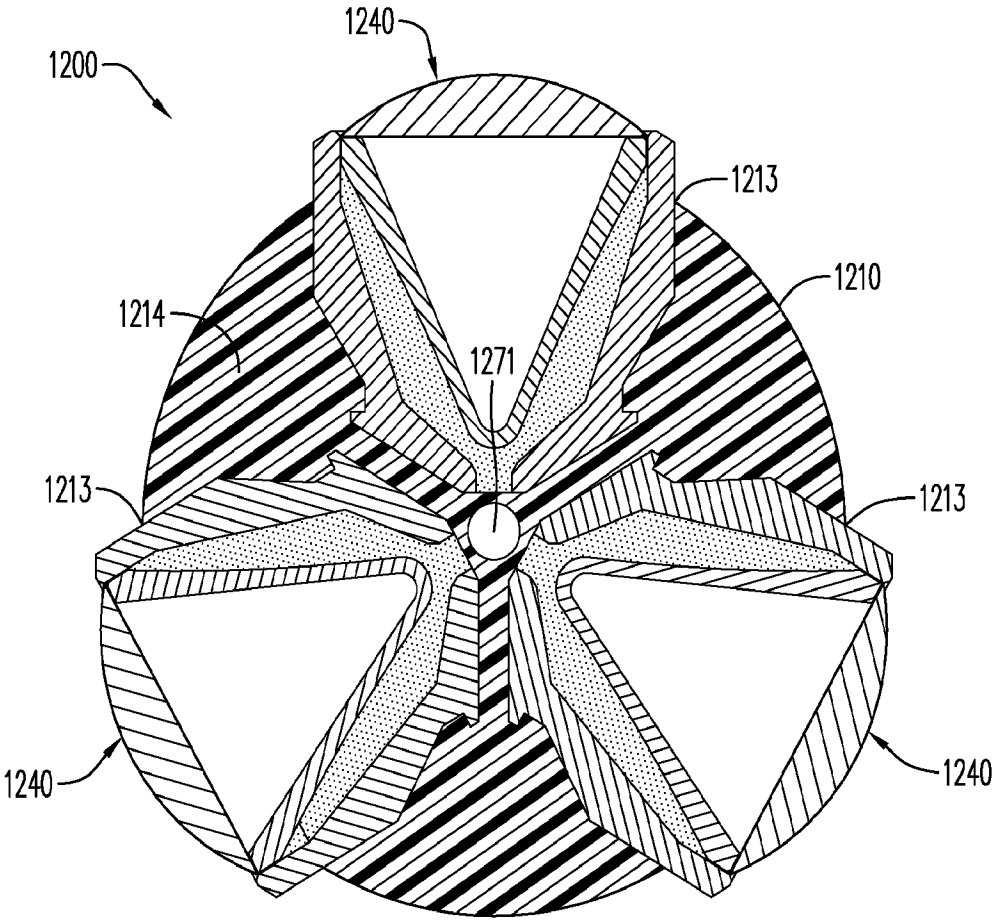
FIG. 10B is a lateral cross-sectional view of the autonomous perforating drone shown in FIG. 10A.

With reference now to FIGS. 10A and 10B, FIG. 10A shows an autonomous perforating drone 1200 according to an exemplary embodiment in which a plurality of shaped charges 1240 are arranged within one or more single radial planes R around a perforating assembly section body 1210 of the autonomous perforating drone 1200. Each of the shaped charges 1240 is received and retained in a corresponding shaped charge aperture 1213 at least in part within an interior 1214 of the perforating assembly section body 1210. FIG. 10B is a cross-sectional view showing the arrangement of the shaped charges 1240 and the shaped charge apertures 1213, among other things, within the interior 1214 of the perforating assembly section body 1210 of the exemplary autonomous perforating drone 1200 shown in FIG. 10A. In particular, FIG. 10B is a lateral cross-sectional view of the perforating assembly section body 1210 of the autonomous perforating drone 1200 shown in FIG. 10A taken along the radial plane R. For purposes of this disclosure, a radial plane is a plane generally containing each of a plurality of radii (e.g., shaped charges 1240) extending from a common center. The exemplary autonomous perforating drone 1200 shown in FIGS. 10A and 10B includes three shaped charges 1240 arranged in the same radial plane R and spaced apart by about a 120-degree phasing around the perforating assembly section body 1210. The type(s) of shaped charges used with an autonomous perforating drone as described throughout this disclosure are not limited and may include any shaped charges as are well-known and/or would be understood in the art and consistent with this disclosure. Exemplary embodiments of shaped charges for use with embodiments of an autonomous perforating drone and arrangement of shaped charges/shaped charge holders according to this disclosure, but not limited thereto, are shown and described with respect to FIGS. 10B-13B.

Figure 12:
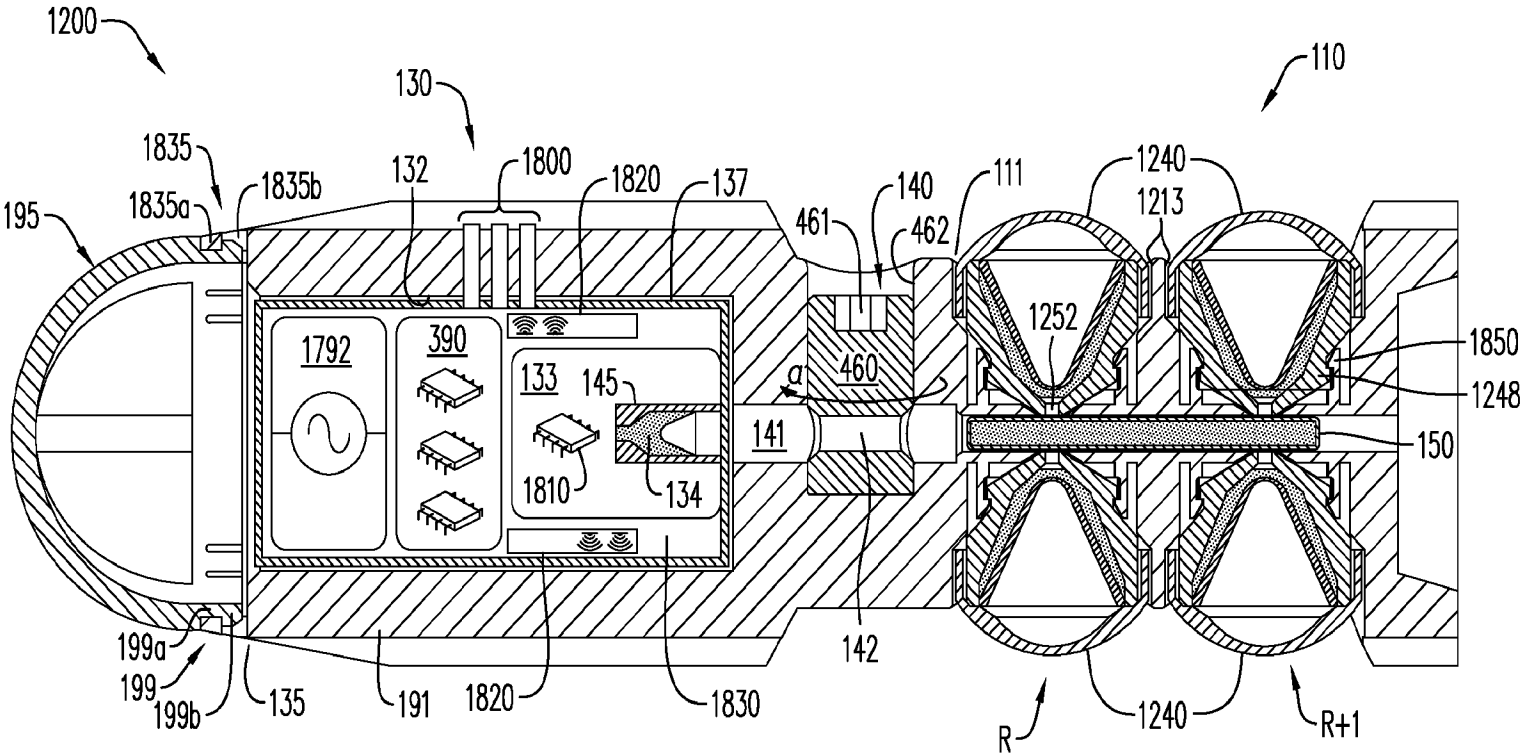
FIG. 12 is a cross-sectional view of an autonomous perforating drone according to an exemplary embodiment.

FIG. 10B also shows a detonator or booster 1271 positioned within the interior 1214 of the perforating assembly section body 1210 and adjacent to the shaped charges 1240 such that the shaped charges 1240 extend radially from the detonator 1271. In an aspect, the detonator 1271 may directly initiate detonation of the shaped charges 1240 upon detonation of the detonator 1271. In some embodiments, a detonation extender, such as a detonating cord or a booster device may also be secured in the interior 1214 of the perforating assembly section body 1210. The detonator extender may abut an end of the detonator 1271 or may be in side-by-side contact with at least a portion of the detonator 1271. The detonation extender may be in communication with the detonator 1271 such that upon activation of the detonator 1271 a detonation energy from the detonator 1271 simultaneously detonates the shaped charges in a first radial plane R and then initiates the detonation extender such that the detonation extender transfers a ballistic energy to detonate shaped charges arranged in a second, third, etc. radial plane R+1, R+2 (FIG. 12).

Figure 11:
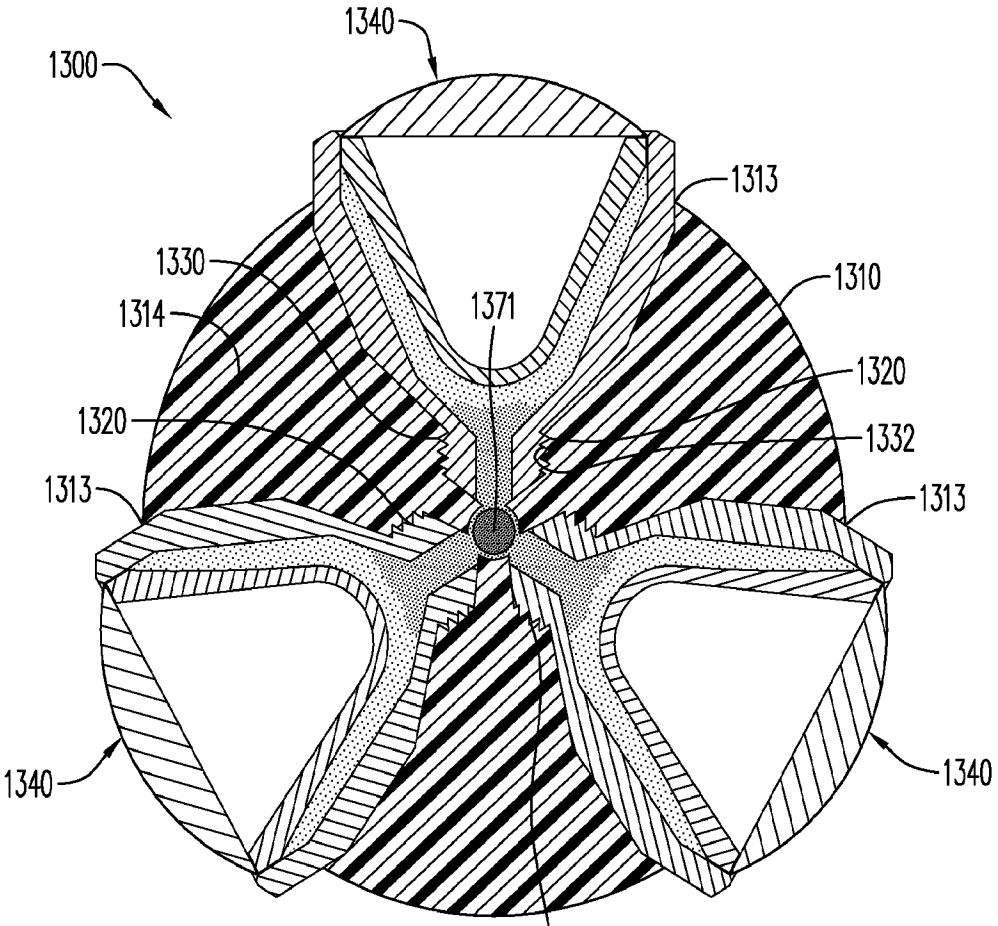
FIG. 11 is a lateral cross-sectional view of an autonomous perforating drone according to an exemplary embodiment.

With reference now to FIG. 11, an exemplary autonomous perforating drone 1300 according to some embodiments may include a threaded connection between a shaped charge 1340 and a shaped charge aperture 1313 in which the shaped charge 1340 is received. For example, FIG. 11 shows a lateral cross-sectional view taken along a radial plane of a body portion 1310 of the exemplary autonomous perforating drone 1300, similar to the lateral cross-sectional view shown in FIG. 10B. As shown in FIG. 11, the exemplary autonomous perforating drone 1300 includes three shaped charges 1340 arranged in the same radial plane and spaced apart by about a 120-degree phasing around the perforating assembly section body 1310. The shaped charges 1340 are respectively received and retained in the shaped charge apertures 1313 at least in part within an interior 1314 of the perforating assembly section body 1310. According to an aspect, the shaped charge apertures 1313 include an internal thread 1320 for threadingly securing the shaped charge 1340 therein. The internal thread 1320 may be a continuous thread or interrupted threads that mate or engage with corresponding threads 1332 formed on a back wall protrusion 1330 of the shaped charge 1340. Other aspects of a configuration of a shaped charge for use with an autonomous perforating drone as described throughout this disclosure are not limited by this disclosure and may include a shaped charge having any configuration as is well-known and/or would be understood in the art and consistent with this disclosure. For example, a shaped charge configuration in which a shaped charge casing houses one or more explosive loads and a liner atop the explosive loads for containing the explosive load(s) within the shaped charge and forming a perforating jet upon detonating the shaped charge.

In the exemplary configuration shown in FIG. 11, a detonator 1371 (and/or optionally, a detonating cord) is positioned within the interior 1314 of the perforating assembly section body 1310 and adjacent to the shaped charges 1340 such that the shaped charges 1340 extend radially from the detonator 1371. In an aspect, the detonator 1371 may directly initiate detonation of the shaped charges 1340 upon detonation of the detonator 1371. It is contemplated that at least one of the shaped charge apertures 1313 may be in open communication with a hollow portion of the interior 1314 of the perforating assembly section body 1310 in which the detonator 1371 and/or the detonating cord is positioned.

The arrangement of shaped charges within a single radial plane as shown in FIGS. 10A-11 is not limited to the embodiments depicted in those figures, nor is the disclosure of such arrangements limiting. For example, any number of charges capable of fitting around a circumference of a portion of an autonomous perforating drone according to this disclosure may be arranged within a single radial plane and respectively spaced apart at any desired phasing. In another non-limiting example, shaped charges in separate radial planes may be arranged in a staggered fashion such that the shaped charges overlap along a single radial plane. In addition, one or more of a detonator, selective detonator, detonating cord, and other internal components of an autonomous perforating drone may be included and configured as particular applications consistent with this disclosure dictate.

With reference now to FIG. 12, a partial cross-section view of an exemplary autonomous drone 1200 with charges arranged in a series of respective radial planes R, R+1, in accordance, at least in part, with the embodiment shown in FIG. 10A, is shown. As discussed throughout this disclosure, autonomous drone 1200 includes a control module section 130 positioned between and connected to each of a tip section 195 and a perforating assembly section 110. The control module section 130 in the exemplary embodiment shown in FIG. 12 is connected to the tip section 195 via complimentary engagement structures including a lip 1835 extending away from a first end 135 of the control module section 130 and a corresponding lip 199 formed on the tip section 195. The lip 1835 of the control module section 130 includes a tab 1835*a* extending inwardly (i.e., towards axis x) and a concave surface 1835*b* positioned between and connected to each of the tab 1835*a* and the control module section body 191. The lip 199 of the tip section 195 includes a notch 199*a* and a tongue 199*b* configured respectively to receive the tab 1835*a* of the lip 1835 of the control module section 130 and be received against the concave surface 1835*b* of the lip of the control module section 130. Tab 1835*a* thereby prevents lateral movement or disengagement of the tip section 195 by engaging each of the notch 199*a* and the tongue 199*b*.

In an aspect, one or both of the control module section body 191 (including the lip 1835) and the lip 199 of the tip section 195 may be formed from a material with sufficient flexibility and resiliency to allow engagement of the lip 1835 of the control module section 130 and the lip 199 of the tip section 195 to move under a force of pushing the tip section 195 and the control module section 130 together, thereby bringing the respective engagement structures into position, before returning the complimentary engagement portions into their set position providing engagement as described above. In an aspect, the tip section 195 may be formed from a material such as, but not limited to, a hard rubber. In a further aspect, the material is abrasion-resistant. The separable aspect of the tip section 195 and the control module section 130 may allow selective insertion of the control module 137 into the hollow interior 132 of the control module section 130. Other techniques and configurations for removably securing the tip section 195 to the control module section 130 include, without limitation, threaded engagements, dovetail arrangements, or other techniques as are known for removably securing structures.

In another aspect, the tip section 195 may be configured as a "frac ball" for sealing a corresponding "frac plug" downhole in the wellbore. For example, frac plugs are well known for isolating zones of a wellbore during perforation. One style of known frac plugs are configured as sealing elements with an open channel through the center of the plug such that the plug may be completely sealed by a frac ball that sets within the open channel. Sealing a zone currently undergoing perforation and fracking from downstream portions of the wellbore allows the fracking fluid to more efficiently achieve the pressures required for cracking hydrocarbon formations in the current zone because the fracking fluid does not lose pressure required to fill downstream portions of the wellbore. However, once the wellbore is ready for production, the frac balls must be drilled out of the frac plug openings to allow hydrocarbons to flow through the wellbore and to the surface.

In an aspect, the tip section 195 of the autonomous perforating drone may be configured dimensionally for use as a frac ball and formed from one or more materials such that the frac ball tip section will not be destroyed upon detonation of the autonomous perforating drone. The frac ball tip section may be retained to the control module section 130 by any known techniques including a threaded portion, clips, straps, friction fits, adhesives, retention in a cavity, or other techniques as described in or consistent with this disclosure. Upon detonation of the autonomous perforating drone, the frac ball tip section will release and travel downstream until it encounters and seals a frac plug. A drone for use with a frac ball tip section may be an autonomous perforating drone as described throughout this disclosure or may be a "dummy" drone, i.e., that does not carry perforating charges or other wellbore tools for performing a separate function in the wellbore. In either case, the control module 137 of the autonomous perforating (or dummy) drone may be made from standard metal and drilled out with the frac ball/plug, and the shaped charges may be formed at least in part from zinc to reduce debris. In addition, an autonomous perforating drone incorporating a tip section as a frac ball may be used in conjunction with an autonomous drone for deploying a frac plug, such that the frac plug drone is sent downhole, sets the plug, and the frac ball drone is sent in thereafter to provide the frac ball seal and potentially perforate the wellbore casing/hydrocarbon formation with shaped charges as discussed throughout this disclosure.

Continuing with reference to FIG. 12, an exemplary arrangement of components in the control module 137 is shown. In an aspect, the control module 137 includes a power source 1792 such as a battery or a capacitor as previously discussed. The power source 1792 may be used to power one or more of, among other things, an onboard computer 390 (i.e., control circuit(s)), sensors 1820 such as depth or velocity sensors, among others, as previously discussed, and detonator control electronics 1810 for, e.g., receiving and responding to selective detonation signals. Charging/programming contacts 1800 are electrically connected to one or more of, e.g., the power source 1792 and the onboard circuitry/sensors 390, 1820, 1810 and extend through the control module section body 191 for connecting to an external power/control source and respectively charging or programming components of the control module 137. In an aspect, the contacts 1800 may be a combination of various seals and electrical contacts configured for, without limitations, isolating a relay between an electrical contact on an outside of the drone and a programmable electronic circuit or a power supply. The seals and connections may include, without limitation, o-rings, gaskets, face seals, sealing tape, contact pins, shafts, surfaces extending from the drone body, and the like.

In an aspect, the components of the control module 137 in the exemplary embodiment shown in FIG. 12 are potted in material 1830 in the control module 137 to further pressure-isolate the components from potentially detrimental influence of surrounding environmental conditions, such as those of the wellbore. Other pressure-isolation techniques for the components include, without limitation, covering, embedding, and/or encasing the components in an injection-molded or 3D-printed material, and the like. Exemplary materials may include, without limitation, polyethylene-, polypropylene-, and/or polyamide-compounds.

The control module section 137, as previously discussed, further includes a detonator 133 and a donor charge 134 positioned within a detonator channel 145 of the control module 137. The donor charge 134 is substantially aligned with a ballistic channel 141 in which a ballistic interrupt 140 is positioned in a spaced apart relationship between the donor charge 134 and a receiver booster 150. In the embodiment shown in FIG. 12, the receiver booster 150 extends along a length of the ballistic channel 141 that is adjacent to a plurality of shaped charges 113 arranged in respective single radial planes R, R+1 and thereby directly initiates the shaped charges 113 upon detonation of the receiver booster 150 in a manner as previously discussed with respect to, e.g., a detonator or a detonating cord.

The exemplary ballistic interrupt 140 is cylindrically-shaped and functions as previously described. For example, the ballistic interrupt 140 in FIG. 12 is shown in an open state, i.e., where the autonomous drone 1200 would be considered armed in the sense that the donor charge 134 and the receiver booster 150 are in ballistic communication through the through-bore 142. The ballistic interrupt 140 may be movable, as previously described, between a closed state and an open state by, e.g., rotating ballistic interrupt actuator 460 approximately 90 degrees in a direction a, or opposite direction, such that the through-bore 142 shown in FIG. 12 as concentric with ballistic channel 141 would resultingly have a configuration perpendicular to the ballistic channel 141 (or, into the page as in the view of FIG. 12), i.e., a closed state of the ballistic interrupt 140.

Figure 13B:
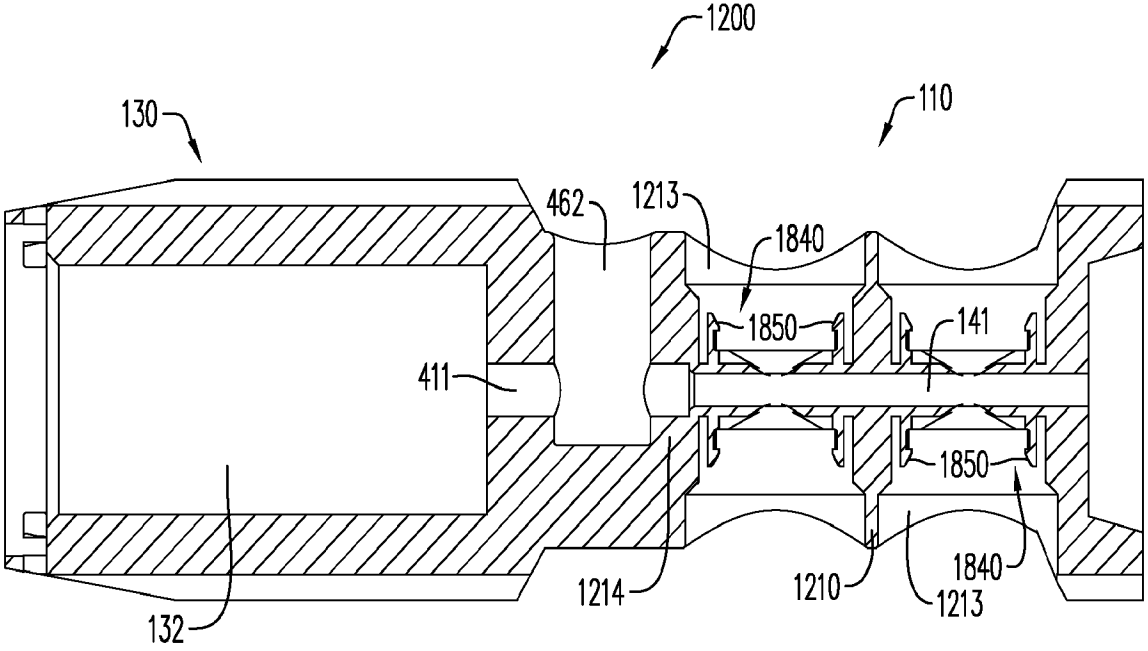
FIG. 13B is a cross-sectional view of the autonomous perforating drone according to FIG. 12, taken along the plane by view 'A' according to FIG. 13A.
Figure 13A:
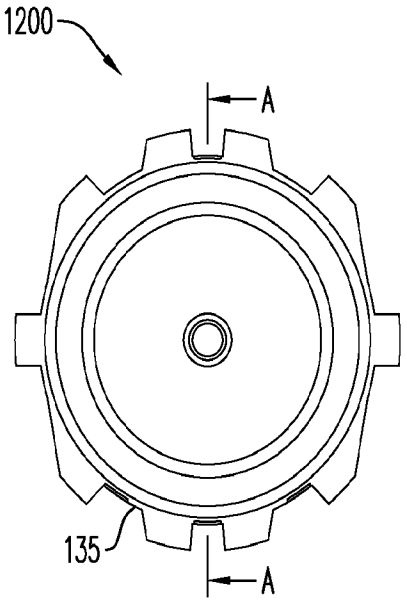
FIG. 13A is a plan view from the tip section of the exemplary autonomous perforating drone according to claim 12.

FIG. 13B shows a cross-section of the exemplary autonomous drone 1200 shown in FIG. 12 taken, according to FIG. 13A, along line A-A from the first end 135 of the control module section 130, and without the various internal components such that the internal configuration alone, including the hollow interior 132 of the control module section 130, the ballistic channel 141, the opening 462 for the ballistic actuator 460, and others as explained below, are illustrated.

With continuing reference to FIG. 12, and further reference to FIGS. 13B-15, an exemplary shaped charge 1240 as shown in FIG. 12 and for use in the arrangement of, e.g., FIG. 10B, although not limited thereto or restricted for use in that embodiment, is shown. As is well known for shaped charges, generally, and applicable commonly throughout this disclosure, the exemplary shaped charge includes a liner 1241 disposed adjacent an explosive load 1242. The liner 1241 is configured for retaining the explosive load 1242 within a cavity 1243 defined at least in part by a cylindrical sidewall 1244 including a first sidewall portion 1245 and a second sidewall portion 1246. A cap 1247 closes the shaped charge cavity 1243 from a surrounding environment as previously discussed with respect to known encapsulated shaped charges. In an aspect, the cap 1247 may not need to be crimped onto the sidewall 1244, due, for example, to the protection that the control module section 130 and tail section 180 provide against the shaped charges 1240 (i.e., caps 1247) impacting the wellbore casing. In another aspect, the cap 1247 may be formed from, without limitation, zinc, aluminum, steel, plastic, or other materials consistent with this disclosure.

In an aspect, the explosive load 1242 includes at least one of pentaerythritol tetranitrate (PETN), cyclotrimethylenetrinitramine (RDX), octahydro-1,3,5,7-tetranitro-1,3,5,7-tetrazocine/cyclotetramethylene-tetranitramine (HMX), 2,6-Bis(picrylamino)-3,5-dinitropyridine/picrylaminodinitropyridin (PYX), hexanitrostibane (HNS), triaminotrinitrobenzol (TATB), and PTB (mixture of PYX and TATB). According to an aspect, the explosive load 1242 includes diamino-3,5-dinitropyrazine-1-oxide (LLM-105). The explosive load may include a mixture of PYX and triaminotrinitrobenzol (TATB). The type of explosive material used may be based at least in part on the operational conditions in the wellbore and the temperature downhole to which the explosive may be exposed.

Figure 14A:
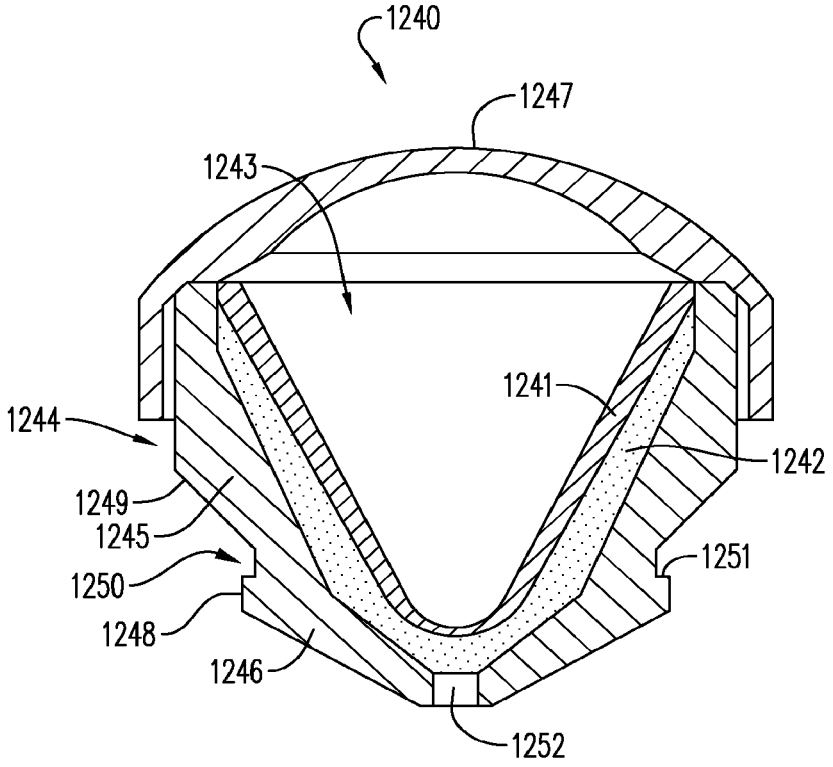
FIG. 14A shows an exemplary shaped charge for use with the exemplary autonomous perforating drone shown in FIG. 12.

In the exemplary embodiment shown in FIG. 14A, the liner 1241 has a conical configuration, however, it is contemplated that the liner 1241 may be of any known configuration consistent with this disclosure. The liner 1241 may be made of a material selected based on the target to be penetrated and may include, for example and without limitation, a plurality of powdered metals or metal alloys that are compressed to form the desired liner shape. Exemplary powdered metals and/or metal alloys include copper, tungsten, lead, nickel, bronze, molybdenum, titanium and combinations thereof. In some embodiments, the liner 1241 is made of a formed solid metal sheet, rather than compressed powdered metal and/or metal alloys. In another embodiment, the liner 1241 is made of a non-metal material, such as glass, cement, high-density composite or plastic. Typical liner constituents and formation techniques are further described in commonly-owned U.S. Pat. No. 9,862,027, which is incorporated by reference herein in its entirety to the extent that it is consistent with this disclosure. When the shaped charge 1240 is initiated, the explosive load 1242 detonates and creates a detonation wave that causes the liner 1241 to collapse and be expelled from the shaped charge 1240. The expelled liner 1241 produces a forward-moving perforating jet that moves at a high velocity.

Figure 14B:
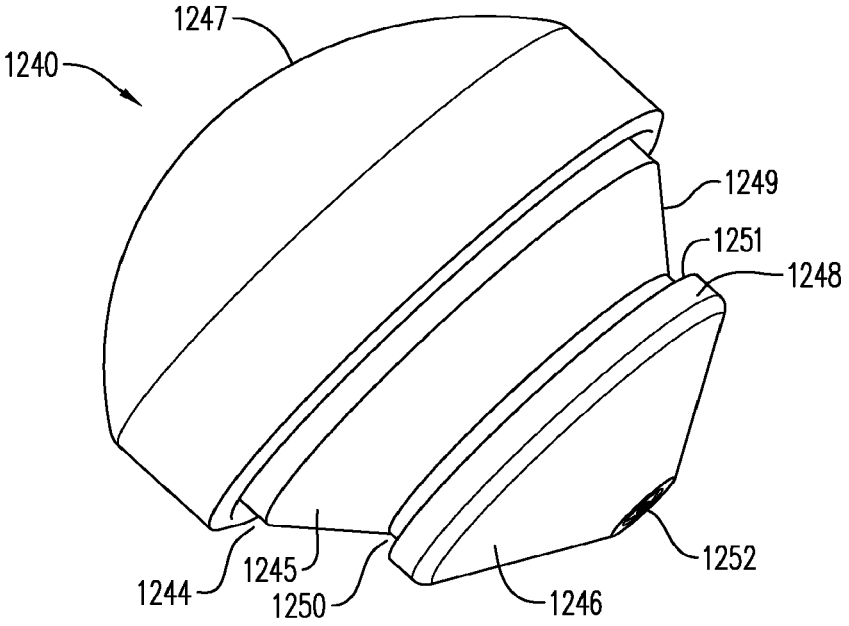
FIG. 14B shows a non-cross-sectional view of the exemplary shaped charge according to FIG. 14A.

With continuing reference to FIGS. 12 and 14A-14B, an engagement member 1248 outwardly extends from an external surface 1249 of the side wall 1244 at a position substantially between the first sidewall portion 1245 and the second sidewall portion 1246. In an aspect, the engagement member 1248 may be configured for coupling the shaped charge 1240 within a shaped charge holder 1840 within an aperture 1213 at least partially within an interior 1214 of the perforating assembly section body 1210. In the exemplary embodiment, the engagement member 1248 at least in part defines a groove 1250 circumferentially extending around the side wall 1244. The groove 1250 defines a seat 1251 for engaging a retention device, such as one or more clips 1850 within the shaped charge holder 1840 for retaining the shaped charge 1240 within the shaped charge holder 1840. When the shaped charges 1240 are retained in the shaped charge holders 1840, an initiation point 1252 of each shaped charge 1240 is adjacent the ballistic channel 141 including, e.g., the receiver booster 150 for initiating detonation of the shaped charges 1240 in the exemplary embodiments.

Figure 15:
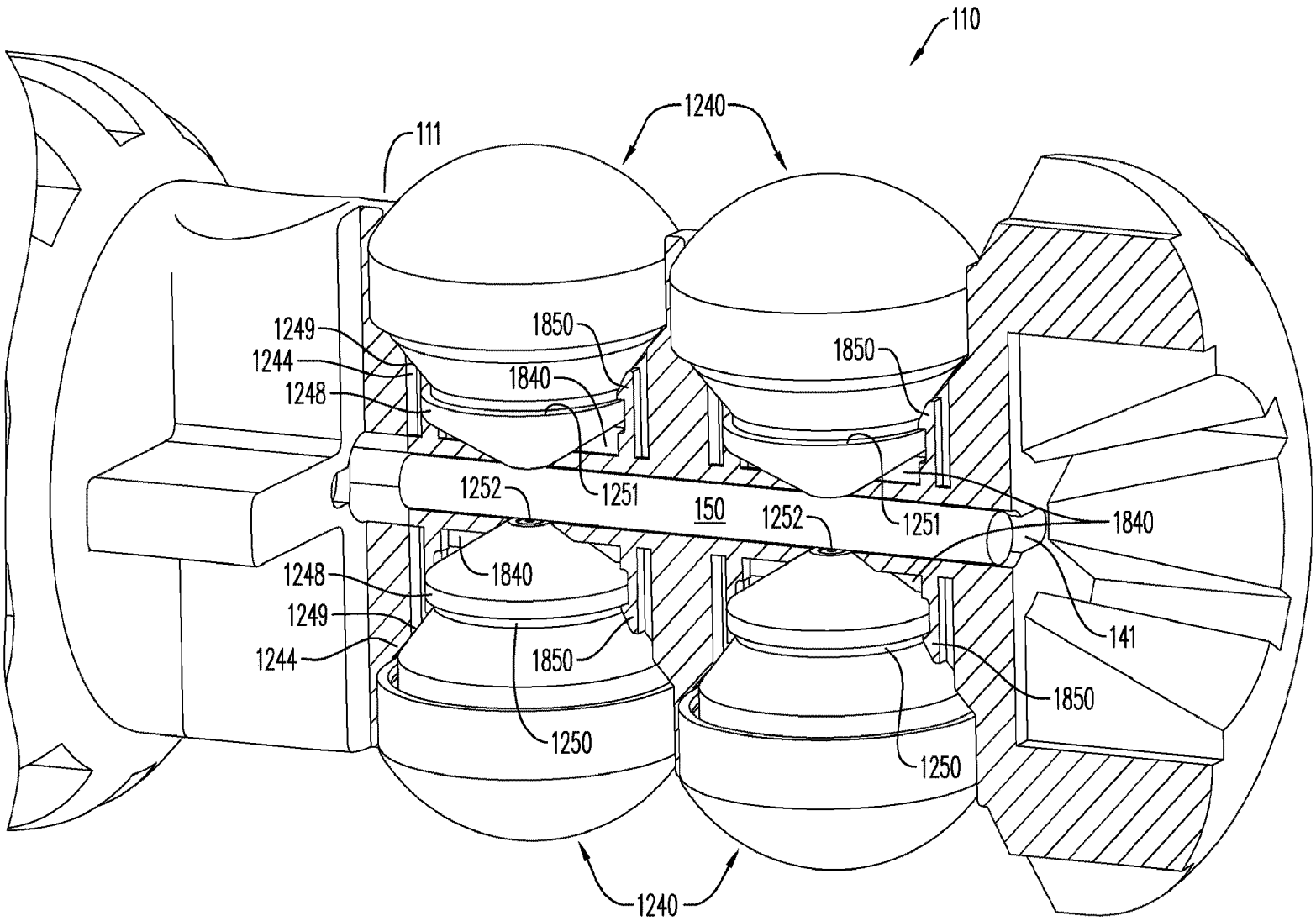
FIG. 15 shows a blown-up view of the shaped charges received in the exemplary perforating gun assembly section according to FIG. 12.

With reference now to FIG. 15, a blown-up view of the shaped charges 1240 received in the shaped charge holders 1840 according to FIGS. 12-14B is shown. When a shaped charge 1240 is received in a corresponding shaped charge holder 1840, clips 1850 engage against the seat 1251 formed on the groove 1250 defined by the engagement member 1248 extending outwardly from the external surface 1249 of the side wall 1244. As shown in FIG. 12, a receiver booster 150 is positioned within the ballistic channel 141 of the autonomous perforating gun 1200, adjacent to an initiation point 1252 of each shaped charge.

In an aspect, shaped charges arranged according to any of the exemplary embodiment(s) shown in FIGS. 10A-15 in which shaped charges are arranged adjacent to a detonator, receiver booster, donor charge, etc. in the absence or optional absence of a detonating cord, may be directly initiated by one or more of the adjacent detonator, receiver booster, donor charge, etc.

Figure 16:
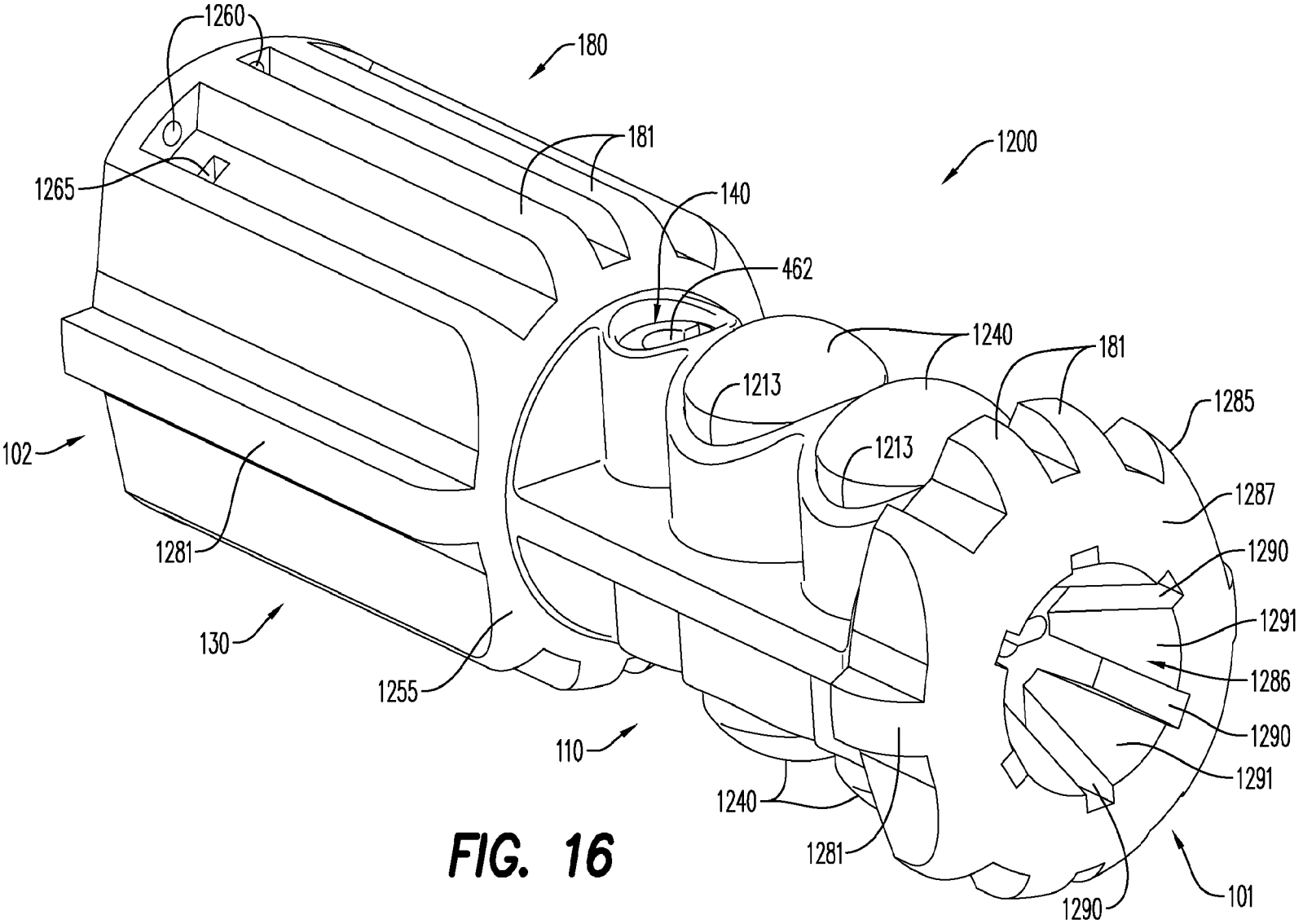
FIG. 16 shows a perspective view of an autonomous perforating drone according to an exemplary embodiment.

With reference now to the exemplary embodiment shown in FIG. 16, an autonomous perforating drone 1200 includes a perforating assembly section 110 positioned between and connected to each of a head portion 1285 at a first end 101 of the drone 1200 and a control module section 130 at a second end of the drone 1200. Except where otherwise noted, various aspects of the exemplary drones 100, 1200 disclosed herein are common to the embodiment shown in FIG. 16 and for brevity will not be repeated here. Further, as previously noted, references to portions such as the head portion 1285, perforating assembly section 110, and control module section 130 are to aid generally in describing the location of certain components and do not imply any particular assembly, delineation between sections, or other limits on the configuration of the structures and components. In an aspect, the exemplary drone 1200 shown in FIG. 16 may be an integrally formed piece, as additionally shown in FIGS. 17, 20 and 21, and a drone body 1255 is referenced for simplicity to identify the structure(s) that define, house, or retain the various features of the drone 1200, except where otherwise indicated.

Figure 19:
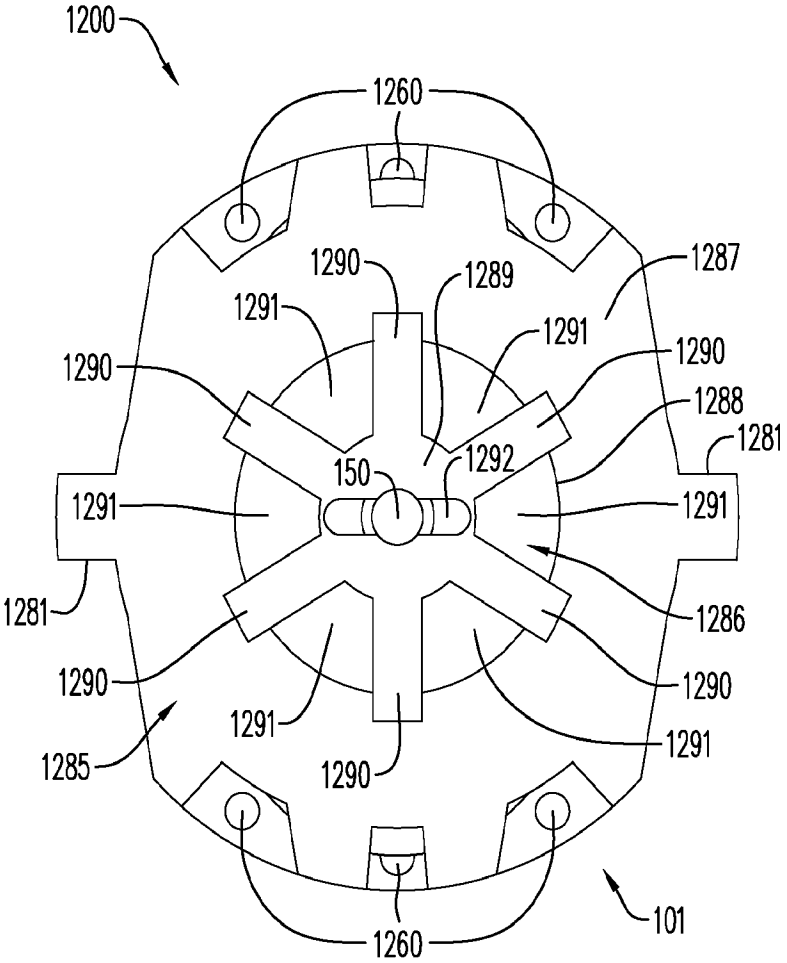
FIG. 19 shows a front plan view of the autonomous perforating drone shown in FIG. 16.
Figure 20:
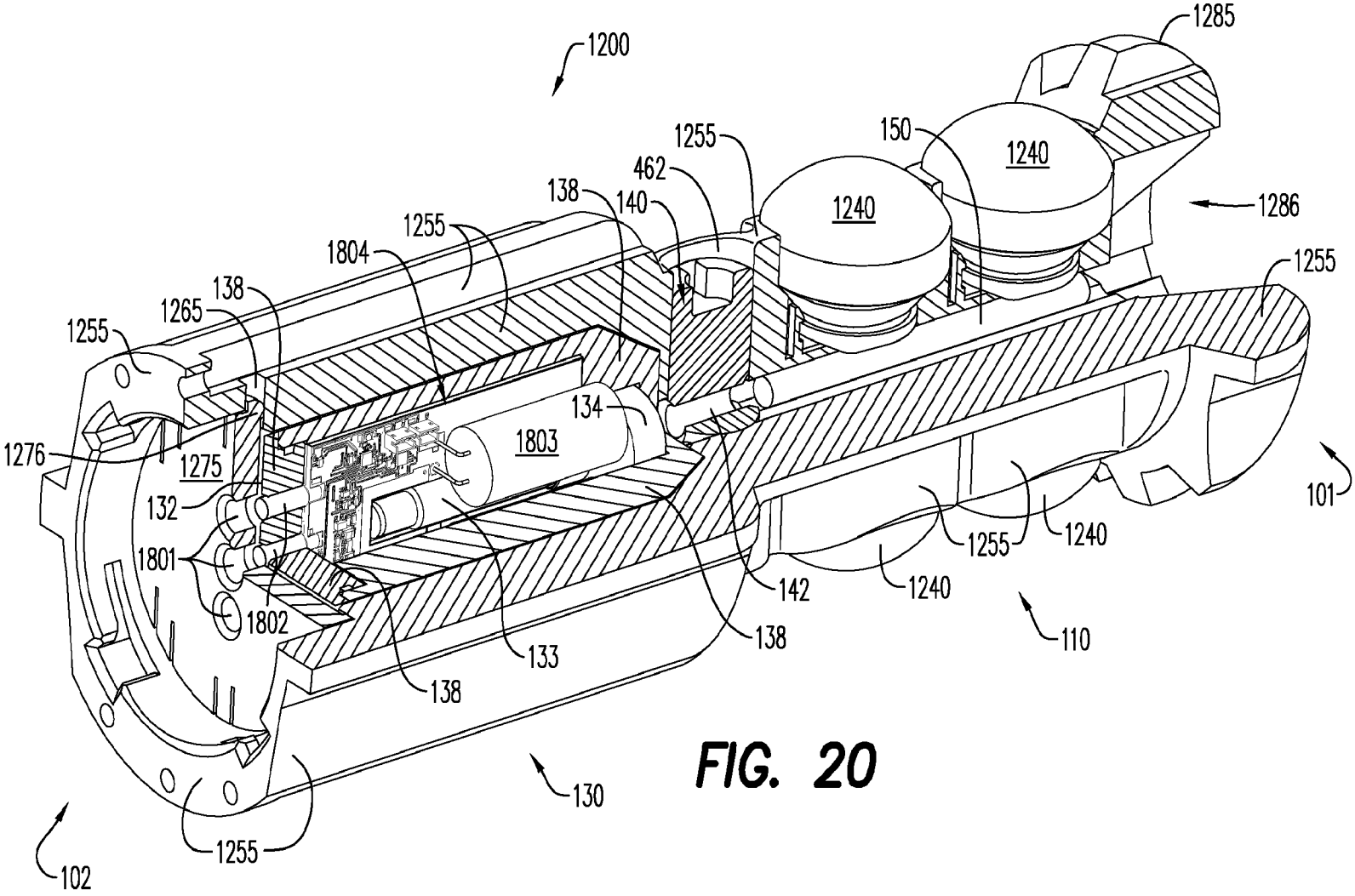
FIG. 20 shows a partial cutaway view of the autonomous perforating drone shown in the perspective of FIG. 17.

The control module section 130 in the exemplary embodiment shown in FIG. 16 and FIG. 20 is notably located upstream of the perforating assembly section 110 with respect to an orientation of the drone 1200 as it travels down a wellbore—that is, the control module section 130 is above the perforating assembly section 110 in the tail section 180 of the drone 1200. With additional reference to FIG. 20, the control module section 130 includes a hollow interior portion 132 (as previously discussed) within which a control assembly, referred to interchangeably for purposes of this embodiment but without limitation and not implying a difference between the various embodiments, as a Control Interface Unit (CIU) 1804 is positioned and housed, as discussed below. As described below, the exemplary drone 1200 shown in FIGS. 16-21 includes a configuration in which, e.g., shaped charges carried by the drone are detonated in a top-down sequence, while still addressing problems in the existing art in an alternative approach from embodiments of a drone in which shaped charges are detonated in a bottom-up sequence, as disclosed herein.

As previously described, both the head portion 1285 and the tail section 180 of the drone 1200 may be formed with fins 181. Particularly pronounced fins 1281 may be present on one or both of the head portion 1285 and the tail section 180 and may be used, for example, to further lessen impacts against critical components of the drone 1200 and/or provide an engagement means for a mechanical implement to grip and move the drone as part of a management and/or launcher system for drones, for example as described in co-owned U.S. patent application Ser. No. 16/423,230, incorporated herein by reference.

Tail section 180/control module section 130 may further include pass-through holes 1260 in a rear area of the tail section 180/control module section 130. The pass-through holes 1260 may, without limitation, provide a channel for fluid running through fins 181 to flow through, thus reducing friction on the drone 1200, and may also be part of an engagement structure by which a mechanical implement for moving the drones, as mentioned above, may engage the drone 1200 for moving it as part of moving, making an electrical connection to, and/or launching the drone 1200, or other operations of the like. With additional reference to FIGS. 17 and 20-21, the control module section 130 may further include a passage 1265 through the drone body 1255 for accessing a sealing access plate 1275 that encloses, seals, and protects the components within the hollow interior 132 of the control module section 130. The passage 1265 is discussed further below.

As previously described with respect to other embodiments, the perforating assembly section 110 includes at least one aperture 1213 configured for receiving a shaped charge 140 at least in part within the body 1255 of the drone 1200. For purposes of the embodiment(s) shown in FIGS. 16-21, retaining the shaped charges 1240 within the apertures 1213 may be accomplished by any known means. In the exemplary embodiment of FIG. 16, retaining the shaped charges 1240 within the apertures 1213 may be accomplished according to the shaped charges and associated assemblies shown and described with respect to FIGS. 12-15. For purposes of convenience and not limitation, such description or labeling is not repeated here.

The exemplary embodiment(s) shown in FIGS. 16, 17, 20, and 21 include opposing apertures 1213 and thus shaped charges 1240, such that the charges will ideally fire at 180 degrees to each other. The ballistic interrupt 140, as previously described, is retained within the drone body 1255 through an opening 462 in the drone body 1255. The ballistic interrupt 140 in the exemplary embodiment and for purposes of preventing accidental or unintended detonation of the shaped charges is positioned, in any event, between an initiator within the control module section 130 and a shaped charge initiator configured for being initiated by the initiator in the control module (as discussed with respect to other embodiment(s) and further described below).

The head portion 1285 of the drone 1200 is sized and shaped, as previously discussed, to help reduce impacts between the drone 1200 and the wellbore casing as the drone 1200 travels down the well. The exemplary head portion 1285 shown in FIG. 16 is defined by a generally circularly-shaped outer body portion 1287 of the head portion 1285. A concavity 1286 is formed substantially in the center of the head portion 1285 and an upper ledge 1288 (FIG. 19) of the concavity 1286 is defined by the outer body portion 1287. As described below with additional reference to FIGS. 19 and 20, a series of slopes 1291 extend inward into the head portion 1285, between the outer body portion 1287 and a bottom surface 1289 of the concavity 1286, in a direction towards the perforating assembly section 110. The series of slopes 1291 taper inward towards a common center that is substantially aligned with a booster 150 within the drone body 1255 (as discussed with respect to FIGS. 20 and 21) and are interposed with slits 1290, resulting in the star-shaped profile of the concavity 1286 seen in the straight-on view of the exemplary embodiment of FIG. 19.

As mentioned throughout this disclosure, the head portion 1285, perforating assembly section 110, and tail section 180 may take any form consistent with this disclosure. For example, an embodiment of a head portion may be torpedo or arrow shaped, have fins including a curved profile, or any other configuration consistent with the application(s). The exemplary head portion 1285 shown in FIG. 16 may help with any or all, and without limitation, of increasing rotational speed of the drone 1200 or slowing a forward speed of the drone 1200 when it is traveling through a wellbore fluid, funneling the wellbore fluid through which it travels to help centralize the drone in the wellbore, and enhance the destructibility or break-up of the head portion 1285 when the drone 1200 is detonated. The shaped charges 1240 of a drone 1200 as in the exemplary embodiment shown in FIG. 16 will detonate in a top-down sequence—i.e., upstream to downstream—when the drone is detonated, due to the configuration of the drone as described with respect to FIGS. 16-21.

Figure 17:
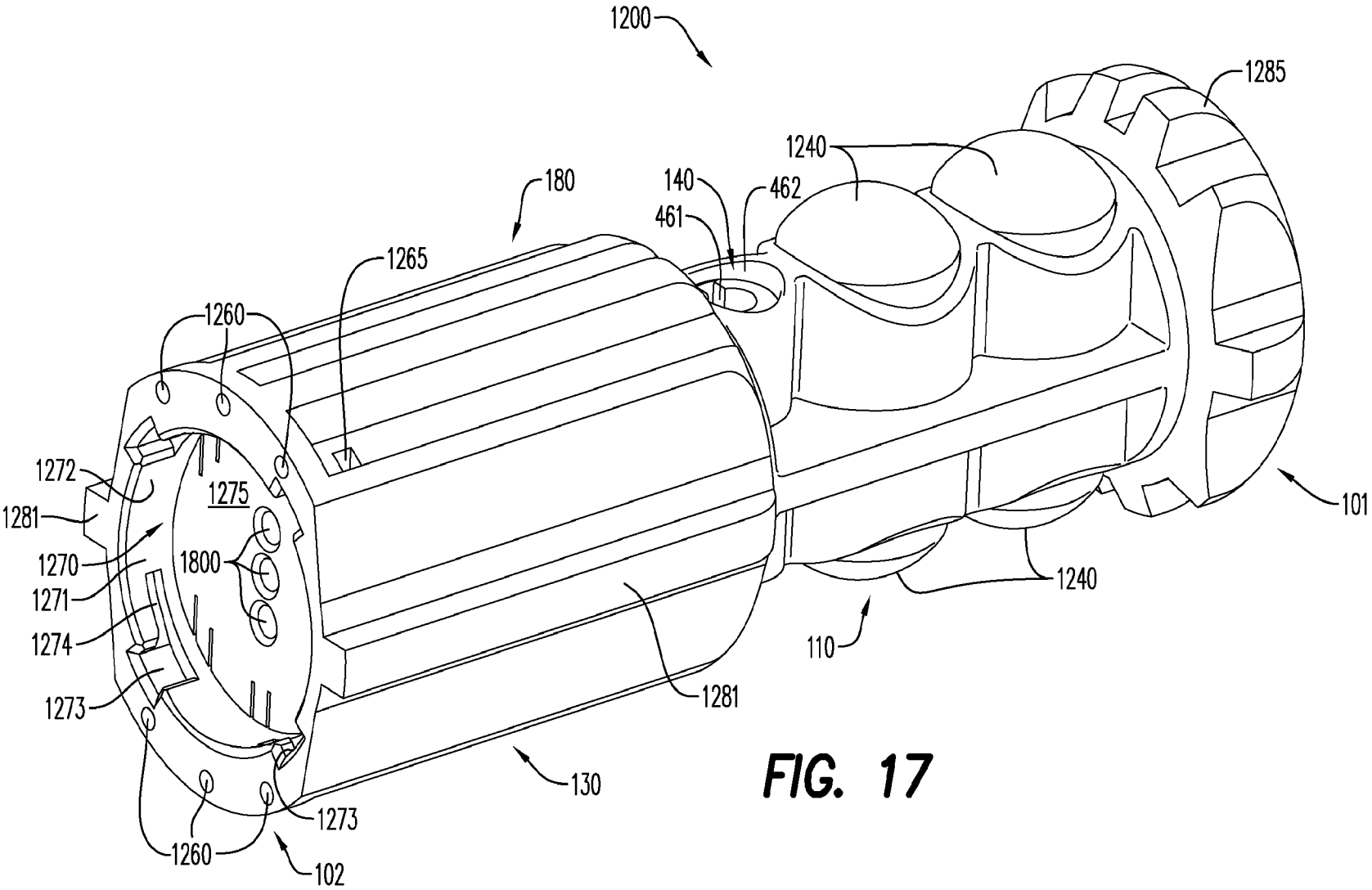
FIG. 17 shows a reverse perspective view of the autonomous perforating drone shown in FIG. 16.

With reference to FIG. 17, the exemplary embodiment of the drone 1200 shown in FIG. 16 is illustrated from a reverse perspective such that the second end 102 and rear of the control module section 130 may be seen. The control module section 130 at the second end 102 includes the sealing access plate 1275 that seals the internal components of the control module section 130. The sealing access plate 1275 includes the charging and programming contacts 1800 as discussed above. The charging and programming contacts 1800 are further described below especially with respect to FIGS. 18 and 20-25. The sealing access plate 1275 is set back within a recess 1270 of the tail section 180, the recess defined by the body portion 1255 of the drone 1200 extending outwardly from the tail section 180. This may provide additional protection to the sealing access plate 1275 and allow for the inclusion of different structures that will now be described.

For example, the annular portion of the tail section 180 extending beyond the sealing access plate 1275 defines a wall 1271 around the recess 1270. The wall has an interior surface 1272 on which engagement structures may be formed. In the exemplary embodiment shown in FIG. 17, the engagement structures include receiving slots 1273 extending longitudinally through the wall as cut-outs between the second end 102 and towards the sealing access plate 1275. The slots 1273 terminate at retaining channels 1274 that are open to and extend from the slots in a circumferential direction around the interior surface 1272 of the wall 1271. The slot 1273/channel 1274 configuration may receive a complimentary connecting element through the slot 1273 and into the channel 1274, and thereby be securely yet removable retained to the second end 102 of the drone 1200. The connection may be, without limitation, to another autonomous perforating drone having a complementary connecting structure on its head portion, to a mechanical implement for engaging and holding the drone 1200 such that the drone 1200 may be moved and/or loaded into a wellbore, or may be an attachment means for other wellbore tools, such as data collection devices, to connect to the drone 1200. In a case where a series of drones or wellbore tools are connected in series as a string, an aspect of the string may be that a single drone or tool, for example the most upstream drone or tool, contains a single CIU for controlling each drone or tool in the string.

Figure 18:
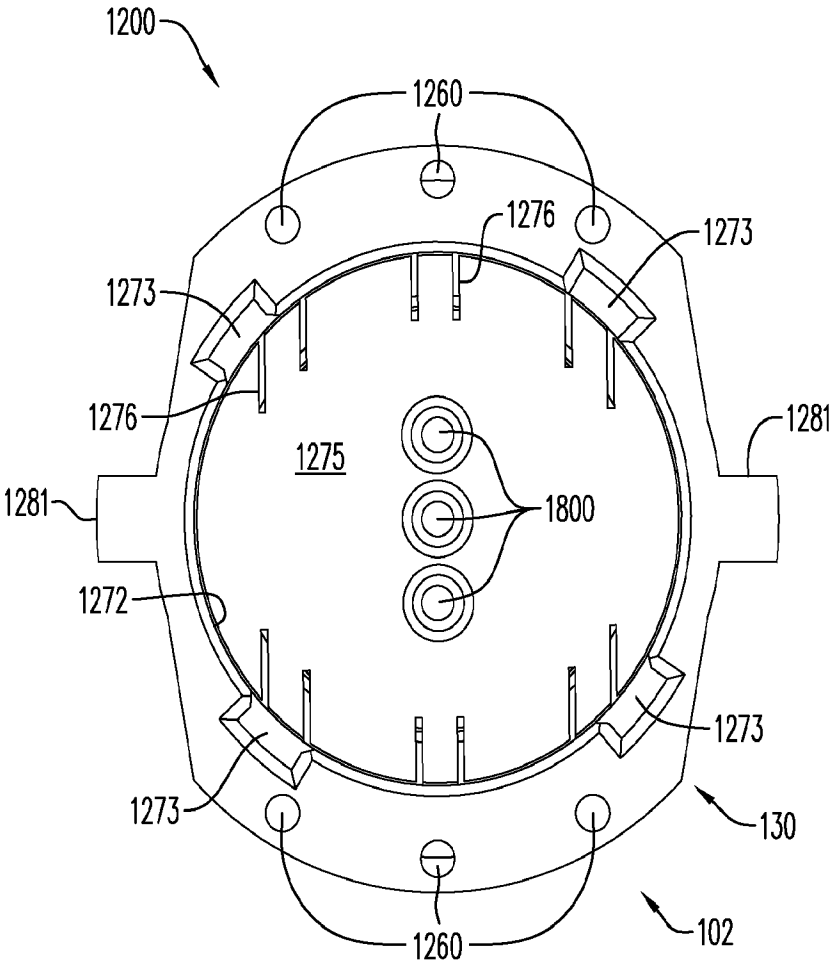
FIG. 18 shows a rear plan view of the autonomous perforating drone shown in FIG. 16.

FIG. 18 shows a rear plan view of the exemplary drone 1200 shown in FIG. 17. As previously discussed, the rear plan view shows the relationship between the different components, including the passages 1260, slots 1273, and pronounced fins 1281, of which one or more may be used to engage with a mechanical implement for moving the drone 1200 as discussed above. Charging and programming contacts 1800 are accessible through the sealing access plate 1275. Sealing access plate 1275 additionally includes a plurality of slits 1276 formed in the sealing access plate 1275 for providing the sealing access plate 1275 with additional manipulability such that the sealing access plate 1275 may be attached to and removed from the drone 1200 as discussed below with respect to FIGS. 20 and 21.

FIG. 19 shows a front plan view of the exemplary drone 1200 as shown in FIG. 16, wherein passages 1260 are visible through spaces between the fins 181 of the head portion 1285. As previously discussed, FIG. 19 illustrates the star-shaped configuration of the concavity 1286 in the head portion 1285. Also visible in FIG. 19 is an aperture 1292 that opens certain areas of the drone body 1255 to a surrounding environment. The aperture 1292 may provide benefits in forming the drone body 1255 or in a flow profile as the drone 1200 travels through a wellbore. As discussed herein, the CIU 1804 may be provided in, e.g., a sealed control module housing 138, and the CIU 1804 and/or other components may be sealed against the environmental aspects by known techniques, or those disclosed herein, such as for providing sealed boosters, detonators, shaped charges, and the like.

Figure 23:
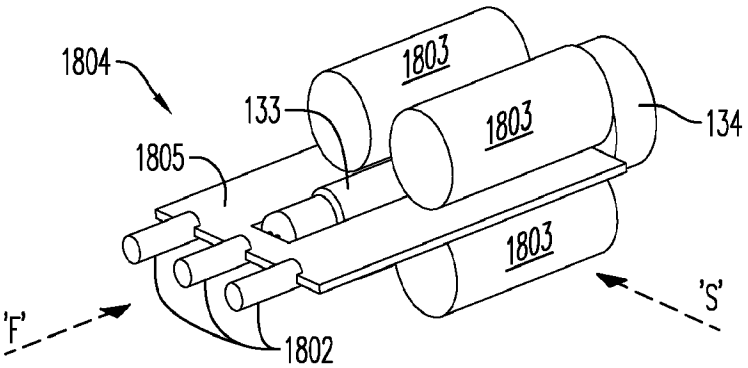
FIG. 23 shows an exemplary Control Interface Unit for use with the exemplary embodiments described herein.

With reference now to FIG. 20, a partial cutaway of the exemplary drone 1200 is shown. The CIU 1804 is housed within a control module housing 138 positioned within the hollow interior portion 132 of the control module section 130. The cross section shown in FIG. 20 depicts that charging and programming contacts 1800 include pin contact leads 1802 electrically connected to the CIU 1804, for example, to a programmable electronic circuit which may be contained on a Printed Circuit Board (PCB) 1805 (FIG. 23). The pin contact leads 1802 may be exposed through, and sealed within, apertures 1801 through the sealing access plate 1275. As previously discussed, a number of known techniques exist for sealing the CIU 1804 and, e.g., the pin contact leads 1802, from external conditions.

Figure 21:
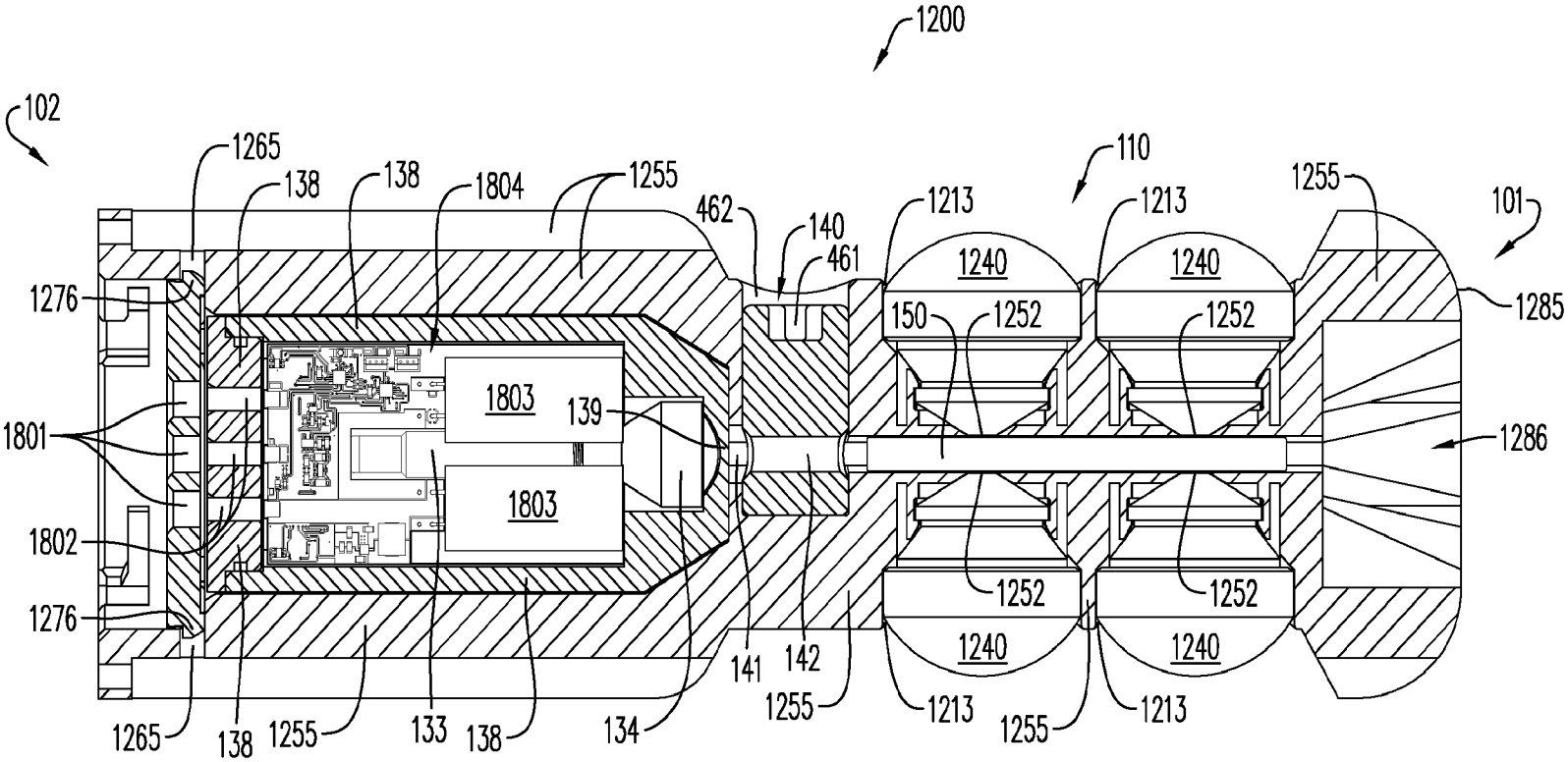
FIG. 21 shows a side cross-sectional view taken longitudinally through the autonomous perforating drone shown in FIG. 16.

As further shown in FIG. 20, and with further reference to FIG. 21, sealing access plate 1275 includes sealing portions 1276 on a periphery of the sealing access plate 1275. The sealing portions 1276 in the exemplary embodiment are formed from a material and configured with a geometry to form a seal within the passages 1265 through the drone body 1255. This technique both seals the internal components of the control module section 130 from external conditions and allows the sealing access plate 1275 to be removed and re-secured within the control module section 130, although other techniques as known and consistent with this disclosure may be used.

With continuing reference to FIG. 20, the CIU 1804 may contain such electronic systems such as power supplies, programmable circuits, sensors, processors, and the like, as described throughout this disclosure. In an exemplary embodiment, the CIU 1804 further includes capacitor 1803 power supplies, a detonator 133, and the donor charge 134. According to previous embodiments, the detonator 133 is configured for initiating the donor charge 134 upon receiving a signal to detonate the drone 1200. As further shown and discussed, below, with respect to FIGS. 23-25, the detonator 133 in the exemplary configuration may be surrounded by the one or more capacitors 1803 for powering the CIU 1804 and associated components. The detonator 133 may include a Non-Mass Explosive (NME) body and the donor charge 134 may be integrated with the explosive load of the detonator 133. In an aspect of integrating the donor charge 134 with the explosive load of the detonator 133, the amount of explosive may be adjusted to accommodate the donor charge 134 and the size and spacing of components such as a ballistic channel 141 along which the jet from the donor charge propagates, and the ballistic interrupt 140 and a receiver booster 150 positioned within the ballistic channel.

In an aspect, the CIU 1804 may include the PCB 1805 and a fuse for initiating the detonator 133 may be attached directly to the PCB 1805. In an aspect of those embodiments, the detonator 133 may be connected to a non-charged firing panel—for example, a selective detonator may be attached to the PCB 1805 such that upon receiving a selective detonation signal the firing sequence, controls, and power may be supplied by components of the PCB or CIU via the PCB. This can enhance safety and potentially allow shipping the fully assembled drone in compliance with transportation regulations if the ballistic interrupt is in the closed position. Connections for the detonator/detonator components on the PCB board may be, without limitation, sealed contact pins or concentric rings with o-ring/groove seals to prevent the introduction of moisture, debris, and other undesirable materials.

In an aspect, the CIU 1804 may be configured without a control module housing 138. For example, the CIU 1804 may be contained within the hollow interior portion 132 of the control module section 130 and sealed from external conditions by the drone body 1255 itself. Alternatively, the CIU 1804 may be housed within an injection molded case and sealed within the body 1255. The injection molded case may be potted on the inside to add additional stability. In addition, or alternatively, the control module housing 138 or other volume in which the CIU 1804 is positioned may be filled with a fluid to serve as a buffer. An exemplary fluid is a non-conductive oil, such as mineral insulating oil, that will not compromise the CIU components including, e.g., the detonator. The control module housing 138 may also be a plastic carrier or housing to reduce weight versus a metal casing. In any configuration including a control module housing 138 the CIU components may be potted in place within the control module housing 138, or alternatively potted in place within whatever space the CIU 1804 occupies.

With continuing reference to FIGS. 20 and 21, and the exemplary embodiment, the detonator 133 and donor charge 134 are contained within a control module housing 138 and the donor charge 134 is substantially aligned with the ballistic channel 141. Upon detonation of the detonator 133, the donor charge 134 is initiated and the jet from the donor charge 134 will pierce a portion 139 of the control module housing 138 that is positioned between the donor charge 134 and the ballistic channel 141, according to operation as described throughout this disclosure. The ballistic interrupt 140 and receiver booster 150 are positioned in a spaced apart relationship within the ballistic channel 141, and the ballistic interrupt 140 lies between the donor charge 134 and the receiver booster 150 such that, in the closed position, the ballistic interrupt 140 prevents the jet from the donor charge 134 from reaching and initiating the receiver booster 150, as has been described herein. The ballistic interrupt 140 in the exemplary embodiments shown in each of FIGS. 20 and 21 is shown in the open position—i.e., the through-bore 142 of the ballistic interrupt 140 is parallel and coaxial with the longitudinal axis of the ballistic channel 141. As has been discussed herein, the ballistic interrupt 140 is movable between a closed and an open state by, for example and without limitation, rotating the ballistic interrupt 140 between open and closed states via the keyway 461.

The ballistic channel 141 is open to and extends from the hollow interior portion 132 of the control module section 130 towards the perforating assembly section 110. As shown in FIGS. 20 and 21, the receiver booster 150 extends, within the ballistic channel 141, through a length of the perforating assembly section 110 adjacent the shaped charges 140 retained in the shaped charge apertures 1213 extending into a portion of the drone body 1255. The shaped charges 1240 in the exemplary embodiments shown in FIGS. 20 and 21 are received and secured in the shaped charge apertures 1213 in substantially the same was as has been described with respect to FIGS. 12-15 and will not be repeated here. Accordingly, an initiation end 1252 of the shaped charges 1240 within the shaped charge apertures 1213 are, by the exemplary configuration, directly initiated by detonation of the receiver booster 150. In alternative embodiments, the configuration may be applied with one or more of a detonator, detonating cord, or other initiation device consistent with the receiver booster 150 in the ballistic channel 141, in place of or in combination with the receiver booster 150.

Figure 22:
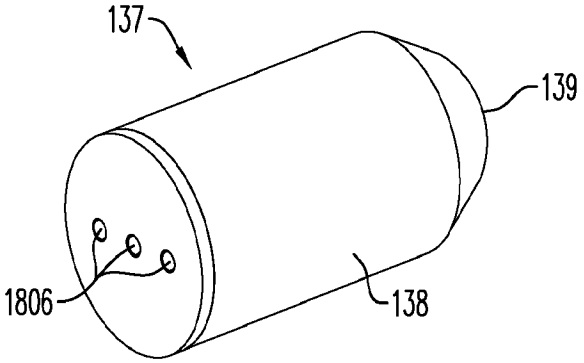
FIG. 22 shows a perspective view of an exemplary control module for use with the exemplary embodiments described herein.

FIGS. 22-25 illustrate exemplary CIU 1804 assemblies for use in the exemplary embodiments. For example, FIG. 22 shows the control module 137 including control module housing 138 in which the CIU 1804 and related and/or other components may be housed within the control module section 130. The control module housing 138 includes portion 139 positioned between the donor charge 134 and the ballistic channel 141 when the drone 1200 is assembled. Control module 137 additionally includes openings 1806 for pin contact leads 1802 from the CIU 1804 to pass into the apertures 1801 of the sealing access plate 1275 and remain exposed and available for an electrical or power connection to an outside control unit. In the event that the exemplary drone(s) is being moved or loaded into a wellbore using a mechanical implement for gripping, holding, engaging to the drone, the exemplary embodiment(s) shown in FIGS. 16-21 provide the benefit of the charging and programming contacts 1800 being positioned and exposed in the area of engaging structures on the drone where a mechanical tool is likely to engage the drone. Thus, the connection to charge a power source of the drone or program the drone may be accomplished when the drone is engaged for moving/loading. The charging and programming contacts 1800 may also be used as part of a function test, safety test, arming procedure, data retrieval, and the like.

Figure 23A:
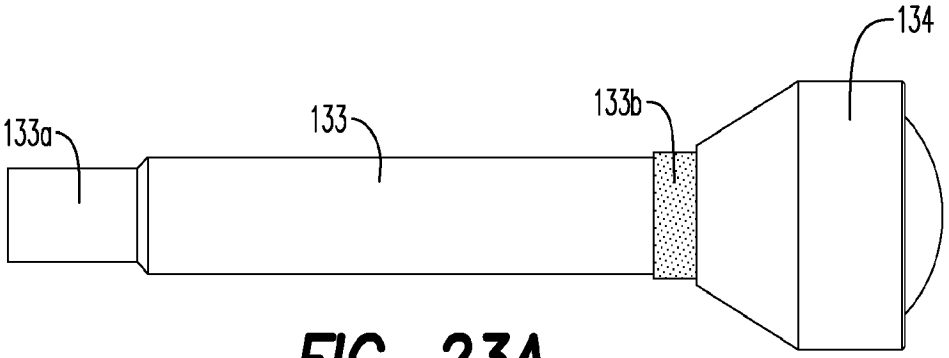
FIG. 23A shows an exemplary detonator and integrated donor charge for use with the exemplary embodiments described herein.

FIG. 23 shows the exemplary CIU 1804 for use with certain exemplary embodiments of the drone. As discussed previously, the CIU 1804 includes a PCB 1805 to which a detonator 133 is directly attached and in which the donor charge 134 is integrated with the explosive load 133*b* (FIG. 23A) of the detonator 133. FIG. 23A shows the arrangement in which a detonator fuse 133*a*, which may be directly attached to the PCB 1805, is connected to initiate the detonator 133, namely the explosive load 133*b* of the detonator 133. The donor charge 134 being integrated with the detonator 133 configures the donor charge 134 to use the explosive load 133*b* of the detonator directly, instead of to initiate a separate, or full, explosive load of the donor charge 134. Capacitors 1803 surround the detonator. Pin contact leads 1802 extend from, and are electrically connected to, e.g., a programmable electronic circuit on the PCB 1805 and/or the capacitors 1803, for charging the capacitors 1803.

Figure 24:
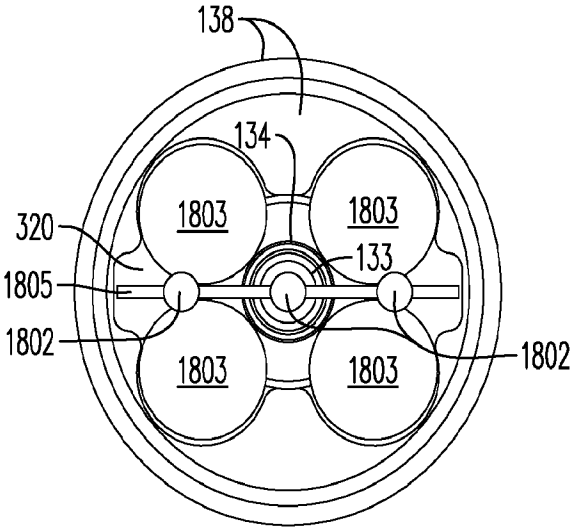
FIG. 24 shows a front cross-sectional view of the control module shown in FIG. 22 housing the Control Interface Unit shown in FIG. 23.

FIG. 24 shows a cross section of the control module 137 with the exemplary CIU 1804 contained within an inner area 320 of the control module 137 defined by the control module housing 138. From this vantage, taken along line 'F' of FIG. 23, the capacitors 1803 are seen surrounding at least a portion of each of the detonator 133 and the donor charge 134, while the PCB 1805 and pin contact leads 1802 extend in a direction out of the page.

Figure 25:
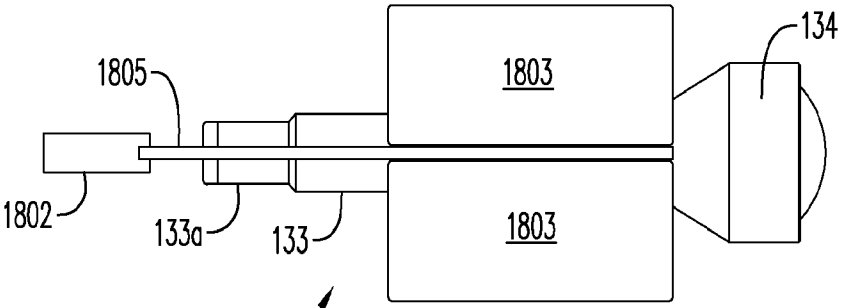
FIG. 25 shows a side view of the Control Interface Unit shown in FIG. 23; and, FIG. 26 shows an exemplary arrangement of a ballistic interrupt retention mechanism according to some embodiments.

FIG. 25 is another vantage of the exemplary CIU 1804, taken along the line 'S' of FIG. 23. Here, again, capacitors 1803 surround at least a portion of the detonator 133 and the donor charge 134. Fuse 133*a* may be connected directly to the PCB 1805 and electrically connected to a programmable electronic circuit for receiving a selective detonation command for the detonator 133 and initiating detonation in response. Pin contact leads 1802 are connected to and extend from the PCT 1805 for connection/use as part of the charging and programming contacts 1800.

With respect to the exemplary embodiment(s) presented in FIGS. 16-26, uses, methods, and variations as have been discussed throughout this disclosure remain applicable and are not repeated here.

The exemplary embodiments presented herein may be used for deploying a variety of wellbore tools downhole, as previously discussed. Thus, neither the description nor the claims necessarily excludes the use of the autonomous perforating drone described throughout this disclosure of deploying a variety of wellbore tools for activation.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. An autonomous perforating drone for downhole delivery of one or more wellbore tools, comprising:

a perforating assembly section including at least one aperture configured for receiving a shaped charge;

a control module section including a hollow interior portion;

a ballistic channel open to and extending from the hollow interior portion to the at least one aperture in the perforating assembly section;

a control module positioned within the hollow interior portion of the control module section, wherein the control module includes a housing, wherein the housing encloses a donor charge within an inner area of the control module housing and the control module is configured for initiating the donor charge in response to a detonation instruction, wherein the donor charge is positioned adjacent to the ballistic channel, and an intervening portion of the control module housing is positioned between the donor charge and the ballistic channel; and a receiver booster positioned within the ballistic channel;

wherein the donor charge is configured to produce a perforating jet upon initiation that pierces the intervening portion of the control module housing positioned between the donor charge and the ballistic channel to open communication between the inner area of the control module housing and the ballistic channel, with the perforating jet extending into the ballistic channel.

2. The autonomous perforating drone of claim 1, further comprising a ballistic interrupt positioned within the ballistic channel between the donor charge and the receiver booster in a spaced apart configuration from the donor charge and the receiver booster and including a through-bore, wherein the ballistic channel extends along a longitudinal axis of the autonomous perforating drone, the ballistic interrupt is movable between a closed state and an open state, the through-bore is substantially perpendicular to the longitudinal axis when the ballistic interrupt is in the closed state, and the ballistic interrupt is configured for preventing a perforating jet created by the donor charge from reaching the receiver booster when the ballistic interrupt is in the closed state, and the through-bore is substantially parallel to the longitudinal axis and coaxial with the ballistic channel when the ballistic interrupt is in the open state, and the donor charge is in ballistic communication with the receiver booster when the ballistic interrupt is in the open state.

3. The autonomous perforating drone of claim 1, wherein the control module section is positioned at an end of the autonomous perforating drone, and the control module section is configured for engaging a mechanism for holding and moving the autonomous perforating drone.

4. The autonomous perforating drone of claim 1, wherein the control module section includes at least one of a charging and a programming contact for providing at least one of power and instructions to the control module.

5. The autonomous perforating drone of claim 4, wherein the control module includes at least one of a battery, a capacitor, and a programmable electronic circuit.

6. The autonomous perforating drone of claim 5, wherein the control module includes the programmable electronic circuit, wherein the programmable electronic circuit includes one or more pin contacts for relaying a signal from an external control unit to the programmable electronic circuit, via the at least one of the charging and the programming contact.

7. The autonomous perforating drone of claim 6, wherein the control module includes a capacitor and a detonator, wherein the detonator is configured for initiating the donor charge and the control module is configured for initiating the donor charge by detonating the detonator in response to the detonation instruction.

8. The autonomous perforating drone of claim 7, wherein the detonation instruction is based on a threshold depth of the autonomous perforating drone in the wellbore and the programmable electronic circuit is programmed with the detonation instruction, wherein the programmable electronic circuit is configured for receiving and updating information from a depth correlation sensor regarding the depth of the autonomous perforating drone within the wellbore, determining whether the depth of the autonomous perforating drone meets the threshold depth of the detonation instruction, and transmitting a detonation signal to the detonator in response to a determination that the autonomous perforating drone has reached the threshold depth of the detonation instruction, and wherein the detonator is configured to detonate in response to the detonation signal, and thereby initiate the donor charge.

9. The autonomous perforating drone of claim 8, wherein the donor charge is integrated with an explosive load of the detonator.

10. The autonomous perforating drone of claim 1, wherein the perforating assembly section includes a plurality of apertures respectively configured for retaining a shaped charge, wherein the autonomous perforating drone is configured for detonating the shaped charges in an order from an upstream end of the perforating assembly section to a downstream end of the perforating assembly section.

11. The autonomous perforating drone of claim 1, further comprising at least one shaped charge retained in the at least one aperture, wherein at least a portion of the aperture is positioned within a body portion of the autonomous perforating drone such that at least a portion of the ballistic channel is adjacent to an initiation end of the shaped charge received within the aperture, and the ballistic channel, the aperture, and the shaped charge are together configured for direct initiation of the shaped charge by at least one of the receiver booster or a detonating cord positioned within the ballistic channel and a detonator positioned within the ballistic channel.

12. The autonomous perforating drone of claim 11, wherein the perforating assembly section includes a plurality of apertures respectively configured for retaining a shaped charge, and at least two of the apertures are configured such that shaped charges respectively received in those apertures are opposing.

13. A method for perforating a wellbore casing or hydrocarbon formation, the method comprising:

arming an autonomous perforating drone, wherein the autonomous perforating drone includes a perforating assembly section including at least one shaped charge received in an aperture, wherein at least a portion of the shaped charge and the aperture extend into a body of the autonomous perforating drone, a control module section positioned upstream of the perforating assembly section relative to an orientation of the autonomous perforating drone when deployed in the wellbore, the control module section including a hollow interior portion, a ballistic channel open to and extending from the hollow interior portion to the at least one aperture in the perforating assembly section, a control module positioned within the hollow interior portion of the control module section, wherein the control module includes a housing, wherein the housing encloses a detonator and a donor charge and the control module is configured for initiating the donor charge in response to a detonation instruction, the donor charge is positioned adjacent to the ballistic channel, and a portion of the control module housing is positioned between the donor charge and the ballistic channel, and wherein the donor charge is configured to produce a perforating jet upon initiation that forms an opening in the portion of the control module housing and travels into the ballistic channel, a receiver booster positioned within the ballistic channel, at the portion of the ballistic channel that extends to the at least one aperture, a ballistic interrupt positioned within the ballistic channel between the donor charge and the receiver booster in a spaced apart configuration from the donor charge and the receiver booster, wherein the ballistic interrupt is movable between a closed state and an open state, wherein arming the autonomous perforating drone includes moving the ballistic interrupt from the closed state to the open state;

deploying the autonomous perforating drone into the wellbore;

initiating the donor charge with the control module in response to the detonation instruction, wherein initiating the donor charge includes sending a detonation signal from the control module to the detonator, detonating the detonator in response to the detonation signal, and initiating the donor charge in response to detonating the detonator;

responsive to initiating the donor charge, producing the perforating jet;

forming, by the perforating jet, the opening in the portion of the control module housing, wherein the perforating jet extends through the opening into the ballistic channel; and detonating the at least one shaped charge.

14. The method of claim 13, wherein the ballistic interrupt includes a through-bore having a first opening and a second opening, wherein the moving the ballistic interrupt from the closed state to the open state includes moving the through-bore from an orientation that is substantially perpendicular to a longitudinal axis of the ballistic channel, with the first opening and second opening of the through-bore positioned beyond a diameter of the ballistic channel, to an orientation that is substantially parallel to the longitudinal axis and coaxial with the ballistic channel.

15. The method of claim 14, wherein moving the ballistic interrupt from the closed state to the open state places the donor charge in ballistic communication with the receiver booster, via the through-bore.

16. The method of claim 13, wherein the at least a portion of the aperture extends into the body of the autonomous perforating drone such that at least a portion of the ballistic channel is adjacent to an initiation end of the shaped charge received within the aperture, and the ballistic channel, the aperture, and the shaped charge are together configured for direct initiation of the shaped charge by at least one of the receiver booster or a detonating cord positioned within the ballistic channel and a detonator positioned within the ballistic channel, and detonating the at least one shaped charge includes directly initiating the shaped charge with the at least one of the receiver booster, the detonator, and the detonating cord.

17. The method of claim 13, further comprising performing at least one of a function test and a safety check of the autonomous perforating drone, wherein arming the autonomous perforating drone is in response to a successful result of the at least one of the function test and the safety check, wherein the autonomous perforating drone includes at least one charging and programming contact in electrical communication with the control module and the at least one of the function test and the safety check is performed by electrically connecting the control module to an external controller, via the at least one programming contact.

18. The method of claim 13, wherein the detonation instruction is based on a threshold depth of the autonomous perforating drone in the wellbore and a programmable electronic circuit is programmed with the detonation instruction, and detonating the at least one shaped charge includes, at the programmable electronic circuit, receiving and updating information from a depth correlation sensor regarding the depth of the autonomous perforating drone within the wellbore, determining whether the depth of the autonomous perforating drone meets the threshold depth of the detonation instruction, and transmitting a detonation signal to the detonator in response to a determination that the autonomous perforating drone has reached the threshold depth of the detonation instruction.

19. An autonomous perforating drone for downhole delivery of one or more wellbore tools, comprising:

a perforating assembly section;

a control module section including a hollow interior portion;

a ballistic channel open to and extending from the hollow interior portion into at least a portion of the perforating assembly section;

a control module positioned within the hollow interior portion of the control module section, and a donor charge housed within a housing of the control module and substantially aligned with the ballistic channel, wherein the control module is configured for initiating the donor charge in response to a detonation instruction and a portion of the control module housing is positioned between the donor charge and the ballistic channel, and wherein the donor charge is configured to produce a perforating jet upon initiation that pierces the portion of the control module housing to form an opening in the portion of the control module housing and that travels into the ballistic channel;

a receiver booster positioned at least in part within the portion of the ballistic channel within the perforating assembly section;

a first plurality of shaped charges received in a first plurality of shaped charge apertures in the body portion of the autonomous perforating drone positioned at the perforating assembly section, wherein the first plurality of shaped charge apertures are arranged in a first single radial plane and an initiation end of each of the first plurality of shaped charges is substantially adjacent to the receiver booster when the respective shaped charges are received in the respective shaped charge apertures; and a second plurality of shaped charges received in a second plurality of shaped charge apertures in the body portion of the autonomous perforating drone positioned at the perforating assembly section, wherein the second plurality of shaped charge apertures are arranged in a second single radial plane, wherein the second single radial plane is positioned upstream of the first single radial plane, and an initiation end of each of the second plurality of shaped charges is substantially adjacent to the receiver booster when the respective shaped charges are received in the respective shaped charge apertures.

20. The autonomous perforating drone of claim 19, further comprising a ballistic interrupt positioned within the ballistic channel between the donor charge and the receiver booster in a spaced apart configuration from the donor charge and the receiver booster, wherein the ballistic interrupt is movable between a closed state and an open state.

* * * * *